US006233422B1

(12) United States Patent
Abe et al.

(10) Patent No.: US 6,233,422 B1
(45) Date of Patent: May 15, 2001

(54) IMAGE FORMING APPARATUS HAVING TRANSFER DRUM WITH TRANSFER PAPER CHARGING MEMBER

(75) Inventors: Takuya Abe; Kiyoshi Toizumi; Fumio Shimazu, all of Chiba; Hiromu Yoshimoto, Yamabe-gun; Kouichi Yamauchi; Hiroshi Tachiki, both of Yamatokoriyama; Tomohiro Oikawa, Chiba; Yoshie Iwakura, Narashino; Atsuyuki Katoh, Tenri, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/447,434

(22) Filed: Nov. 23, 1999

Related U.S. Application Data

(62) Division of application No. 09/115,257, filed on Jul. 14, 1998, now Pat. No. 6,026,256, which is a division of application No. 08/536,100, filed on Sep. 29, 1995.

(30) Foreign Application Priority Data

| | | |
|---|---|---|
| Oct. 19, 1994 | (JP) | 6-253878 |
| Jun. 8, 1995 | (JP) | 7-142277 |
| Jun. 13, 1995 | (JP) | 7-146510 |
| Jul. 14, 1995 | (JP) | 7-179108 |

(51) Int. Cl.[7] ..... G03G 15/01
(52) U.S. Cl. ..... 399/303
(58) Field of Search ..... 399/66, 303, 304, 399/316, 317

(56) References Cited

U.S. PATENT DOCUMENTS

| | | |
|---|---|---|
| 3,837,741 | 9/1974 | Spencer . |
| 4,674,860 | 6/1987 | Tokunaga et al. . |
| 5,019,871 | 5/1991 | Takeda et al. . |
| 5,113,226 | 5/1992 | Tadokoro et al. . |
| 5,128,717 | 7/1992 | Uchikawa et al. . |
| 5,249,023 | 9/1993 | Miyashiro et al. . |
| 5,250,994 | 10/1993 | Ito et al. . |
| 5,276,483 | 1/1994 | Hasegawa et al. . |
| 5,287,144 | 2/1994 | Takeda . |
| 5,287,163 | 2/1994 | Miyashiro et al. . |
| 5,291,253 | 3/1994 | Kumasaka et al. . |
| 5,550,620 | 8/1996 | Kimura et al. . |
| 5,623,329 | 4/1997 | Yamauchi et al. . |
| 5,629,760 | 5/1997 | Hayashi et al. . |
| 5,697,034 | 12/1997 | Iwakura et al. . |
| 5,745,820 | 4/1998 | Iwakura et al. . |
| 5,771,430 | 6/1998 | Iwakura . |
| 5,799,225 | 8/1998 | Abe et al. . |

FOREIGN PATENT DOCUMENTS

| | | |
|---|---|---|
| 548 803 A1 | 6/1993 | (EP) . |
| 0 603 819 A1 | 6/1994 | (EP) . |
| 0 666 518 A2 | 8/1995 | (EP) . |
| 0 737 901 A2 | 10/1996 | (EP) . |
| 56-135865 | 10/1981 | (JP) . |
| 59-90873 | 5/1984 | (JP) . |
| 61-52673 | 3/1986 | (JP) . |
| 63-293573 | 11/1988 | (JP) . |
| 2-74975 | 3/1990 | (JP) . |

(List continued on next page.)

*Primary Examiner*—Robert Beatty

(57) ABSTRACT

An image forming apparatus includes a transfer drum which attracts and holds a transfer paper electrostatically. A voltage is applied to a conductive layer provided on an inner side of the transfer drum, and a grounded conductive electrode member is pressed against a dielectric layer provided on an outer side of the transfer drum through the transfer paper. A toner image formed on a photosensitive drum is transferred onto the transfer paper when the transfer paper is wound around the transfer drum and brought into contact with the photosensitive drum. The image forming apparatus further includes an upstream member or layer on the electrode member which charges the transfer paper in a polarity reversed to a polarity of the transfer drum, so that the transfer drum can attract the transfer sheet electrostatically in a satisfactory manner.

27 Claims, 57 Drawing Sheets

FOREIGN PATENT DOCUMENTS

| | | |
|---|---|---|
| 2-157778 | 6/1990 | (JP) . |
| 3-102385 | 4/1991 | (JP) . |
| 3-233483 | 10/1991 | (JP) . |
| 4-149464 | 5/1992 | (JP) . |
| 4-256977 | 9/1992 | (JP) . |
| 4-256978 | 9/1992 | (JP) . |
| 5-150671 | 6/1993 | (JP) . |
| 5-173435 | 7/1993 | (JP) . |
| 5-333708 | 12/1993 | (JP) . |
| 5-341618 | 12/1993 | (JP) . |
| 6-19341 | 1/1994 | (JP) . |
| 6-51645 | 2/1994 | (JP) . |
| 6-149088 | 5/1994 | (JP) . |
| 6-167892 | 6/1994 | (JP) . |
| 6-167895 | 6/1994 | (JP) . |
| 89 09949 | 10/1989 | (WO) . |

IMAGE FORMING APPARATUS HAVING TRANSFER DRUM WITH TRANSFER PAPER CHARGING MEMBER

This application is a divisional of application Ser. No. 09/115,257, filed on Jul. 14, 1998 now U.S. Pat. No. 6,026,256, which is a divisional of copending application Ser. No. 08/536,100, filed on Sep. 29, 1995, the entire contents of which are hereby incorporated by reference.

FIELD OF THE INVENTION

The present invention relates to an image forming apparatus employed in a laser printer, a copying machine, a laser facsimile and the like.

BACKGROUND OF THE INVENTION

An image forming apparatus which develops an electrostatic image formed on a photosensitive drum by adhering toner and transfers the developed image onto a transfer paper wound around a transfer drum is known.

Such an image forming apparatus includes, for example, two corona chargers within a cylinder 501 having a dielectric layer 501*a* as shown in FIG. 69: one is a corona charger 502 for attracting a transfer paper P, and the other is a corona charger 504 for transferring a toner image formed on the surface of a photosensitive drum 503 onto the transfer paper P. Including two corona chargers 502•504 makes it possible to attract the transfer paper P and transfer the toner image onto the transfer paper P independently.

Another image forming apparatus shown in FIG. 70 includes a two-layer structure cylinder 601 made of a semi-conductive layer 601*a* serving as an outer layer and a base material 601*b* serving as an inner layer, and a grip mechanism 602 for holding the transported transfer paper P around the cylinder 601. This image forming apparatus grips the end of the transported transfer paper P to hold the same around the surface of the cylinder 601 by means of the grip mechanism 602 first, then charges the surface of the cylinder 601 with electricity either by applying a voltage to the semi-conductive layer 601*a* serving as the outer layer of the cylinder 601 or triggering a discharge of a charger installed within the cylinder 601, and then transfers a toner image formed on the photosensitive drum 503 onto the transfer paper P.

However, the cylinder 501 of the image forming apparatus shown in FIG. 69 must have two corona charges 502•504 inside thereof, because the cylinder 501, which serves as a transfer roller, is of a single layer structure using the dielectric layer 501*a* alone. This structure limits the size of the cylinder 501 and presents a problem that the image forming apparatus can not be downsized.

In contrast, the cylinder 601 in the image forming apparatus shown in FIG. 70, which serves as the transfer roller, is charged by exploiting its two-layer structure to transfer the toner image onto the transfer paper P, and thus the number of the chargers can be reduced. However, the grip mechanism 602 complicates the entire structure of the image forming apparatus. Moreover, the semi-conductive layer 601*a* serving as the outer layer and the base material 601*b* serving as the inner layer must be fixed with mounting hardware and secured to each other by small screws, a double-sided adhesive tape or the like to assemble the cylinder 601. Accordingly, the image forming apparatus requires more components and presents a problem that the manufacturing costs increase.

To eliminate these problems, Japanese Laid-open Patent Application No. 2-74975/1990 discloses an image forming apparatus including a corona charger driven by a unipolar power source in the vicinity of a point where a transfer paper separates from a transfer drum made of a lamination of conductive rubber and a dielectric film on a grounded roll of metal.

With this image forming apparatus, a transfer paper is attracted to the transfer drum by inducing the charges on the dielectric film by means of the corona charger. Once the transfer paper is attracted, more charges are induced on the dielectric film, thereby enabling the transfer of a toner image onto the transfer paper.

Since this image forming apparatus uses a single charger to charge the surface of the transfer drum so as to attract the transfer paper and transfer the toner image onto the transfer paper, the transfer drum can be downsized. Also, the above image forming apparatus omits a mechanism such as the grip mechanism 602, so that the transfer paper can be attracted to the transfer drum by a simple structure.

However, since the transfer paper adheres to the transfer drum electrostatically in this image forming apparatus, some charges remain on the transfer drum, which may cause the toner to adhere to the surface of the transfer drum. Thus, these residual charges present problems such as insufficient adhesion of the transfer paper to the transfer drum or back transfer on the transfer paper, thereby degrading the quality of a resulting image.

Accordingly, Japanese Laid-open Patent Application No. 6-51645/1994 discloses a transfer device provided in the vicinity of the transfer drum in an image forming apparatus, which includes cleaning means made of a conductive fur brush for scraping off the toner adhering to the transfer drum and charge removing means for removing the charges caused by the friction between the conductive fur brush and transfer drum. Note that the charge removing means applies a voltage to the conductive fur brush in a polarity reversed to that of the surface potential of the transfer drum, so that the residual charges on the transfer drum are removed. Since not only the charges remaining on the transfer drum are removed, but also the transfer drum is cleaned, the transfer paper can adhere to the transfer drum satisfactorily and the back transfer on the transfer paper can be eliminated, thereby making it possible to produce a good-quality image.

Also, Japanese Laid-open Patent Application No. 3-102385/1991 discloses a cleaning device for an image forming apparatus which attracts a transfer paper to the surface of the transfer drum electrostatically. The cleaning device removes post-transfer residual toner on the surface of a transferring body by applying a bias voltage to a brush cleaner in a polarity reversed to that of the toner. As shown in FIG. 71, the cleaning device includes a conductive brush 702 which makes contact with the inner side of a transfer drum 701 and a cleaning brush 703 which makes contact with the outer surface of the transfer drum 701. According to this structure, the charges remaining on the transfer drum 701 are removed by the conductive brush 702, while the surface of the transfer drum 701 is cleaned by the cleaning brush 703. Thus, the transfer drum can attract the transfer paper satisfactorily and the back transfer on the transfer paper can be eliminated, thereby making it possible to produce a high-quality image.

However, the image forming apparatus disclosed in Japanese Laid-open Patent Application No. 2-74975/1990 charges the surface of the transfer drum through an atmospheric discharge by a corona charger. For this reason, if a color image is formed by repeating a transfer process a number of times, the charges are replenished by the corona charger each time a toner image is transferred onto the transfer paper. Thus, the image forming apparatus demands a charging unit comprising a unipolar power source or the like to drive the corona charger under its control. As a result, the number of components of the image forming apparatus increases, thereby presenting a problem that the manufacturing costs increase.

In addition, a flaw on the surface of the transfer drum makes an electric field area developed by the atmospheric discharge smaller, and the electric field becomes out of balance over the flaw. Such off-balance of the electric field causes a defect in a transferred image such as a white spot (void), and hence degrades the quality of a resulting image.

Also, a considerably high voltage must be applied to charge the surface of the transfer roller through the atmospheric discharge, and the driving energy of the image forming apparatus increases accordingly. Further, since the atmospheric discharge is susceptible to the environments such as the temperature and humidity of air, the surface potential of the transfer roller varies easily, which causes insufficient adhesion of the transfer paper, disordered printing, etc.

The transfer device in the image forming apparatus disclosed in Japanese Laid-open Patent Application No. 6-51645/1994 and the cleaning device disclosed in Japanese Laid-open Patent Application No. 3-102385/1991 remove the residual toner and charges on the surface of the transferring body (transfer drum) by bringing the cleaning brush into contact with the surface of the transferring body. Thus, the cleaning brush may cause a flaw on the surface of the transferring body, and the flaw on the transferring body causes a defect in the transferred toner image and degrades the quality of a resulting image.

Further, the transfer device in the image forming apparatus disclosed in Japanese Laid-open Patent Application No. 6-51645/1994 employs the conductive fur brush to prevent the transfer drum from being charged with electricity caused by the friction between the transfer drum and the brush portion while the transfer drum is being cleaned, and to remove the charges on the transfer drum. The charges on the transfer drum are removed by applying a voltage to the fur brush in a polarity reversed to that of the surface potential of the transfer drum. However, a structure such that enables satisfactory charge removal is not fully concerned, and the removal of the surface potential is not ensured in this application. Thus, there still occur problems that the residual toner causes a smudge on the back of the transfer paper and the residual charges cause insufficient adhesion of the transfer paper to the transfer drum.

Japanese Laid-open Patent Application No. 5-173435/1993 discloses an image forming apparatus which includes a transfer drum having at least an elastic layer made of a foam body and a dielectric layer covering the elastic layer. This image forming apparatus produces a color image on a transfer sheet by sequentially forming a plurality of toner images in their respective colors on a photosensitive drum and superimposing the toner images sequentially on the transfer sheet.

The above image forming apparatus applies a voltage to an attracting roller serving as charge giving means as a technique to hold the transfer sheet on the transfer drum, so that the transfer drum attracts the transfer sheet electrostatically. A space is formed between the elastic layer and dielectric layer to enhance an adhesion force, or namely, the adhesion of the transfer sheet to the transfer drum.

The image forming apparatus disclosed in Japanese Laid-open Patent Application No. 5-173435/1993 specifies neither the hardness of the elastic layer (foam body layer) nor the contacting pressure between the attracting roller and transfer drum. Further, the application is silent about the width of a close contacting portion between the attracting roller furnished with a power source and transfer drum (known as the nip width), and the time required for an arbitrary point on the transfer sheet to pass by the nip width (known as the nip time). Thus, the nip time is assumed to be constant regardless of the kind of the transfer sheet.

However, it is known that the amount of charges given to the transfer sheet during a constant nip time varies depending on the kind of the transfer sheet. Thus, it is assumed that, when the transfer drum attracts the transfer sheet electrostatically, the electrostatic adhesion force differs considerably depending on the kind of the transfer sheet. That is to say, given a constant nip time to all kinds of the transfer sheets, some kinds of the transfer sheets may not adhere to the transfer drum electrostatically in a satisfactory manner, because the amount of the charges given to the transfer sheet during the constant time varies considerably depending on the kind of the transfer sheet. Therefore, as the electrostatic adhesion force decreases over time, there may be a case that the transfer sheet separates from the transfer drum before all of the toner images in their respective colors formed on the photosensitive drum are transferred onto the transfer sheet, thereby presenting a problem that the toner images are not transferred satisfactorily.

Further, the above image forming apparatus demands at least two power sources: an attracting roller's power source for enabling the transfer drum to attract the transfer sheet, and a power source for applying a voltage to the transfer sheet in a polarity reversed to that of the toner when transferring a toner image onto the transfer sheet. Accordingly, there occurs a problem that the manufacturing costs increase.

In addition, Japanese Laid-open Patent Application No. 4-256977 discloses an image forming apparatus including an attracting roller for giving charges to transfer means to enable the transfer means to attract a transfer paper, and attracting voltage applying means for applying an attracting voltage to the attracting roller.

Also, Japanese Laid-open Patent Application No. 4-256978 discloses an image forming apparatus including, in addition to the above-mentioned attracting roller and attracting voltage applying means, transferring voltage applying means for applying a voltage to the transfer means to enable the transfer means to transfer a toner image onto the transfer paper.

In the image forming apparatuses disclosed in the above Japanese Laid-open Patent Application Nos. 4-256977 and 4-256978, the transfer paper is attracted to the transfer means in a reliable manner, and thus the toner image is transferred onto the transfer paper satisfactorily, thereby making it possible to produce a high-quality image.

However, the above two image forming apparatuses apply a high voltage to the attracting roller in the same polarity as that of the voltage applied to the transfer means. Thus, both the image forming apparatuses demand a high voltage power source, or namely, an attracting bias power source, which not only increases the number of components but also demands a safeguard against the high voltage, such as measures for leakage and insulation. Accordingly, the resulting image forming apparatuses becomes more expensive and has more complicated structure.

SUMMARY OF THE INVENTION

It is therefore an object of the present invention to provide an inexpensive image forming apparatus which can attract a transfer paper to the surface of transfer means such as a transfer drum in a stable manner so as to eliminate defects in a transferred toner image and produce a satisfactory image on the transfer paper.

To fulfill the above object, an image forming apparatus of the present invention is characterized by comprising:

(1) an image carrying body on which a toner image is formed:

(2) transfer means for transferring the toner image fomred on the image carrying body onto a transfer paper by bringing the transfer paper into contact with the image carrying body, the transfer means attracting and holding the transfer paper electrostatically, the transfer means including at least a dielectric layer on an outer surface side and a semi-conductive layer and a conductive layer on an inner surface side;

(3) voltage applying means, connected to the conductive layer, for applying a predetermined voltage to the conductive layer;

(4) potential difference generating means for pressing the transfer paper against a surface of the transfer means, and for generating a potential difference between the conductive layer to which the voltage is applied and the transfer paper; and (5) transfer paper charging means, provided on an upstream side of the potential difference generating means in a direction in which the transfer paper is transported, for charging the transfer paper in a polarity reversed to a polarity of the transfer means.

According to the above structure, the transfer paper charging means which charges the transfer paper in a polarity reversed to that of the transfer means is provided on an upstream side of the potential difference generating means in the direction in which the transfer paper is transported. Thus, the transfer paper is charged in a polarity reversed to that of the transfer means before the transfer paper is attracted to the transfer means. Accordingly, the transfer paper can adhere to the transfer means in a stable manner whether the transfer paper was negatively or positively charged before it is attracted to the transfer means. As a result, defects in a transferred toner image caused by insufficient adhesion of the transfer paper can be eliminated, thereby making it possible to transfer a toner image onto the transfer paper satisfactorily.

It is preferable that the transfer paper charging means forms a surface portion of the potential difference generating means, so that it charges the transfer-paper by the friction between the transfer paper and the surface portion. This structure makes it unnecessary to provide the transfer paper charging means and the potential difference generating means separately, which can reduce the number of the components and hence save the manufacturing costs.

To fulfill the above object, it is preferable that the image forming apparatus of the present invention further comprises:

(6) adhesive transporting means, provided on an upstream side of the potential difference generating means in a direction in which the transfer paper is transported, for pressing the transfer paper against the surface of the transfer means, and for transporting the transfer paper to the potential difference generating means while making the transfer paper adhere to the transfer means.

According to this structure, the transfer means can attract the transfer paper electrostatically and mechanically, so that the transfer paper can adhere to the transfer means in a stable manner. Thus, defects in a transferred toner image caused by insufficient adhesion of the transfer paper can be eliminated, thereby making it possible to transfer a toner image onto the transfer paper satisfactorily.

To fulfill the above object, it is preferable to enable the voltage applying means to apply an attracting voltage for attracting the transfer paper and a transferring voltage for transferring the toner image onto the transfer paper to the conductive layer of the transfer means while changing the values of these voltages. According to this structure, the value of the attracting voltage and that of the transferring voltage can be changed appropriately depending on the humidity or kind of the transfer paper. Thus, the transfer paper can adhere to the transfer means in a reliable manner, and as a result, a toner image can be transferred onto the transfer paper satisfactorily.

The amount of charges given to the transfer paper during a nip time (a time required for an arbitrary point on the transfer paper to pass by a close contacting portion between the transfer means and potential difference generating means) varies depending on the kind of the transfer paper. This means that the amount of charges on the transfer paper can be adjusted by changing the nip time depending on the kind of the transfer paper. Thus, any kind of transfer paper can adhere to the dielectric layer of the transfer means electrostatically in a stable manner.

If the relation between the nip time and the amount of charges on each kind of the transfer paper is found in advance, the nip time can be changed to an adequate nip time in which a sufficient amount of charges needed to enable the transfer paper to adhere to the transfer means in a stable manner is given efficiently. Further, it becomes easier to check how to change the current nip time to an adequate nip time for a particular kind of transfer paper to enable the transfer paper to adhere to the dielectric layer of the transfer means in a stable manner.

More specifically, physical properties such as resistivity vary in each kind of the transfer paper, and the amount of charges given to the transfer paper during the nip time varies depending on not only the physical properties of the transfer paper, but also the other conditions such as the physical properties (resistivity) of the semi-conductive layer and/or dielectric layer, or an applied voltage. However, even the conditions such as the resistivity of the semi-conductive layer and/or dielectric layer, applied voltage, or the kind of the transfer paper is changed, the relation between the nip time and the amount of charges on the transfer paper is classified into three patterns. Thus, if the relation between the nip time and the amount of charges on the transfer paper is found in advance using an arbitrary semi-conductive layer and an arbitrary dielectric layer for each kind of the transfer paper, the nip time in which a particular kind of transfer paper is charged efficiently can be found easily only by detecting the kind of the transfer paper and the pattern to which the detected kind of transfer paper belongs when the resistivity of the semi-conductive layer and/or dielectric layer, or the kind of the transfer paper is changed.

For example, when the amount of charges on the transfer paper reaches its maximal value over the nip time (PATTERN I), the nip time is set in such a manner that the amount of charges will not drop below the initial charge amount, thereby enabling the transfer paper to adhere to the dielectric layer electrostatically in a stable manner. If the nip time is set to a nip time corresponding to the maximal value, the charges are injected effectively, and hence the transfer paper can be charged efficiently.

When the amount of charges on the transfer paper increases as the nip time extends (PATTERN II), the nip time is set in such a manner that the potential difference before and after the charge injection will be in a range between 0V and 1000V inclusive in an absolute value. As a result, the transfer paper can adhere to the dielectric layer electrostatically in a stable manner. It is found from experiments that the electrostatic adhesion force of the transfer paper decreases when there is a potential difference exceeding 1000V before and after the charge injection.

When the amount of charges of the transfer paper drops below the initial charge amount as the nip time extends (PATTERN III), the nip time is set in such a manner that the amount of charges on the transfer paper will be at least 50% of the initial charge amount. As a result, the transfer paper can adhere to the dielectric layer electrostatically in a stable manner.

As has been explained, when the relation between the nip time and amount of charges on the transfer paper is found in advance for each kind of transfer paper, the nip time in which a particular kind of transfer paper is charged efficiently is found based on the kind of the transfer paper using the relation between the nip time and amount of the charges on the transfer paper. Further, when the nip time is changed for a particular kind of transfer paper based on the relation between the nip time and the amount of charges on the transfer paper, a sufficient amount of charges needed to enable that kind of transfer paper to adhere to the dielectric layer of the transfer means can be given. As a result, the transfer paper can adhere to the dielectric layer electrostatically in a stable manner.

When the transfer means includes the semi-conductive layer, the nip time can be changed easily by adjusting the hardness of the semi-conductive layer. Also, the nip time can be changed by adjusting a contacting pressure between the transfer means and potential difference generating means.

The nip time can be changed by adjusting the rotation speed of the transfer means; however, the rotation speed of the transfer means must be decreased to extend the nip time, and when the rotation speed of the transfer means is decreased, the transfer efficiency per minute decreases. In contrast, the toner-image transfer efficiency is not degraded if the nip time is changed not by the moving speed of the transfer means but by the hardness of the semi-conductive layer and/or the contacting pressure between the transfer means and potential difference generating means as has been explained. Thus, it is preferable to change the nip time by adjusting the hardness of the semi-conductive layer and/or the contacting pressure between the transfer means and potential difference generating means.

Also, to fulfill the above object, it is preferable that the image forming apparatus of the present invention further comprises:

(7) charge removing means for removing the charges on the surface of the transfer means; and/or (8) cleaning means for cleaning the surface of the transfer means.

According to this structure, the residual toner and/or residual charges are removed by the charge removing means and cleaning means, respectively. Thus, not only back transfer on the transfer paper can be eliminated, but also the transfer means can be charged in a stable manner. As a result, defects in a transferred toner image caused by insufficient adhesion of the transfer paper can be eliminated, thereby making it possible to transfer a toner image onto the transfer paper satisfactorily.

It is preferable that the charge removing means includes:

(a) a conductive member which slides on the transfer means;

(b) a charge-removing-use power source unit for applying a voltage to the conductive member;

(c) first switching means for switching the connection of the conductive member to the charge-removing-use power source unit from a grounding portion and vice versa; and (d) second switching means for switching the connection of the conductive layer to the voltage applying means from a grounding portion and vice versa.

When a roller type brush or comb-shaped brush is used as the conductive member, the charges on the transfer means can be removed while the transfer means is cleaned.

When the potential difference generating means comprises a grounded conductive electrode member and electrode member driving means for driving the electrode member to touch and separate from the transfer means, the charge removing means may include:

(e) control means for controlling the voltage applying means to apply a voltage to the transfer means in a polarity reversed to a polarity of the transfer means when a toner image has been transferred onto the transfer paper, and for controlling the electrode member driving means to bring the electrode member into contact with the transfer means by pressure.

According to the above structure, a voltage is applied to the transfer means in a polarity reversed to that of the transfer means when the toner image has been transferred onto the transfer paper and the electrode member is brought into contact with the transfer means by pressure. Given these conditions, the residual charges on the transfer means are neutralized while they are released through the electrode member. Thus, the residual charges on the transfer means are removed when the toner image has been transferred onto the transfer paper, and the transfer means can be charged in a reliable manner so as to attract the transfer paper in a stable manner. As a result, defects in a transferred toner image caused by insufficient adhesion of the transfer paper can be eliminated, thereby making it possible to transfer a toner image onto the transfer paper satisfactorily.

Also, it is preferable that the charge removing means further includes:

(f) temperature and humidity measuring means for measuring the temperature and humidity inside of the image forming apparatus; and (g) storage means for storing a value of a charge removing voltage depending on the temperature and humidity inside of the image forming apparatus to remove the charges on the transfer means.

According to this structure, the value of a charge removing voltage depending on the temperature and humidity measured by the temperature and humidity measuring means is read out from the storage means, and the voltage applying means is controlled so as to apply a voltage having the same value as the readout value to the transfer means when a toner image has been transferred onto the transfer paper. Accordingly, the transfer means can be charged in a stable manner without being affected by the temperature and humidity. As a result, defects in a transferred toner image caused by insufficient adhesion of the transfer paper can be eliminated, thereby making it possible to transfer a toner image onto the transfer paper satisfactorily.

Alternatively, a current flowing through the electrode member may be measured to determine the value of the charge removing voltage for removing the charges on the transfer means, and a voltage having the same value as the determined value is applied to the transfer means to remove the charges on the transfer means. Since the charge removing voltage can be set to an adequate value, the charges can be removed effectively.

Further, a surface potential of the transfer means may be measured to determine the value of the charge removing voltage for removing the charges on the transfer means, and a voltage having the same value of the determined value is applied to the transfer means to remove the charges on the transfer means.

If the charge removing means includes:

(h) a roller type charge removing brush for removing the charges on the dielectric layer of the transfer means as it rotates while making contact with the dielectric layer; and (i) second voltage applying means for applying a voltage, which is of the same polarity as that of a voltage applied to the conductive layer from the voltage applying means and higher than the same, to the charge removing brush.

According to this structure, the charges on the surface of the transfer means can be removed in a reliable manner. The principle of the above charge removal will be explained in the following.

According to a principle applied to a capacitor (condenser), a current flows when a polarized electrode is energized and the charges on the transfer means are removed as a consequent. However, not all of the charges are removed when the voltages of the same level are applied to the transfer means and charge removing brush, respectively. Thus, when a voltage higher than a voltage applied to the transfer means is applied to the charge removing brush, the polarized charges are attracted to the charge removing brush and removed completely. As a result, back transfer on the transfer paper caused by the toner adhering to the surface of the transfer means or defects in a transferred image caused by insufficient adhesion of the transfer paper to the transfer means due to the residual charges can be eliminated. In addition, the charges needed to attract a following transfer paper to the transfer means can be given to the surface of the transfer means.

It is preferable that the transfer means is made into a cylinder to serve as a transfer drum, and the charge removing brush is tilted with respect to a direction in which an axis of the charge removing brush intersects at right angles with a direction in which the surface of the transfer drum moves. According to this structure, the charge removing means makes contact with the transfer means in a larger area, so that the charge removing effect is upgraded without making the diameter of the charge removing means larger. As a result, the charge removing effect on the transfer means can be upgraded without upsizing the image forming apparatus and increasing the manufacturing costs.

To fulfill the above object, it is preferable that the image forming apparatus of the present invention further comprises:

(9) charge amount control means, provided on a downstream side of a transfer point between the image carrying body and transfer means in a direction in which the image carrying body moves, for controlling an amount of charges on the surface of the image carrying body.

According to this structure, the residual charges on the image carrying body can be removed when a toner image has been transferred onto the transfer paper. Accordingly, the charges on the transfer means will not be affected by the residual charges on the image carrying body. Thus, the transfer means can be charged in a stable manner, and as a result, defects in a transferred toner image caused by insufficient adhesion of the transfer paper can be eliminated, thereby making it possible to transfer a toner image onto the transfer paper satisfactorily.

If an erasing lamp is used as the charge amount control means, the structure of the charge amount control means can be simplified while saving the manufacturing costs of the charge amount control means, and thus saving the manufacturing costs of the image forming apparatus as a result.

When the transfer means is of a layered structure of the dielectric layer, semi-conductive layer, and conductive layer, which are laminated in this order from a contact surface side of the transfer paper, the charges move to the semi-conductive layer from the conductive layer in a stable manner if the semi-conductive layer and conductive layer are laminated to each other fixedly. Accordingly, the surface of the dielectric layer is charged evenly in a stable manner by the charges moved from the semi-conductive layer. As a result, the charging and discharging characteristics of the dielectric layer can be upgraded. Thus, the transfer means can be charged in a stable manner, and hence defects in a transferred toner image caused by insufficient adhesion of the transfer paper can be eliminated, thereby making it possible to transfer a toner image onto the transfer paper satisfactorily.

In particular, when the transfer means comprises a cylinder made of conductive metal, and a one-piece sheet made of at least two layers each having different volume resistivity and layered on the surface of the cylinder, the cylinder can serve as the conductive layer, and the inner layer and the outer-most layer of the one-piece sheet can serve as the semi-conductive layer and dielectric layer, respectively. Accordingly, each layer can adhere to each other fixedly.

For a fuller understanding of the nature and advantages of the invention, reference should be made to the ensuing detailed description taken in conjunction with the accompanying drawings.

BRIEF DESCRIPTION OF THE DRAWINGS

FIG. 15(*b*) is a schematic view showing a structure of an image forming apparatus in accordance with the third embodiment of the present invention, which employs a comb-shaped brush instead of the ground roller shown in FIG. 1.

FIG. 68(*b*) is a plan view of the roller type conductive brush shown in FIG. 68(*a*).

FIG. 68(*c*) is a front view of a virtual cross section a of the roller type conductive brush shown in FIG. 68(*a*).

FIG. 68(*d*) is a front view of another virtual cross section b of the roller type conductive brush shown in FIG. 68(*a*).

DESCRIPTION OF THE PREFERRED EMBODIMENTS

[FIRST EMBODIMENT]

An embodiment of the present invention will be explained in the following while referring to FIGS. 1 through 14 and FIG. 46.

Figure 2:
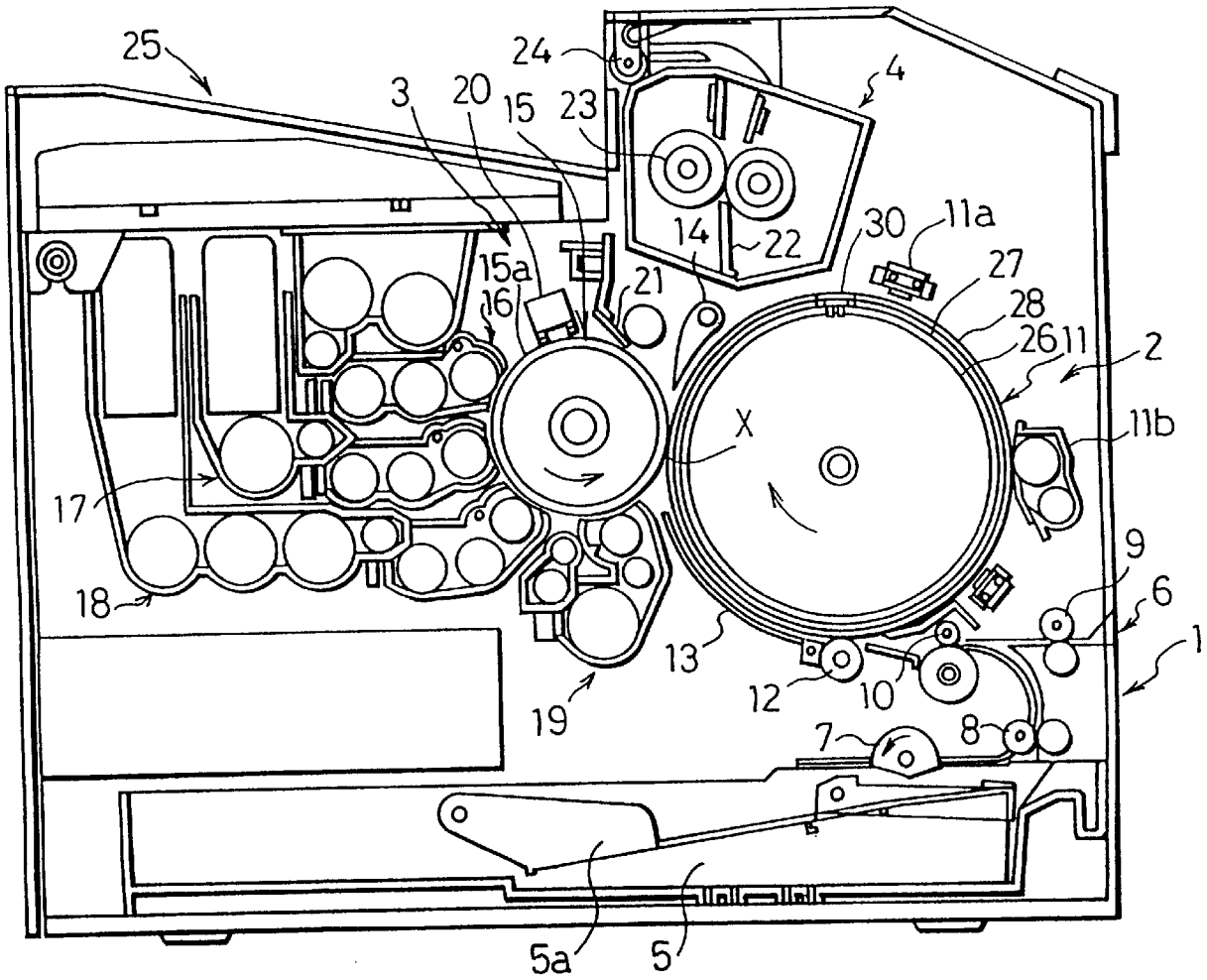
FIG. 2 is a schematic view showing a copying machine employing the image forming apparatus of FIG. 1.

As shown in FIG. 2, an image forming apparatus of the present embodiment comprises a paper feeding unit 1 for storing transfer papers as recording papers on which toner images are formed and feeding the transfer papers sequentially, a transfer unit 2 for transferring a toner image onto a transfer paper, a developing unit 3 for forming a toner image, and a fuser unit 4 for fusing the transferred toner image into place on the transfer paper.

The paper feeding unit 1 is attachable to and detachable from the lowest stage of the main body of the image forming apparatus, and includes a paper feeding cassette 5 for storing the transfer papers and feeding the transfer papers sequentially to the transfer unit 2, and a manual paper feeding unit 6, provided on the front side of the main body, for feeding one transfer paper at a time manually. The paper feeding unit 1 further includes a pick up roller 7 for sending the transfer paper on the top in the paper feeding cassette 5, a pre-feed roller (PF roller) 8 for transporting the transfer paper sent from the pick up roller 7, a manual paper feeding roller 9 for transporting the transfer paper from the manual paper feeding unit 6, and a pre-curl roller (PS roller) 10 for curling the transfer paper transported from either the PF roller 8 or manual paper feeding roller 9 before the transfer paper reaches the transfer unit 2.

The paper feeding cassette 5 includes a forwarding member 5*a* energized upward by a spring or the like, on which the transfer papers are piled. According to this structure, the transfer paper on the top of the pile in the paper feeding cassette 5 is brought into contact with the pick up roller 7, so that only the transfer paper on the top is sent to the PF roller 8 as the pick up roller 7 rotates in the direction indicated by an arrow, and further transported to the PS roller 10.

The transfer paper fed from the manual paper feeding unit 6 is also transported to the PS roller 10 by the manual paper feeding roller 9.

The PS roller 10 curls the transported transfer paper as previously mentioned, so that the transfer paper easily adheres to the surface of a cylindrical transfer drum 11 provided in the transfer unit 2.

The transfer unit 2 includes the transfer drum 11 serving as transfer means, and around which a ground roller 12 (potential difference generating means and an electrode member) made of a conductive member serving as a grounded electrode member, a guiding member 13 for guiding the transfer paper so as not to separate from the transfer drum 11, a separating claw 14 for forcefully separating the transfer paper adhering to the transfer drum 11 from the transfer drum 11, etc. are provided. The transfer drum 11 attracts a transfer paper P to the surface thereof electrostatically. For this reason, followings are further provided around the transfer drum 11: a charge removing device 11*a* serving as charge removing means for removing the charges on the surface of the transfer drum 11, and a cleaning device 11*b* serving as cleaning means for removing the toner adhering to the surface of the transfer drum 11. Note that the separating claw 14 is movable to touch and separate from the surface of the transfer drum 11, and the structure of the transfer drum 11 will be explained below in detail. The charge removing device 11*a*, cleaning device 11*b*, and separating claw 14 are driven by unillustrated driving means so as to be brought into contact with the surface of the transfer drum 11.

The developing unit 3 includes a photosensitive drum 15 serving as an image carrying body which is brought into contact with the transfer drum 11 by pressure. The photosensitive drum 15 is made of a grounded conductive aluminium tube 15*a*, and the surface thereof is covered with an OPC (organic photoconductive conductor) film.

Developers 16, 17, 18, and 19, which are filled with toner in yellow, magenta, cyan, and black, respectively, are provided radially around the photosensitive drum 15. Also, provided around the photosensitive drum 15 are: a charger 20 for charging the surface of the photosensitive drum 15, an unillustrated image spacing eraser, and a cleaning blade 21 serving as toner removing means for scraping off residual toner on the surface of the photosensitive drum 15. According to this structure, a toner image is formed on the photosensitive drum 15 for each color. That is to say, a series of charging, exposure, development, and transfer operations is repeated for each color with the photosensitive drum 15. Note that the surface of the photosensitive drum 15 is exposed by being irradiated with a beam of light emanated from an unillustrated optical series through a space between the charger 20 and cleaning blade 21.

Thus, when transferring color toner images, one toner image in one color is transferred onto the transfer paper adhering to the transfer drum 11 each time the transfer drum 11 makes a full turn; the transfer drum 11 rotates up to four times to form a color image.

Note that the photosensitive drum 15 and transfer drum 11 of the present embodiment press against each other so that a pressure of 2 to 8 kg is applied to a portion where a toner image is transferred onto the transfer paper to enhance transfer efficiency and the image quality.

The fuser unit 4 includes a fixing roller 23 for fusing a toner image into place on the transfer paper at a certain temperature and under a certain pressure, and a fixing guide 22 for guiding the transfer paper separated from the transfer drum 11 by the separating claw 14 to the fixing roller 23.

A discharging roller 24 is provided on a downstream side of the fuser unit 4 in a direction in which the transfer paper having the toner image fixed thereon is transported, so that the transfer paper is discharged from the main body onto an output tray 25.

The structure of the transfer drum 11 will be explained while referring to FIG. 3.

Figure 3:
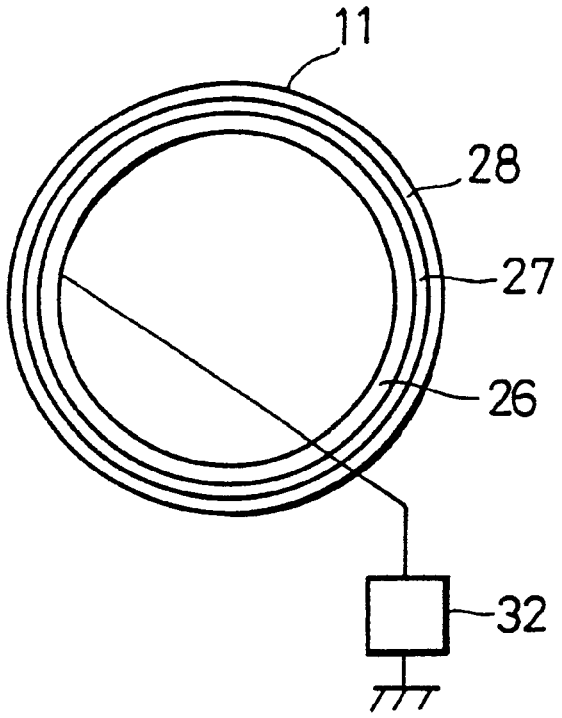
FIG. 3 is a schematic cross sectional view showing a structure of a transfer drum in the image forming apparatus of FIG. 1.
Figure 4:
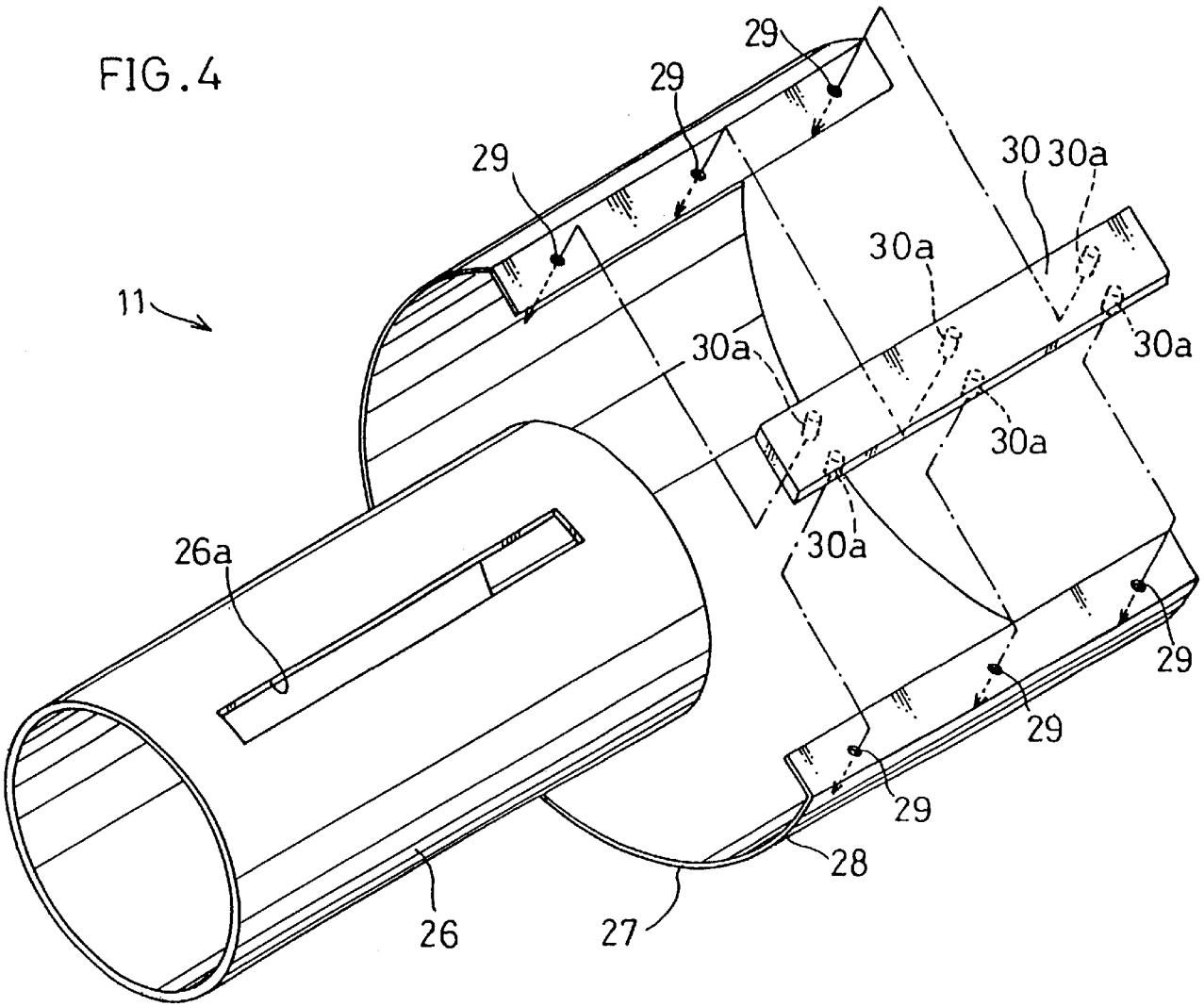
FIG. 4 is a view explaining the coupling state of a conductive layer, a semi-conductive layer, and a dielectric layer forming the transfer drum of FIG. 3.

As shown in FIG. 3, the transfer drum 11 employs a cylindrical conductive layer 26 made of aluminum serving as a base material, and a semi-conductive layer 27 made of urethane foam is formed on the top surface of the conductive layer 26.

Further, a dielectric layer 28 made of polyvinylidene fluoride or PET (polyethylene terephtalate) is formed on the top surface of the semi-conductive layer 27.

In addition, the conductive layer 26 is connected to a power source unit 32 serving as voltage applying means, so that a voltage is applied constantly across the conductive layer 26.

The above three layers are bonded to each other without using an adhesive agent or the like. For example, they are bonded to each other by a method shown in FIG. 4. To be more specific, a plurality of bosses 30*a* are formed on a sheet keeping plate 30, and a plurality of through holes 29 are made on the two opposing sides of a sheet made of the semi-conductive layer 27 and dielectric layer 28 so as to pierce through the sheet. Then, the bosses 30*a* are engaged with the through holes 29 first, and thence with an opening 26*a* formed on the top surface of the conductive layer 26. As a result, the semi-conductive layer 27 and dielectric layer 28 are fixed to the conductive layer 28.

According to the above fixing method, the semi-conductive layer 27 and dielectric layer 28 apply a tension to the inner side of the conductive layer 26 through the sheet keeping plate 30, thereby preventing separation or slack of each layer.

In addition, since each layer is fixed by the sheet keeping plate 30 alone, each layer can be replaced easily.

Figure 5:
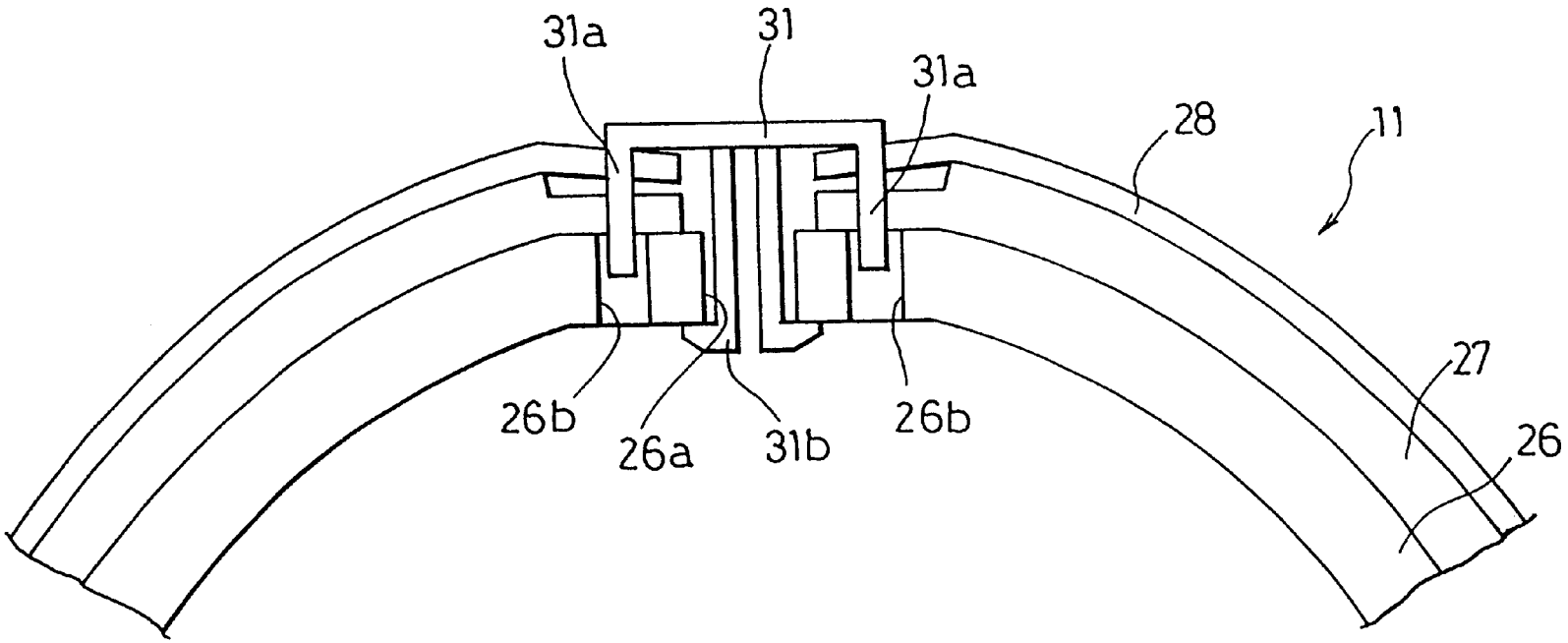
FIG. 5 is another view explaining the coupling state of the conductive layer, semi-conductive layer, and dielectric layer forming the transfer drum of FIG. 3.

Note that methods other than the above fixing method may be applicable. For example, as shown in FIG. 5, a sheet made of the semi-conductive layer 27 and dielectric layer 28 may be fixed to the conductive layer 26 by a sheet keeping member 31. The sheet keeping member 31 has a plurality of bosses 31*a* on the two opposing sides and a fixing member 31*b* for fixing the sheet at the center. According to this fixing method, the bosses 31*a* of the sheet keeping member 31 are engaged with a plurality of engaging holes 26*b* formed on the two opposing sides of an opening 26*a* of the conductive layer 26, so that the fixing member 31*b* of the sheet keeping member 31 is fitted into the opening 26*a*.

Each layer can be also replaced easily when fixed by this method.

Figure 1:
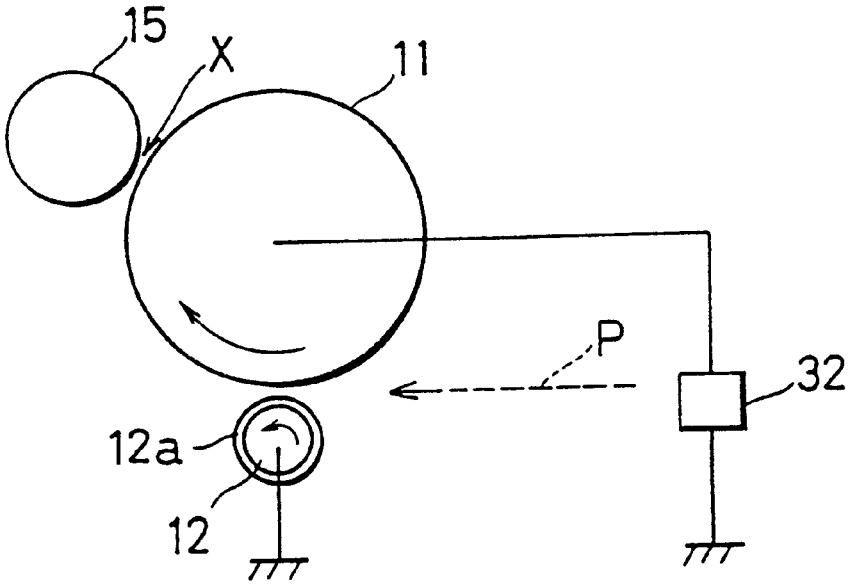
FIG. 1 is a schematic view showing the structure of an image forming apparatus in accordance with the first embodiment of the present embodiment.

As shown in FIG. 1, a charging layer 12*a*, made of a charging member for charging the transfer paper P in a certain polarity before the transfer paper P adheres to the transfer drum 11, is formed on the surface of the ground roller 12 provided below the transfer drum 11. According to this structure, the transfer paper P is charged by friction when the transfer paper P touches the charging layer 12*a* as the transfer paper P passes through a section between the ground roller 12 and transfer drum 11. Note that the transfer paper P is charged in a polarity reversed to that of a voltage applied to the transfer drum 11.

The polarity of the transfer paper P can be changed by the materials forming the charging layer 12*a*. For example, if a positive voltage is applied to the transfer drum 11, then the charging layer 12*a* is made of a material such that negatively charges the transfer paper P. Whereas if a negative voltage is applied to the transfer drum 11, then the charging layer 12*a* is made of a material such that positively charges the transfer paper P.

The charging properties of materials available for the charging layer 12*a* are set forth in TABLE 1 below. The charging properties referred herein are the properties representing the charges induced on each material by the friction between the paper and each material assuming that the initial amount of charges of the paper is nil.

TABLE 1

| POLARITY OF CHARGES | MATERIAL |
|---|---|
| POSITIVE (+) | ASBESTOS |
| ↑ | GLASS |
| ↑ | NYLON |
| ↑ | SILK |
| ↑ | ALUMINUM |
| ↑ | COTTON |
| 0 | PAPER |
| ↓ | WOOD |
| ↓ | HARD RUBBER |
| ↓ | NICKEL |
| ↓ | COPPER |
| ↓ | GOLD, PLASTICS |
| ↓ | ACETATE, RAYON |
| ↓ | POLYESTER |
| ↓ | POLYCARBONATE |
| ↓ | POLYURETHANE |
| ↓ | POLYETHYLENE |
| ↓ | POLYPROPLYLENE |
| ↓ | PVC |
| ↓ | SILICON |
| NEGATIVE (−) | POLYTETRAFLUOROETHYLENE |

TABLE 1 reveals that it is preferable to make the. charging layer 12*a* out of glass, nylon, etc. when negatively charging the transfer paper P, and it is preferable to make the charging roller 12*a* out of polytetrafluoroethylene when positively charging the transfer paper P.

Since the transfer paper P is charged by the charging layer 12*a* in the instant at which the transfer paper P touches the transfer drum 11, the transfer paper P can be charged in a desired polarity regardless of the polarity of the initial charges of the transfer paper P. Thus, if the transfer paper P has the charges of the same polarity as that of the charges of the transfer drum 11 initially and will not adhere to the transfer drum 11 easily, the transfer paper P can be charged in a desired polarity by friction only by being brought into contact with the charging layer 12*a*, thereby enabling the transfer paper P to adhere to the transfer drum 11 in a stable manner.

The ground roller 12 is pressed against the transfer drum 11 with the transfer paper P in between at the moment when the transfer paper P is transported to the section between the transfer drum 11 and ground roller 12. Subsequently, a voltage is applied to the transfer drum 11 to start the charging of the transfer paper P. The amount of thrust of the ground roller 12 into the transfer drum 11, or namely, the amount of crossover of the ground roller 12 and transfer drum 11, and the corresponding charging effect on the transfer paper P are set forth in TABLE 2 below.

The amount of crossover referred herein is defined as a balance between a total of a radius of the peripheral circumference of the ground roller 12 and that of the peripheral circumference of the transfer drum 11 and a distance from the center of the one peripheral circumference to that of the other when these two peripheral circumferences are crossed. The charging effect on the transfer paper P referred herein indicates how readily the transfer paper P is charged.

TABLE 2

| AMOUNT OF CROSSOVER (mm) | −0.5 OR LESS | 0.0 | 0.5 | 1.0 | 2.0 | 3.0 | 5.0 OR MORE |
|---|---|---|---|---|---|---|---|
| CHARGING EFFECT | X | ○ | ⊙ | ⊙ | ⊙ | ⊙ | ○ |

X: ALMOST NONE
Δ: POOR
○: FAIR
⊙: EXCELLENT

TABLE 2 reveals that the charging effect on the transfer paper P can be realized when the ground roller 12 and transfer roller 11 are brought into contact with each other, and in particular, the charging effect is enhanced when the amount of crossover is in a range between 0.5 mm and 3.0 mm.

Since the transfer drum 11 and ground roller 12 are brought into contact with each other when the amount of the crossover of the transfer drum 11 and ground roller 12 is in the above-specified range, not only the transfer paper P can be charged more efficiently, but also the ground roller 12 can be rotatably driven by the transfer drum 11, thereby enabling stable transportation of the transfer paper P.

Further, the charging layer 12*a* of the ground roller 12 may have a slightly irregular surface to enhance the charging and transportation efficiency of the transfer paper P.

The charging of the transfer paper P continues until the transfer paper P has made a full turn around the transfer drum 11. When the charging of the transfer paper P ends, the ground roller 12 is separated from the transfer drum 11. Otherwise, the ground roller 12 is brought into contact with the transfer paper P which has made a full turn while adhering to the transfer drum 11 by pressure again, and may touch the toner image attracted to the surface of the transfer paper P electrostatically.

The charging effect on the transfer paper P corresponding to the amount of spacing between the transfer drum 11 and ground roller 12 after the transfer paper P has made a full turn is set forth in TABLE 3 below. The charging effect referred herein represents a condition of a toner image formed on the transfer paper P.

TABLE 3

| AMOUNT OF SPACING (mm) | −0.5 OR LESS | 0.0 | 0.5 | 1.0 | 2.0 | 3.0 OR MORE |
|---|---|---|---|---|---|---|
| CHARGING EFFECT | X | X | ○ | ⊙ | ⊙ | ⊙ |

X: ALMOST NONE Δ: POOR ○: FAIR ⊙: EXCELLENT

TABLE 3 reveals that it is necessary to have the amount of spacing of at least 0.5 mm, and more preferably, 1.0 mm or more, between the ground roller 12 and transfer drum 11 to obtain the charging effect on the transfer paper P. Thus, when the ground roller 12 and transfer drum 11 are spaced apart 1.0 mm or more, a toner image is formed satisfactorily on the transfer paper P, thereby producing a satisfactory image. In contrast, when the ground roller 12 and transfer drum 11 is spaced apart 0.5 mm or less, an unsatisfactory toner image is formed on the transfer paper P.

Solenoids 12*b* (shown in FIG. 14) serving as electrode member driving means are provided on the two opposing sides of the center of rotation of the ground roller 12, so that the ground roller 12 moves mechanically to touch and separate from the transfer drum 11. This structure enables the ground roller 12 to have a constant nip width and a constant spacing amount.

Figure 46:
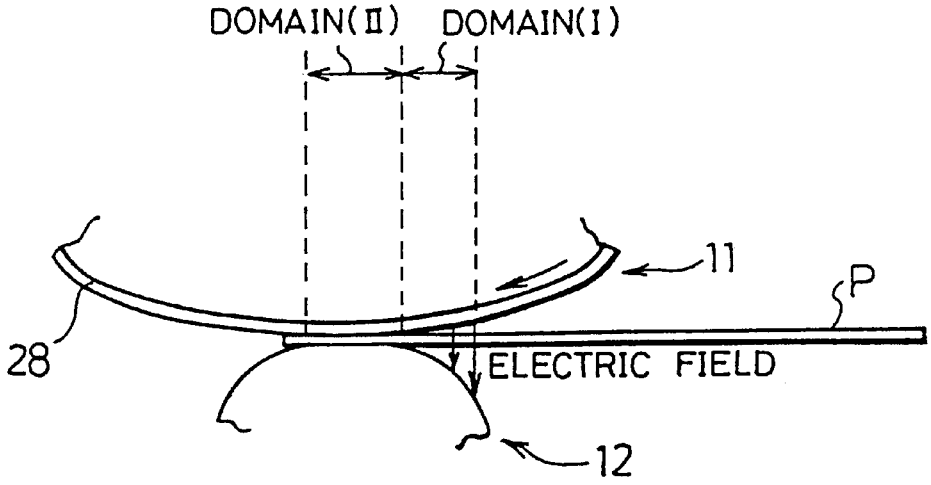
FIG. 46 is a view explaining Paschen's discharge occurring at a close contacting portion between the transfer drum and a conductive roller shown in FIG. 1.

In the following, the paper attracting operation and transferring operation by the transfer drum 11 will be explained while referring to FIGS. 6, 7, and 46. Assume that a positive voltage is applied to the conductive layer 26 of the transfer drum 11 from the power source unit 32.

First, a process of attracting the transfer paper P will be explained. As shown in FIG. 6, the transfer paper P transported to the transfer drum 11 is transported further while being pressed against the surface of the dielectric layer 28 by the ground roller 12. At this point, the transfer paper P is negatively charged by the friction between the charging layer 12*a* formed on the surface of the ground roller 12 and the transfer paper P. Also, charges accumulated on the semi-conductive layer 27 move to the dielectric layer 28, thereby inducting the positive charges on the surface of the dielectric layer 28.

The dielectric layer 28 is charged by the conductive ground roller 12 mainly through Paschen's discharge and a charge injection. More specifically, when the positive charges are induced on the surface of the dielectric layer 28 as has been explained, an electric field develops from the transfer drum 11 side to the ground roller 12 side as shown in FIG. 46. Here, the surface of the transfer drum 11 is charged uniformly as the ground roller 12 and transfer drum 11 rotate. In the meantime, an atmospheric dielectric breakdown occurs when the electric field strength on a close contacting portion between the dielectric layer 28 and ground roller 12 known as the nip increases as the ground roller 12 approaches to the dielectric layer 28 of the transfer drum 11. Accordingly, a discharge, or namely, Paschen's discharge, is triggered from the transfer drum 11 side to the ground roller 12 side in a domain (I).

Further, when the discharge ends, the charge injection from the ground roller 12 side to the transfer drum 11 side occurs in the nip between the ground roller 12 and transfer drum 11 indicated as a domain (II), and the negative charges are accumulated on the surface of the transfer drum 11. In short, the negative charges are accumulated on the transfer paper P on the inner side making contact with the dielectric layer 28 by Paschen's discharge and the following charge injection. As a result, the transfer paper P adheres to the transfer drum 11 electrostatically. Since the adhesion force of the transfer paper P does not vary if a voltage is supplied constantly, the transfer drum 11 can attract the transfer paper P in a stable manner.

As has been explained, since the transfer paper P is not charged through the atmospheric discharge but by contact electrification, a voltage applied to the conductive layer 26 can be lowered. Various experiments show that it is adequate to apply a voltage of +3 kV or less, and more preferably, a voltage of +2 kV, to charge the transfer paper P and transfer a toner image onto the transfer paper P satisfactorily.

The transfer paper P attracted to the transfer drum 11 is transported as far as a toner-image transfer point X as the transfer drum 11 rotates in the direction indicated by an arrow with its outer surface being positively charged.

Next, a process of toner-image transfer onto the transfer paper P will be explained. As shown in FIG. 7, the photosensitive drum 15 attracts the negatively charged toner on the surface thereof. Thus, when the transfer paper P whose surface is positively charged is transported to the transfer point X, the toner is attracted to the surface of the transfer paper P due to the potential difference between the positive charges on the surface of the transfer paper P and the negative charges of the toner, thereby transferring a toner image onto the surface of the transfer paper P.

The ground roller 12 separates from the transfer drum 11 to keep the above-specified amount of spacing when a first toner image has been transferred onto the transfer paper P as the transfer drum 11 makes a full turn.

Note that the transfer drum 11 and photosensitive drum 15 are pressed against each other in such a manner that they have a certain nip width at the transfer point X. This means that this nip width affects the transfer efficiency, or namely, the image quality. The nip width referred herein is a width of a close contacting portion between the transfer drum 11 and the photosensitive drum 15 in a circumferential direction.

The relation between the nip width and image quality is set forth in TABLE 4 below.

TABLE 4

| NIP WIDTH | 1 | 2 | 3 | 4 | 5 | 6 | 7 | 8 | 9 | 10 |
|---|---|---|---|---|---|---|---|---|---|---|
| IMAGE QUALITY | X | Δ | ○ | ○ | ○ | ○ | Δ | X | X | X |
| | | DEFECTIVE TRANSFER ← SMEAR etc. | | | | | | | | |

UNIT: mm

○: EXCELLENT Δ: FAIR X: POOR

TABLE 4 reveals that it is preferable to have the nip width of 2 mm to 7 mm, and more preferably, 3 mm to 6 mm, to produce an image satisfactorily on the transfer paper P.

The semi-conductive layer 27 has a volume resistivity of $10^8$ Ω·cm, a thickness of 2 mm to 5 mm, and a hardness of 25 to 50 in ASKER C, because the transfer drum 11 and photosensitive drum 15 are pressed against each other under a pressure of 2 to 8 kg in the present embodiment. Note that it is preferable that the transfer drum 11 and photosensitive drum 15 are pressed against each other under a pressure of 6 kg. ASKER C indicates the hardness of a sample which is measured by a hardness measuring device produced in accordance with the standard of Japanese Rubber Association. Specifically, the hardness measuring device indicates the hardness of a sample by pressing a ball-point needle designed for hardness measurement against a surface of the sample using a force of a spring and measuring the depth of indentation produced by the needle when the resistive force of the sample and the force of spring balance. With the standard of ASKER C, when the depth of the indentation produced by the needle with the application of load of 55 g on the spring becomes equal to the maximum displacement of the needle, the hardness of the sample is indicated as zero degree. Also, when the depth of indentation produced by the application of load of 855 g is zero, the hardness of the sample is indicated as 100 degree.

The relation among ASKER C, the quality of post-transfer toner image, and the adhesion of the transfer paper P is set forth in Table 5.

TABLE 5

| HARDNESS (ASKER C) | 10 | 20 | 30 | 40 | 50 | 60 | 70 | 80 | 90 |
|---|---|---|---|---|---|---|---|---|---|
| IMAGE Q'LTY | X | Δ | ○ | ○ | ○ | Δ | Δ | X | X |
| ADHESION | X | Δ | ○ | ○ | ○ | ○ | Δ | X | X |
| SMEARS, etc. ← | | | | → DEFECTIVE TRANSFER | | | | | |

○: EXCELLENT
Δ: FAIR
X: POOR

TABLE 5 reveals that a satisfactory image can be produced and the transfer paper P can adhere to the transfer drum 11 satisfactorily when the hardness is in a range between 25 and 50 in ASKER C.

In other words, since the pressing pressure between the transfer drum 11 and photosensitive drum 15 varies depending on the material of the semi-conductive layer 27, the thickness, hardness, etc. of the semi-conductive layer 27 are adjusted for each material to obtained a desired image quality.

Thus, using the semi-conductive layer 27 having the above-specified thickness and hardness limits the nip width between the transfer drum 11 and photosensitive drum 15 within the above-specified range.

If the semi-conductive layer 27 has no volume resistivity (0 Ω·cm), the voltage drops before the transfer paper P reaches the transfer point X due to the ground roller 12 placed where the adhesion of the transfer paper starts. To eliminate such a drop in voltage, the semi-conductive layer 27 must have a certain volume resistivity so as to play a role of a capacitor (condenser).

The relation between the volume resistivity and image quality is set forth in TABLE 6 below.

TABLE 6

| VOLUME RESISTIVITY (Ω · cm) | $10^1$ | $10^2$ | $10^3$ | $10^4$ | $10^5$ | $10^6$ | $10^7$ | $10^8$ | $10^9$ |
|---|---|---|---|---|---|---|---|---|---|
| IMAGE Q'LTY | X | X | X | X | Δ | ○ | ○ | Δ | X |
| | | ← RE-TRANSFER | | | | — DEFECTIVE TRANSFER | | | |

UNIT: Ω · cm

○: EXCELLENT
Δ: FAIR
X: POOR

TABLE 6 reveals that a toner image is transferred onto the transfer paper P efficiently without causing re-transfer or defects when the volume resistivity of the semi-conductive layer 27 is in a range between $10^5$ Ω·cm and $10^8$ Ω·cm, and in particular, the toner image is transferred onto the transfer paper P more efficiently when the volume resistivity of the semi-conductive layer 27 is in a range between $10^6$ Ω·cm and $10^7$ Ω·cm.

Since the semi-conductive layer 27 of the present embodiment has the volume resistivity of $10^8$ Ω·cm, the toner image can be transferred onto the transfer paper P satisfactorily, and hence a good-quality image can be produced.

In general, the dielectric layer 28 must have a high dielectric constant and a charge maintaining force. This is the reason why the dielectric layer 28 is made of polyvinylidene fluoride, and the dielectric constant thereof is set in a range between 8 and 12.

Thus, a charge capacity c of the dielectric layer 28 is found by an equation: $c=\epsilon \cdot s/l$ , where c is a charge capacity, $\epsilon$ is a dielectric constant, s is an area, and l is a thickness of the dielectric layer 28.

It is understood from the above equation that the smaller the dielectric constant $\epsilon$, the smaller the charge capacity c and the better the transfer efficiency. However, since the charge capacity c is small, the adhesion force becomes weaker. It is also understood from the above equation that the thinner the dielectric layer 28 becomes, the larger the capacity c and the worse the transfer efficiency. However, since the capacity c is large, the adhesion force becomes stronger.

Therefore, the dielectric constant $\epsilon$ and the thickness l of the dielectric layer 28 must be set appropriately. That is to say, adequate adhesive force and transfer efficiency can be obtained with the transfer paper P when the dielectric layer 28 has the dielectric constant in a range between 8 and 12 and the thickness of 100 μm to 300 μm.

Figure 8:
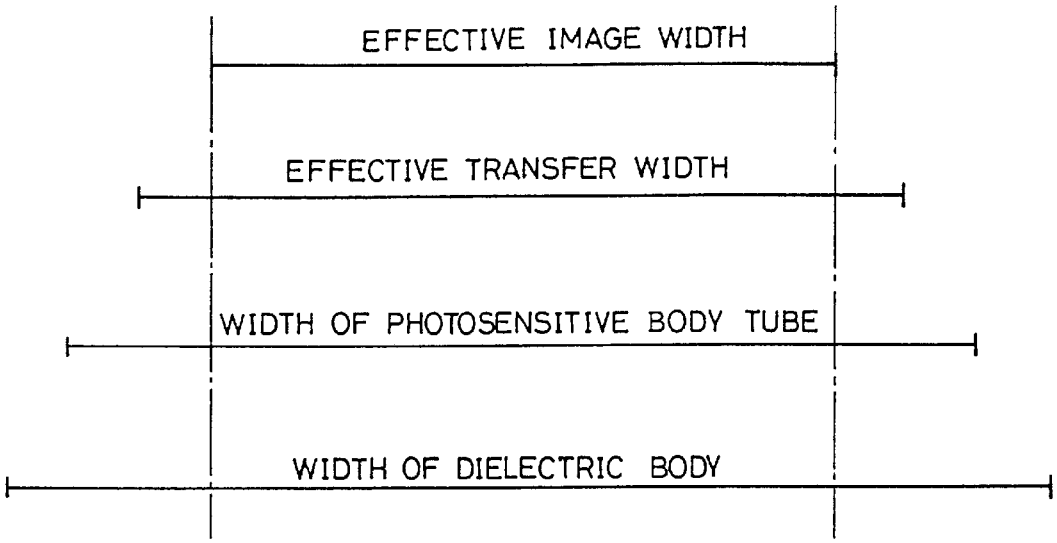
FIG. 8 is a view explaining a comparison between a chargeable width of the transfer drum of FIG. 3 and an effective image width.

As shown in FIG. 8, the dielectric layer 28 of the transfer drum 11 is wider than a photosensitive body tube (aluminum tube 15*a*) forming the photosensitive drum 15. The photosensitive body element is wider than an effective transfer width, and the effective transfer width is wider than an effective image width (OPC applied width).

Figure 9:
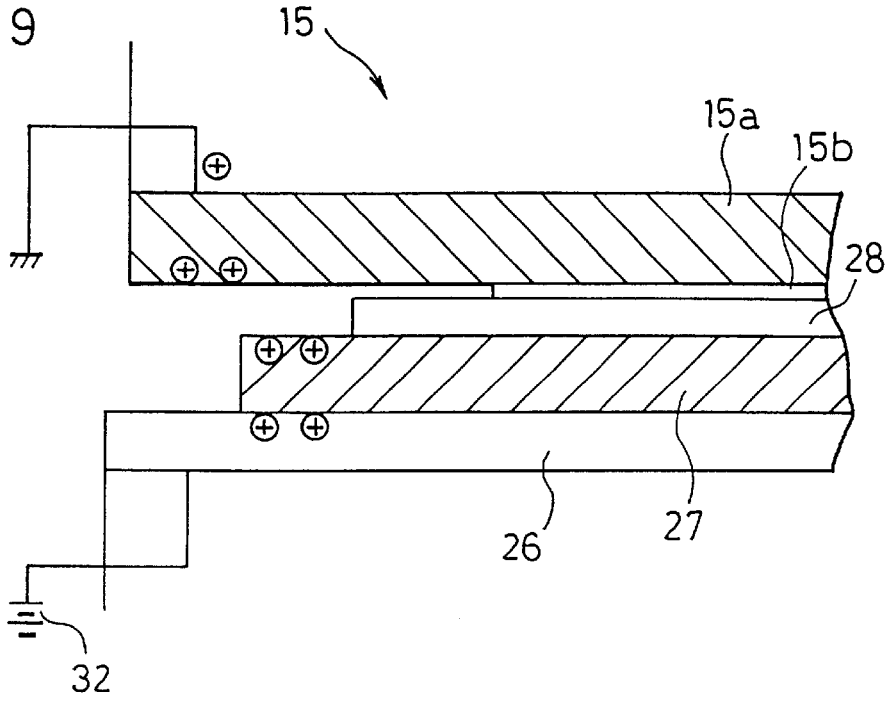
FIG. 9 is a view explaining the movement of charges between the transfer drum of FIG. 3 and a photosensitive drum when a following relation is established in terms of widths: dielectric layer <semi-conductive layer<conductive layer.

As shown in FIG. 9, if the transfer drum 11 is assembled in such a manner that the following relation is established among the above-mentioned three layers in terms of widths: conductive layer 26>semi-conductive layer 27>dielectric layer 28, then the semi-conductive layer 27 may touch the grounded aluminum tube 15*a* of the photosensitive drum 15.

To be more specific, when a positive voltage is applied to the conductive layer 26 from the power sour unit 32, the positive charges are induced on the conductive layer 26, and the induced positive charges move to the surface of the semi-conductive layer 27. If the grounded aluminum tube 15*a* of the photosensitive drum 15 touches the semi-conductive layer 27 under these conditions, all of the charges on the semi-conductive layer 27 move to the aluminum tube 15*a*, thereby making it impossible to induce the positive charges on the surface of the dielectric layer 28. As a result, the transfer drum 11 can not attract the negatively charged toner adhering to the OPC film 15*b*, and thus causes defective transfer.

Figure 10:
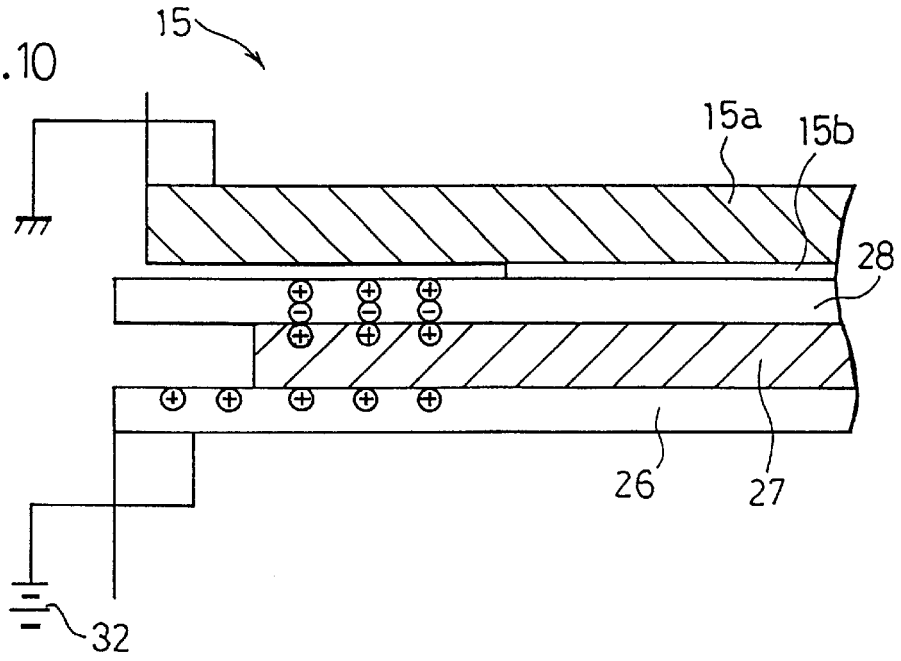
FIG. 10 is a view explaining the movement of charges between the transfer drum of FIG. 3 and the photosensitive drum when a following relation is established in terms of widths: semi-conductive layer<dielectric layer=conductive layer.

Thus, the conductive layer 26 and dielectric layer 28 are made into the same width, and the semi-conductive layer 27 is made narrower than the other two layers as shown in FIG. 10, so that the semi-conductive layer 27 will not touch the grounded aluminum tube 15*a* to prevent leakage of the charges. As a result, the transfer drum 11 can attract the negative charges adhering to the OPC film 15*b*, thereby eliminating defects in a transferred toner image.

The transfer drum 11 is of a diameter such that prevents an overlap of the transfer paper P when it is wound around the transfer drum 11. To be more specific, the transfer drum 11 is designed to have a diameter corresponding to the width or length of a transfer paper of a maximum size used in the image forming apparatus of the present embodiment.

Accordingly, the transfer paper P is wound around the transfer drum 11 in a stable manner, which enhances the transfer efficiency and the image quality as a result.

A process of image formation by the above-structured image forming apparatus will be explained while referring to FIGS. 2, 6, and 7.

As shown in FIG. 2, in case of the automatic paper feeding, the pick up roller 7 steadily sends the transfer papers P per sheet from the top of the pile in the paper feeding cassette 5 provided in the lowest stage of the main body to the PF roller 8. The transfer paper P having passed through the PF roller 8 is curled by the PS roller 10 substantially in the same shape as the transfer drum 11.

Whereas in the case of the manual paper feeding, the transfer papers P are sent to the manual paper feeding roller 9 from the manual paper feeding unit 6 provided on the front surface of the main body per sheet, and transported further to the PS roller 10 by the manual paper feeding roller 9. Subsequently, the transfer paper P is curled by the PS roller 10 substantially in the same shape as the transfer drum 11.

Figure 6:
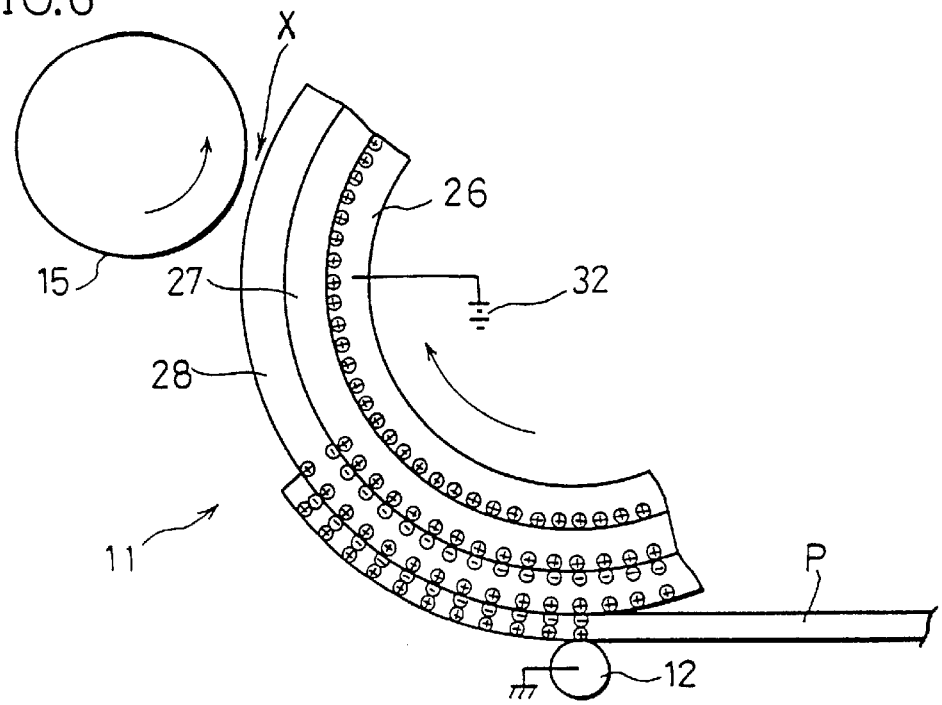
FIG. 6 is a view explaining a charged state of the transfer drum of FIG. 3, and an initial state when a transfer paper is transported to the transfer drum.

Next, as shown in FIG. 6, the transfer paper P curled by the PS roller 10 is transported to the section between the transfer drum 11 and ground roller 12. Accordingly, the charges accumulated on the semi-conductive layer 27 of the transfer drum 11 induce the charges on the surface of the transfer paper P through the surface of the semi-conductive layer 27 and the inner surface of the transfer paper P, thereby allowing the transfer paper P to adhere to the surface of the transfer drum 11 electrostatically.

Figure 7:
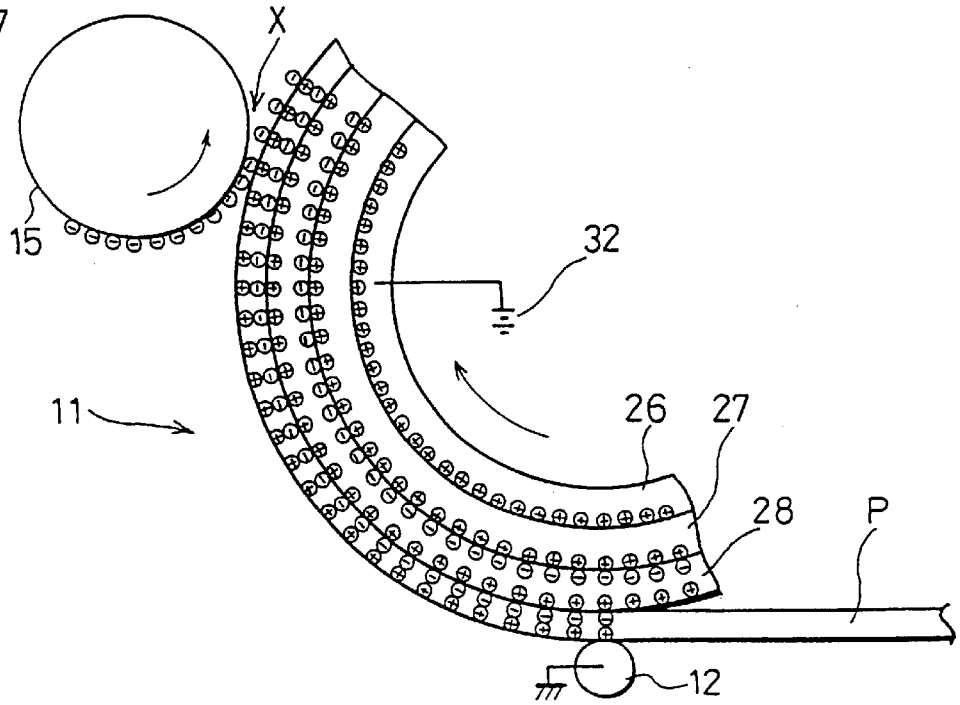
FIG. 7 is a view explaining a charged state of the transfer drum of FIG. 3, and a state when the transfer paper is transported to a transfer point of the transfer drum.

Subsequently, as shown in FIG. 7, the transfer paper P thus attracted to the transfer drum 11 is transported further to the transfer point X where the transfer drum 11 and photosensitive drum 15 are brought into contact with each other by pressure. Then, a toner image is transferred onto the transfer paper P due to the potential difference between the charges of the toner on the photosensitive drum 15 and the charges on the surface of the transfer paper P.

Here, a series of charging, exposure, development, and transfer operations is performed for each color with the photosensitive drum 15. Thus, an image of one color has been transferred onto the transfer paper P when the transfer paper P makes a full turn while adhering to the transfer drum 11, and the transfer paper P rotates up to four times to make a full-color image. Note that the transfer drum 11 rotates only once when making a black-and-white or monochrome image.

When the toner images of all colors are transferred onto the transfer paper P, the transfer paper P is forcefully separated from the surface of the transfer drum 11 by the separating claw 14 provided in the circumference of the transfer drum 11 so as to move to touch and separate from the transfer drum 11, and the transfer paper P is further guided to the fixing guide 22.

Subsequently, the transfer paper P is guided to the fixing roller 23 by the fixing guide 22, and the toner image on the transfer paper P is fused into place at a certain temperature and under a certain pressure.

The transfer paper P with the image thus fixed thereon is discharged onto the output tray 25 by the discharging roller 24.

As has been explained, the transfer drum 11 comprises the conductive layer 26 made of aluminum, semi-conductive layer 27 made of urethane foam, and dielectric layer 28 made of polyvinylidene fluoride or PET (polyethylene terephtalate), which are placed from inward to outward in this order. According to this structure, the charges are induced in the above order when a voltage is applied to the conductive layer 26 and the charges are accumulated on the semi-conductive layer 27. When the transfer paper P is transported to the section between the transfer drum 11 and ground roller 12 under these condition, the accumulated charges on the semi-conductive layer 27 move to the transfer paper P, thereby allowing the transfer paper P to adhere to the transfer drum 11 electrostatically.

As has been explained, the transfer paper adhesion and toner-image transfer of the present embodiment are performed not by the charge injection through a conventional atmospheric discharge, but the charge induction. Thus, the method of the present embodiment demands a relatively low voltage and makes it easy to control the voltage. In addition, this method prevents the voltage from varying due to an external pressure.

Accordingly, a constant voltage can be applied to the transfer drum 11 independently of the environments including humidity and temperature, thereby making it possible to enhance the transfer efficiency and image quality.

Unlike the conventional method where the surface of the transfer drum 11 is charged through the atmospheric discharge, the method of the present embodiment makes it possible to charge the surface of the transfer drum 11 reliably, thereby enabling the adhesion of the transfer paper P and toner-image transfer in a stable manner.

Moreover, the charges are induced on the semi-conductive layer 27 and dielectric layer 28 in this order to charge the surface of the transfer drum 11 only by applying a voltage to the conductive layer 26. Thus, unlike the conventional method where the surface of the transfer drum 11 is charged through the atmospheric discharge, the method of the present embodiment demands a low voltage, which makes it easy to control the voltage and saves the driving energy.

In addition, unlike the conventional method where the voltage is applied to each charger, the voltage is applied to only one point. Thus, the method of the present embodiment not only simplifies the structure of the image forming apparatus, but also saves the manufacturing costs.

Since the transfer drum 11 is charged through contact electrification, the electric field domain does not vary if there is a flaw on the surface of the transfer drum 11. Thus, the electric field does not become out of balance over the flaw on the surface of the transfer drum 11. This prevents defects in a transferred toner image such as a white spot (void), thereby enhancing the transfer efficiency.

Further, unlike the atmospheric discharge, the affects resulted from the environments such as the temperature and humidity of air are almost negligible to the method of the present embodiment. Therefore, the surface potential of the transfer drum 11 does not vary, which makes it possible to prevent insufficient adhesion of the transfer paper P and disordered printing. This also enhances the transfer efficiency and image quality.

Since the transfer paper P is charged in a polarity reversed to that of the transfer drum 11, the initial charges on the transfer paper P are removed. Accordingly, the adhesion degree of the transfer paper P to the transfer drum 11 is enhanced, which enables the transfer drum 11 to steadily attract the transfer papers P when a number of copies are made, thereby making it possible to produce a good-quality image on each copy.

Note that the conductive layer 26 of the present embodiment is cylindrical aluminum; however, the other conductors may be used as well. Likewise, although the semi-conductive layer 27 of the present embodiment is made of urethane foam, other semi-conductors such as elastic bodies including silicon may be used, and although the dielectric layer 28 of the present embodiment is made of polyvinylidene fluoride, however, other dielectric bodies such as resins including PET (polyethylene terephtalate) may be used.

As shown in FIG. 3, the transfer drum 11 of the present embodiment is of a three-layer structure made of the conductive layer 26, semi-conductive layer 27, and dielectric layer 28. However, the transfer drum 11 is not limited to the above structure; the transfer drum 11 may be of any structure as long as the conductive layer 26 and dielectric layer 28 are used as the inner most layer and outer most layer, respectively.

Figure 11:
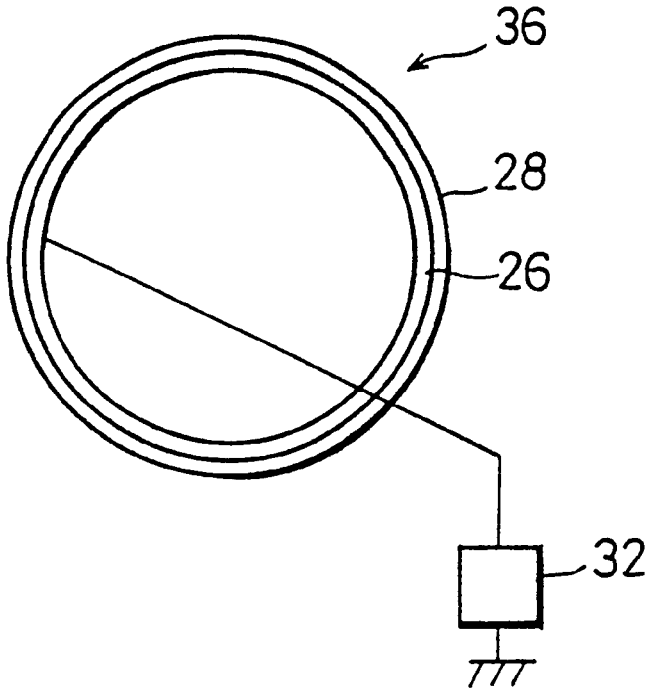
FIG. 11 is a schematic view explaining another structure of the transfer drum of FIG. 3.

For example, the transfer drum 11 may be replaced with a transfer drum 36 shown in FIG. 11, which comprises the conductive layer 26 serving as the inner most layer and the dielectric layer 28 serving as the outer most layer. A voltage is applied to the conductive layer 26 from the power source unit 32 in this case also.

Figure 12:
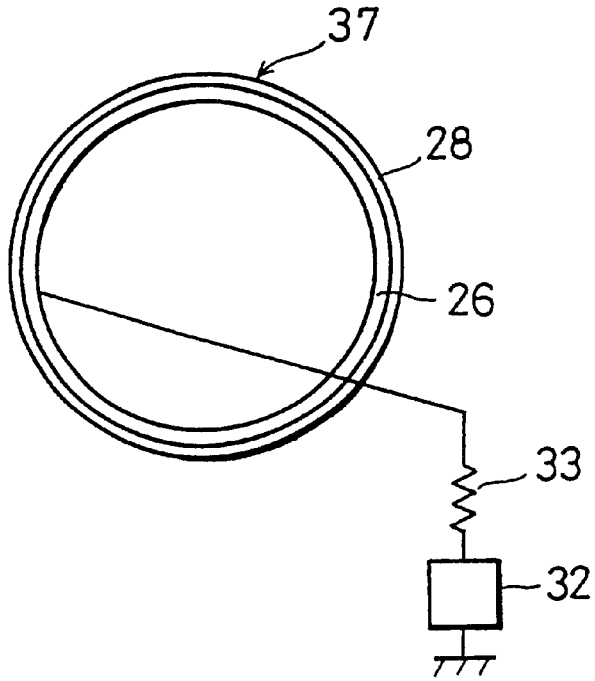
FIG. 12 is a schematic view explaining still another structure of the transfer drum of FIG. 3.

Besides the transfer drum 36, a transfer drum 37 shown in FIG. 12 may be used, which comprises the conductive layer 26 serving as the inner most layer and the dielectric layer 28 serving as the outer most layer. The conductive layer 26 of the transfer drum 37 is connected to the power source unit 32 through a resistor 33 whose resistance value is the same as that of the semi-conductive layer 27 of the transfer drum 11. A voltage is applied to the conductive layer 26 from the power source unit 32 in this case also.

Figure 13:
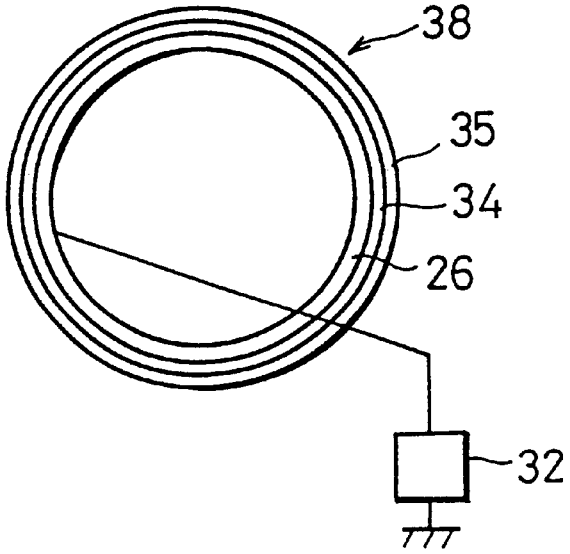
FIG. 13 is a schematic view explaining still another structure of the transfer drum of FIG. 3.

Further, other than the above alternatives, a transfer drum 38 shown in FIG. 13 may be used. The transfer drum 38 comprises the conductive layer 26 serving as the inner most layer, and a two-layer film made of a semi-conductive film 34 (placed inner side of the transfer drum 38) having substantially the same dielectric constant and resistance value as those of the semi-conductive layer 27 of the transfer drum 11 and a dielectric film 35 (placed outer side of the transfer drum 38) having substantially the same dielectric constant and resistance value as those of the dielectric layer 28 of the transfer drum 11; the conductive layer 26 and semi-conductive film 34 are layered from inward to outward in this order. A voltage is applied to the conductive layer 26 from the power source unit 32 in this case also.

Note that the transfer drums 36, 37, and 38 respectively shown in FIGS. 11 through 13 are also applicable to each of the following embodiments.

Figure 14:
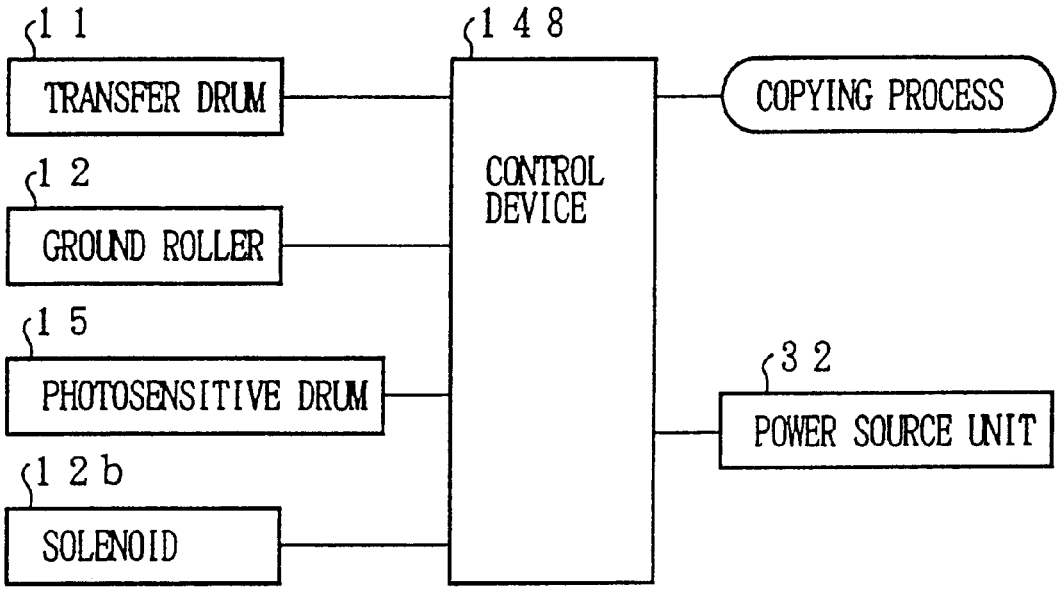
FIG. 14 is a block diagram of a control device installed in the above-structured image forming apparatus.

Also, note that each member used in the present embodiment is driven under the control of a control device 148 shown in FIG. 14, and each member used in the following embodiments is also driven under the control of the control device 148 unless specified otherwise.

In the following, the second through fourteenth embodiments of the present invention will be explained. The major structure of an image forming apparatus in each of the following embodiments is identical with that of the counterpart in the first embodiment, and only the difference will be explained. In the following embodiments, like numerals are labeled with like numeral references with respect to the first embodiment and the description of these components is not repeated for the explanation's convenience.

[SECOND EMBODIMENT]

Another embodiment of the present invention will be explained in the following while referring to FIG. 15(*a*).

Figure 15A:
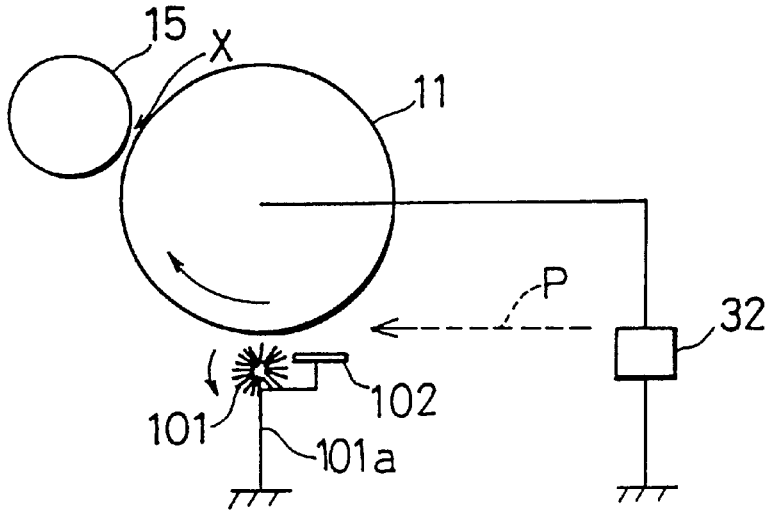
FIG. 15(*a*) is a schematic view showing a structure of an image forming apparatus in accordance with the second embodiment of the present invention, which employs a roller type brush instead of a ground roller shown in FIG. 1.
Figure 15B:
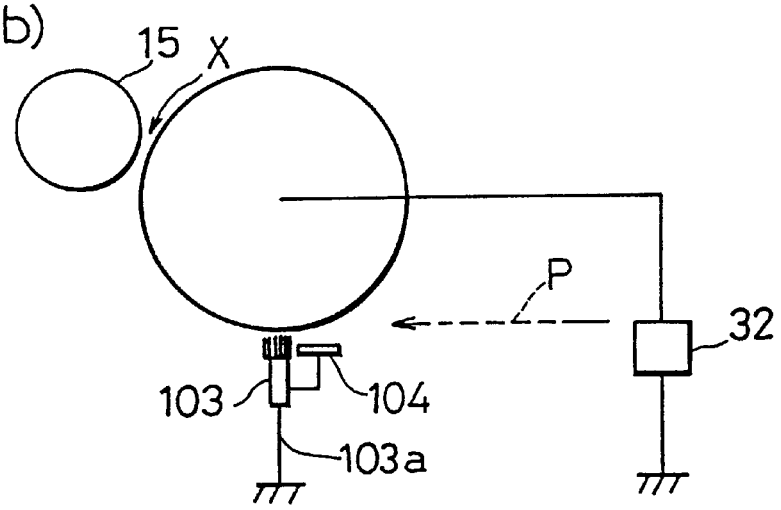

Compared with the counterpart in the first embodiment, an image forming apparatus of the present embodiment includes a roller type brush 101 shown in FIG. 15(*a*) instead of the ground roller 12. The roller type brush 101 is substantially as wide as the transfer drum 11, so that the roller type brush 101 presses the transfer paper P against the transfer drum 11 when the transfer paper P passes through a section between the transfer drum 11 and roller type brush 101. The roller type brush 101 is driven by the same driving mechanism as that of the ground roller 12 of the first embodiment. Also, the roller type brush 101 is grounded through a grounding conductor 101*a*.

A charging member 102 is provided on an upstream side of the roller type brush 101 in a direction in which the transfer paper P is transported. The charging member 102 charges the transfer paper P in a certain polarity, or namely, a polarity reversed to that of the transfer drum 11. The charging member 102 comprises a plate member as long as the width of the transfer drum 11 so as to charge the transfer paper P in the above-mentioned polarity by the friction between the transfer paper P and plate member. The charging member 102 is also grounded through the grounding conductor 101*a* of the roller type brush 101. Further, the charging member 102 is made of any of the materials set forth in TABLE 1 in the first embodiment. For example, in a case where a positive voltage is applied to the transfer drum 11, a charging member 102 made of a material which negatively charges the transfer paper P is adopted. Whereas in a case where a negative voltage is applied to the transfer drum 11, a charging member 102 made of a material which positively charges the transfer paper P is adopted. Note that the charging member 102 can be of any shape as long as it charges the transfer paper P in a desired polarity.

Since the transfer paper P is forcefully charged in a polarity reversed to that of the transfer drum 11 before the transfer paper P adheres to the transfer drum 11, unwanted charges on the transfer paper P, or namely, the charges of the same polarity as that of the transfer drum 11, can be =removed. As a result, the adhesion of the transfer paper P to the transfer drum 11 can be upgraded.

The relation between the length of the charging member 102 in a direction in which the transfer paper P is transported when the charging member 102 is a plate member and the charging effect is set forth in TABLE 7 below.

TABLE 7

| LENGTH (mm) | 5 OR LESS | 10 | 30 | 50 | 100 | 300 OR MORE |
|---|---|---|---|---|---|---|
| CHARGING EFFECT | X | Δ | ○ | ◎ | ◎ | ◎ |

X: ALMOST NONE
Δ: POOR
○: FAIR
◎: EXCELLENT

TABLE 7 reveals that it is possible to charge the transfer paper P when the charging member 102 is at least 10 mm long in the direction in which the transfer paper P is transported, and in particular, the charging effect is improved when the charging member 102 is not less than 50 mm long.

The transfer paper P is charged when a voltage is applied to the transfer drum 11 in the instant at which the transfer paper P having passed by the charging member 102 reaches a point where the roller type brush 101 is brought into contact with the transfer drum 11. The amount of thrust of the brush portion of the roller type brush 101 into the transfer drum 11 at this point, or namely, the amount of the crossover of the roller type brush 101 and transfer drum 11, and the corresponding charging effect on the transfer paper P are set forth in TABLE 8 below.

The amount of crossover referred herein is defined as a balance between a total of a radius of the peripheral circumference of the roller type brush 101 and that of the peripheral circumference of the transfer drum 11 and a distance from the center of the one peripheral circumference to that of the other when these two peripheral circumferences are crossed. The charging effect on the transfer paper P referred herein indicates how readily the transfer paper P is charged.

TABLE 8

| AMOUNT OF CROSSOVER (mm) | −0.5 OR LESS | 0.0 | 0.5 | 1.0 | 2.0 | 3.0 | 5.0 OR MORE |
|---|---|---|---|---|---|---|---|
| CHARGING EFFECT | X | ○ | ◎ | ◎ | ◎ | ◎ | ○ |

X: ALMOST NONE
Δ: POOR
○: FAIR
◎: EXCELLENT

TABLE 8 reveals that the charging effect on the transfer paper P can be obtained when the roller type brush 101 and the transfer drum 11 are brought into contact with each other, and in particular, the charging effect is improved when the amount of the crossover is in a range between 0.5 mm and 3.0 mm.

Since the transfer drum 11 and roller type brush 101 are brought into contact with each other when the amount of the crossover of the transfer drum 11 and roller type brush 101 is in the above-specified range, not only the transfer paper P can be charged more efficiently, but also the roller type brush 101 can be rotatably driven by the transfer drum 11, thereby enabling stable transportation of the transfer paper P.

The charging effect on the transfer paper P corresponding to the amount of the spacing between the transfer drum 11 and roller type brush 101 when the transfer paper P has made a full turn is set forth in TABLE 9 below. The charging effect on the transfer paper P referred herein represents a condition of a toner image formed on the transfer paper P.

TABLE 9

| AMOUNT OF SPACING (mm) | −0.5 OR LESS | 0.0 | 0.5 | 1.0 | 2.0 | 3.0 OR MORE |
|---|---|---|---|---|---|---|
| CHARGING EFFECT | X | X | ○ | ⊙ | ⊙ | ⊙ |

X: ALMOST NONE Δ: POOR ○: FAIR ⊙: EXCELLENT

TABLE 9 reveals that it is necessary to have the amount of spacing of at least 0.5 mm, and more preferably 1.0 mm or more, between the roller type brush 101 and transfer drum 11 to obtain the charging effect on'the transfer paper P. Accordingly, when the roller type brush 101 and transfer drum 11 are spaced apart 1.0 mm or more, the toner image is formed satisfactorily on the transfer paper P, thereby upgrading the quality of a resulting image. In contrast, if the roller type brush 101 and transfer drum 11 are spaced apart 0.5 mm or less, an unsatisfactory toner image is formed on the transfer paper P.

The relation between the resistance of the brush portion of the roller type brush 101 and the charging effect on the transfer paper P is set forth in TABLE 10 below. Also, the relation between a brush density of the roller type brush 101 and the charging effect on the transfer paper P is set forth in TABLE 11 below.

TABLE 10

| BRUSH RESISTANCE VALUE (kΩ) | 70 OR MORE | 60 | 50 | 40 | 36 | 20 | 10 | 5 OR LESS |
|---|---|---|---|---|---|---|---|---|
| CHARGING EFFECT | X | Δ | Δ | ○ | ◎ | ◎ | ◎ | ◎ |

X: ALMOST NONE
Δ: POOR
○: FAIR
◎: EXCELLENT

TABLE 11

| Nos. OF BRUSHES (ps/cm$^2$) | 3000 OR LESS | 5000 | 10000 | 15000 | 20000 | 25000 | 30000 OR MORE |
|---|---|---|---|---|---|---|---|
| CHARGING EFFECT | X | Δ | Δ | ○ | ◎ | ◎ | ○ |

X: ALMOST NONE
Δ: POOR
○: FAIR
◎: EXCELLENT

TABLE 10 reveals that the charging effect on the transfer paper P can be realized when the value of the brush resistance is 60 kΩ or less, and in particular, the charging effect is enhanced when the value of the brush resistance is 36 kΩ or less. Also, TABLE 11 reveals that the charging effect on the transfer paper P can be realized when the brush density is 5000 pieces/cm$^2$ or more, and in particular, the charging effect is enhanced when the brush density is 20000 pieces/cm$^2$ or more.

According to the above structure, the transfer paper P is charged in a polarity reversed to that of the transfer drum 11, and thus the charges on the pre-charge transfer paper P can be removed. Accordingly, a degree of adhesion (hereinafter referred to as adhesion degree) of the transfer paper P to the transfer drum 11 can be upgraded. As a result, a plurality of the transfer papers P can steadily adhere to the transfer drum 11 when a plurality of copies are made, thereby producing a high-quality image on each copy.

[THIRD EMBODIMENT]

A further embodiment of the present invention will be explained in the following while referring to FIG. 15(*b*).

As shown in FIG. 15(*b*), an image forming apparatus of the present embodiment includes a comb-shaped brush 103 instead of the ground roller 12 of the first embodiment shown in FIG. 1. The come-shaped brush 103 is formed in such a manner that the brush surface thereof is substantially as wide as the transfer drum 11, so that the comb-shaped brush 103 presses the transfer paper P against the transfer drum 11 when the transfer paper P passes through a section between the transfer drum 11 and comb-shaped brush 103. The comb-shaped brush 103 is driven by the same driving mechanism as that of the ground roller 12 of the first embodiment. Also, the comb-shaped brush 103 is grounded through a grounding conductor 103*a*.

A charging member 104 is provided on an upstream side of the comb-shaped brush 103 in a direction in which the transfer paper P is transported. The charging member 104 charges the transfer paper P in a certain polarity, or namely, a polarity reversed to that of the transfer drum 11. The charging member 104 comprises a plate member as long as the width of the transfer drum 11 so as to charge the transfer paper P in the above-mentioned polarity by the friction between the transfer paper P and plate member. The charging member 104 is also grounded through the grounding conductor 103*a* of the comb-shaped brush 103. Further, the charging member 104 is made of any of the materials set forth in TABLE 1 in the first embodiment. For example, in a case where a positive voltage is applied to the transfer drum 11, a charging member 104 made of a material which negatively charges the transfer paper P is adopted. In contrast, in a case where a negative voltage is applied to the transfer drum 11, a charging member 104 made of a material which positively charges the transfer paper P is adopted. Note that the charging member 104 can be of any shape as long as it charges the transfer paper P in a desired polarity.

As has been explained, by charging the transfer paper P in a polarity reversed to that of the transfer drum 11 before it adheres to the transfer drum 11, unwanted charges on the transfer paper P, or namely, the charges of the same polarity as that of the transfer drum 11, can be removed, thereby upgrading the adhesion of the transfer paper P to the transfer drum 11.

The relation between the length of the charging member 104 in a direction in which the transfer paper P is transported when the charging member 104 is made of a plate member and the charging effect on the transfer paper P is forth in TABLE 12.

TABLE 12

| LENGTH (mm) | 5 OR LESS | 10 | 30 | 50 | 100 | 300 OR MORE |
|---|---|---|---|---|---|---|
| CHARGING EFFECT | X | Δ | ○ | ⊙ | ⊙ | ⊙ |

X: ALMOST NONE Δ: POOR ○: FAIR ⊙: EXCELLENT

TABLE 12 reveals that the transfer paper P can be charged when the charging member 104 is at least 10 mm long in the direction in which the transfer paper P is transported, and in particular, the charging effect is enhanced when the charging member 104 is not less than 50 mm long.

The transfer paper P is charged when a voltage is applied to the transfer drum 11 at the same time when the transfer paper P having passed the charging member 104 reaches a point where the comb-shaped brush 103 is brought into contact with the transfer drum 11. The amount of thrust of the comb-shaped brush 103 into the transfer drum 11, or namely, the amount of crossover of the comb-shaped brush 103 and transfer drum 11, and the corresponding charging effect on the transfer paper P are set forth in TABLE 13 below.

The amount of crossover referred herein is defined as the length of the comb-shaped brush 103 within the peripheral circumference of the transfer drum 11 when the comb-shaped brush 103 in a natural state and the peripheral circumference of the transfer drum 11 are crossed. The charging effect on the transfer paper P referred herein indicates how readily the transfer paper P is charged.

TABLE 13

| AMOUNT OF CROSSOVER (mm) | −0.5 OR LESS | 0.0 | 0.5 | 1.0 | 2.0 | 3.0 | 5.0 OR MORE |
|---|---|---|---|---|---|---|---|
| CHARGING EFFECT | X | ○ | ⊙ | ⊙ | ⊙ | ⊙ | ○ |

X: ALMOST NONE Δ: POOR ○: FAIR ⊙: EXCELLENT

TABLE 13 reveals that the charging effect on the transfer paper P can be realized when the comb-shaped brush 103 and transfer drum 11 are brought into contact with each other, and in particular, the charging effect is enhanced when the amount of the crossover of the comb-shaped brush 103 and transfer drum 11 is in a range between 0.5 mm and 3.0 mm.

Since the transfer drum 11 and comb-shaped brush 103 are brought into contact with each other when the amount of the crossover of the transfer drum 11 and comb-shaped brush 103 is in the above-specified range, not only the transfer paper P can be charged more efficiently, but also the comb-shaped brush 103 can move together with the transfer drum 11, thereby enabling stable transportation of the transfer paper P.

The charging effect on the transfer paper P corresponding to the amount of the spacing between the transfer drum 11 and comb-shaped brush 103 when the transfer paper P has made a full turn is set forth in TABLE 14 below. The charging effect on the transfer paper P referred herein represents a condition of a toner image formed on the transfer paper P.

TABLE 14

| AMOUNT OF SPACING (mm) | −0.5 OR LESS | 0.0 | 0.5 | 1.0 | 2.0 | 3.0 OR MORE |
|---|---|---|---|---|---|---|
| CHARGING EFFECT | X | X | ○ | ⊙ | ⊙ | ⊙ |

X: ALMOST NONE Δ: POOR ○: FAIR ⊙: EXCELLENT

TABLE 14 reveals that it is necessary to have the amount of the spacing of at least 0.5 mm, and more preferably 1.0 mm or more, between the comb-shaped brush 103 and transfer drum 11 to obtain the charging effect on the transfer paper P.

Accordingly, when the comb-shaped brush 103 and transfer drum 11 are spaced apart 1.0 mm or more, the toner image is formed satisfactorily on the transfer paper P, thereby producing a good-quality image. In contrast, if the comb-shaped brush 103 and transfer drum 11 are spaced apart 0.5 mm or less, a toner image is formed unsatisfactorily on the transfer paper P.

The relation between the resistance of the brush portion of the comb-shaped brush 103 and the charging effect on the transfer paper P is set forth in TABLE 15 below. Also, the relation between a pitch (fur pitch) between the groups of bristles of the comb-shaped brush 103 and the charging effect on the transfer paper P is set forth in TABLE 16 below.

TABLE 15

| BRUSH RESISTANCE VALUE (kΩ) | 70 OR MORE | 60 | 50 | 40 | 36 | 20 | 10 | 5 OR LESS |
|---|---|---|---|---|---|---|---|---|
| CHARGING EFFECT | X | Δ | Δ | ○ | ⊙ | ⊙ | ⊙ | ⊙ |

X: ALMOST NONE Δ: POOR ○: FAIR ⊙: EXCELLENT

TABLE 16

| FUR PITCH (mm) | 6.0 OR MORE | 3.0 | 2.0 | 1.6 | 0.5 | 0.3 OR LESS |
|---|---|---|---|---|---|---|
| CHARGING EFFECT | X | Δ | ○ | ⊙ | ⊙ | ⊙ |

X: ALMOST NONE Δ: POOR ○: FAIR ⊙: EXCELLENT

TABLE 15 reveals that the charging effect on the transfer paper P can be realized when the value of the brush resistance is 60 kΩ or less, and in particular, the charging effect is enhanced when the value of the brush resistance is 36 kΩ or less. Also, TABLE 16 reveals that the charging effect on the transfer paper P can be realized when the fur pitch is 3.0 mm or less, and in particular, the charging effect is enhanced when the fur pitch is 1.6 mm or less.

According to the above structure, the transfer paper P is charged in a polarity reversed to that of the transfer drum 11, and thus the charges on the pre-charge transfer paper P can be removed. Accordingly, the adhesion degree of the transfer paper P to the transfer drum 11 can be upgraded. As a result, a plurality of the transfer papers P can steadily adhere to the transfer drum 11 when a plurality of copies are made, thereby making it possible to produce a good-quality image on each copy.

Note that the adhesion degree of the transfer paper P to the transfer drum 11 is upgraded by charging the transfer paper P in a polarity reversed to that of the transfer drum 11 before the transfer paper P adheres to the transfer drum 11 in the first through third embodiments. However, when the transfer paper P is charged by the grounded ground roller 12 alone as was in the first embodiment, a discharge by the transfer drum 11 is less likely to occur compared with the case where the roller type brush 101 is used as was in the second embodiment. Hence, there occurs a problem that the transfer paper P is charged less efficiently in the first embodiment compared with the second embodiment. On the other hand, when the transfer paper P is charged by either the roller type brush 101 of the second embodiment or the comb-shaped brush 103 of the third embodiment alone, there occurs a problem that it is difficult to secure the adhesion of the transfer paper P to the transfer drum 11.

To eliminate these problems, the fourth embodiment of the present invention presents an image forming apparatus which can charge the transfer paper P more efficiently and improve the adhesion of the transfer paper P to the transfer drum 11.

[FOURTH EMBODIMENT]

Still another embodiment of the present invention will be explained in the following while referring to FIGS. 16 through 19.

Figure 16:
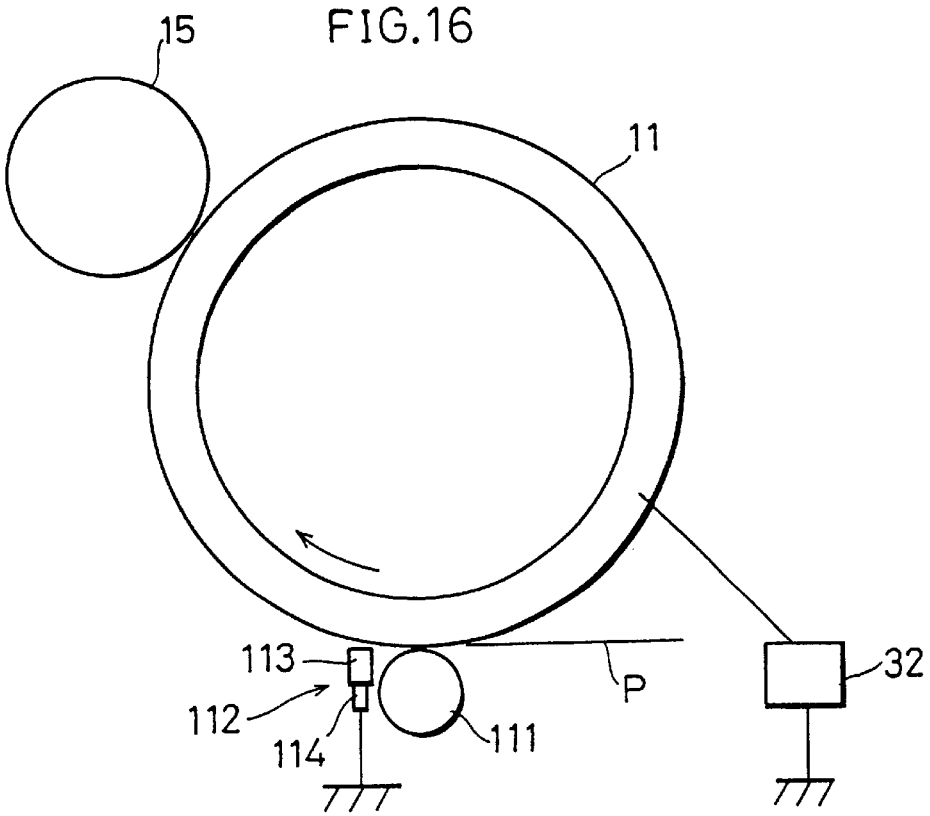
FIG. 16 is a schematic view showing a structure of an image forming apparatus in accordance with the fourth embodiment of the present invention.

As shown in FIG. 16, an image forming apparatus of the present embodiment includes a pressing roller 111 (adhesive transporting means) and a conductive brush 112 (potential difference generating means and an electrode member) instead of the ground roller 12 of the first embodiment; the pressing roller 111 presses the transfer paper P against the transfer drum 11, and the conductive brush 112 is provided on a downstream side of the pressing roller 111 in a direction in which the transfer paper P is transported to charge the transfer paper P.

The pressing roller 111 is extended in a widthwise direction of the transfer drum 11, and moved vertically by a driving mechanism such as the solenoids 12*b* (shown in FIG. 14) provided at the both ends of the pressing roller 111. In other words, when the transfer paper P is not transported to the pressing roller 111, the pressing roller 111 is separated from the transfer drum 11, and when the transfer paper P is transported to the pressing roller 111, the pressing roller 111 is moved toward the transfer drum 11 to press the transfer paper P against the transfer drum 11, and rotated in a direction indicated by an arrow while pressing the transfer paper P against the transfer drum 11, thereby transporting the transfer paper P. The pressing roller 111 is separated from the transfer drum 11 again when the transfer paper P being wound around the transfer drum 11 makes a full turn.

Note that the pressing roller 111 can be made of any material; however, a hard material is preferable because the pressing roller Ill is pressed against the transfer drum 11. In addition, there is no restriction as to the electric characteristics of the material.

Like the pressing roller 111, the conductive brush 112 is extended in the direction of the width of the transfer drum 11, and moved vertically by a vertical moving mechanism such as the solenoids 12*b* provided at the both ends of the conductive brush 112. Note that the pressing roller 111 and conductive brush 112 are moved vertically at the same timing.

The conductive brush 112 is grounded so as to trigger a discharge of the transfer drum 11 when brought into contact with the transported transfer paper P. That is to say, when the transfer paper P touches the conductive brush 112, a discharge occurs therebetween, and the transfer paper P is charged in a polarity reversed to that of the transfer drum 11, thereby allowing the transfer paper P to adhere to the transfer drum 11 electrostatically.

Figure 17:
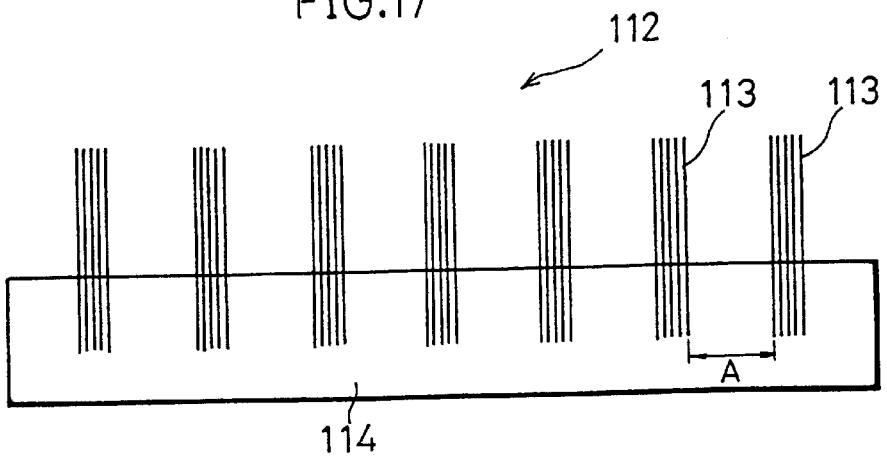
FIG. 17 is a schematic view showing a structure of a conductive brush provided around a transfer drum shown in FIG. 16.

As shown in FIG. 17, the conductive brush 112 is composed of a plurality of groups of bristles 113 each containing a certain number of bristles, and a brush supporting member 114 for supporting the groups of bristles 113. Each bristle is, for example, made of a conductive material such as a stainless fiber, a carbon fiber, and a copper-dyed acrylic fiber. Although the conductive brush 112 of the present embodiment is a comb-shaped brush, the conductive brush 112 may be a roller type brush. However, the roller type brush is inferior to the comb-shaped brush in triggering a discharge of the transfer drum 11. This is the reason why the come-shaped brush is used as the conductive brush 112 in the present embodiment.

The relation between the resistance value of the bristles (brush) and the charging effect on the transfer paper P is set forth in TABLE 17 below. Also, the relation between the pitch between the bristle groups 113 (hereinafter referred to as fur pitch) and the charging effect on the transfer paper P is set forth in TABLE 18 below.

TABLE 17

| BRUSH RESISTANCE VALUE (kΩ) | 70 OR MORE | 60 | 50 | 40 | 36 | 20 | 10 | 5 OR LESS |
|---|---|---|---|---|---|---|---|---|
| CHARGING EFFECT | X | Δ | Δ | ○ | ⊙ | ⊙ | ⊙ | ⊙ |

X: ALMOST NONE Δ: POOR ○: FAIR ⊙: EXCELLENT

TABLE 18

| FUR PITCH (mm) | 6.0 OR MORE | 3.0 | 2.0 | 1.6 | 0.5 | 0.3 OR LESS |
|---|---|---|---|---|---|---|
| CHARGING EFFECT | X | Δ | ○ | ⊙ | ⊙ | ⊙ |

X: ALMOST NONE Δ: POOR ○: FAIR ⊙: EXCELLENT

TABLE 17 reveals that the charging effect on the transfer paper P can be realized when the value of the brush resistance is 60 kΩ or less, and in particular, the charging effect is enhanced when the value of the brush resistance is 36 kΩ or less. Also, TABLE 18 reveals that the charging effect on the transfer paper P can be realized when the fur pitch is 3.0 mm or less, and in particular, the charging effect is enhanced when the fur pitch is 1.6 mm or less.

The pressing roller 111 and conductive brush 112 keep the contact with the transfer drum 11 while the transfer paper P makes a full turn around the transfer drum 11. This means that the contact between the pressing roller 111•conductive brush 112 and transfer drum 11 affects the charging efficiency of the transfer paper P.

The relation between the amount of thrust of the pressing roller 111 into the transfer drum 11, or namely, the amount of crossover of the transfer drum 11 and pressing roller 111, and the charging effect on the transfer paper P is set forth in TABLE 19 below. Also, the relation between the amount of thrust of the brush groups 113 into the transfer drum 11, or namely, the amount of crossover of the transfer drum 11 and conductive brush 112, and the charging effect on the transfer paper P is set forth in TABLE 20 below.

TABLE 19

| AMOUNT OF CROSSOVER (mm) | −0.5 OR LESS | 0.0 | 0.5 | 1.0 | 2.0 | 3.0 | 5.0 OR MORE |
|---|---|---|---|---|---|---|---|
| CHARGING EFFECT | X | ○ | ⊚ | ⊚ | ⊚ | ⊚ | ○ |

X: ALMOST NONE
Δ: POOR
○: FAIR
⊚: EXCELLENT

TABLE 20

| AMOUNT OF CROSSOVER (mm) | −0.5 OR LESS | 0.0 | 0.5 | 1.0 | 2.0 | 3.0 | 5.0 OR MORE |
|---|---|---|---|---|---|---|---|
| CHARGING EFFECT | X | ○ | ⊚ | ⊚ | ⊚ | ⊚ | ○ |

X: ALMOST NONE
Δ: POOR

TABLE 20-continued

| AMOUNT OF CROSSOVER (mm) | −0.5 OR LESS | 0.0 | 0.5 | 1.0 | 2.0 | 3.0 | 5.0 OR MORE |
|---|---|---|---|---|---|---|---|

○: FAIR
◎: EXCELLENT

TABLE 19 reveals that the charging effect on the transfer paper P can be realized when the pressing roller 111 and transfer drum 11 are brought into contact with each other, and in particular, the charging effect is enhanced when the amount of the crossover of the pressing roller 111 and transfer drum 11 is in a range between 0.5 mm and 3.0 mm. Also, TABLE 20 reveals that the charging effect on the transfer paper P can be realized when the conductive brush 112 and transfer drum 11 are brought into contact with each other, and in particular, the charging effect is enhanced when the amount of the crossover of the conductive brush 112 and transfer drum 11 is in a range between 0.5 mm and 3.0 mm. The pressing roller 111 and conductive brush 112 are separated from the transfer drum 11 when the transfer paper P adhering to the transfer drum 11 has made a full turn.

The charging effect on the transfer paper P corresponding to the amount of the spacing between the transfer drum 11 and the pressing roller 111•conductive brush 112 is set forth in TABLE 21 below. The charging effect referred herein represents a condition of a toner image formed on the transfer paper P. The less the effect on the toner image formed on the transfer paper P, the greater the charging effect.

TABLE 21

| AMOUNT OF SPACING (mm) | −0.5 OR LESS | 0.0 | 0.5 | 1.0 | 2.0 | 3.0 OR MORE |
|---|---|---|---|---|---|---|
| CHARGING EFFECT | X | X | ○ | ⊙ | ⊙ | ⊙ |

X: ALMOST NONE Δ: POOR ○: FAIR ⊙: EXCELLENT

TABLE 21 reveals that it is necessary to have the amount of the spacing of at least 0.5 mm, and more preferably 1.0 mm or more, between the pressing roller 111•conductive brush 112 and the transfer drum 11. Thus, when the pressing roller 111•conductive brush 112 and transfer drum 11 are spaced apart 1.0 mm or more, a toner image is formed satisfactorily on the transfer paper P, thereby producing a good-quality image. In contrast, when the pressing roller 111•conductive brush 112 and transfer drum 11 are spaced apart 0.5 mm or less, a toner image is formed unsatisfactorily on the transfer paper P.

Figure 18:
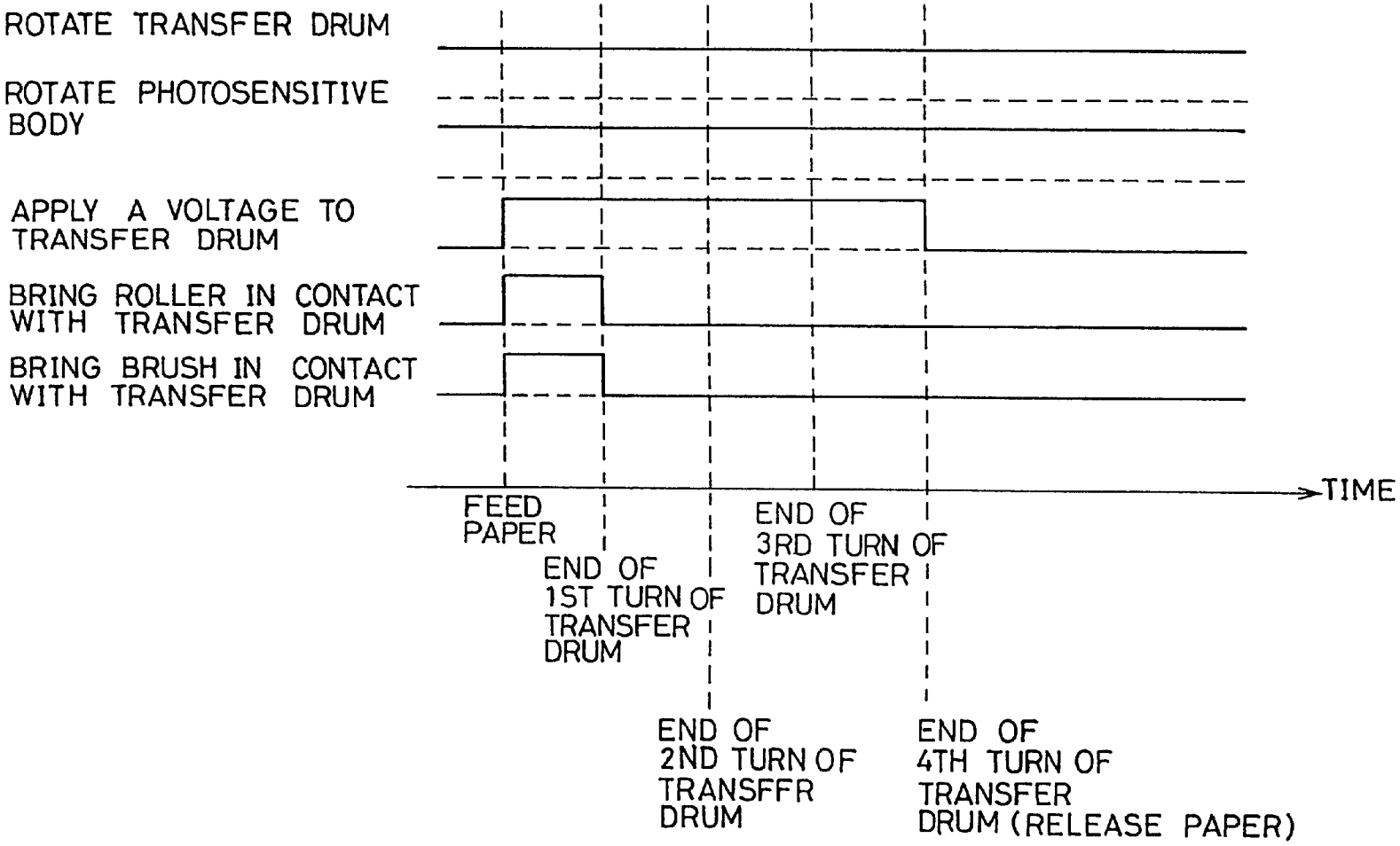
FIG. 18 is a timing chart showing the timing of operation of each component of the image forming apparatus shown in FIG. 16.

The components of the above-structured image forming apparatus shown in FIG. 16, that is, the transfer drum 11, photosensitive drum 15, pressing roller 111, and conductive brush 112 operate at the timing shown in FIG. 18.

Figure 19:
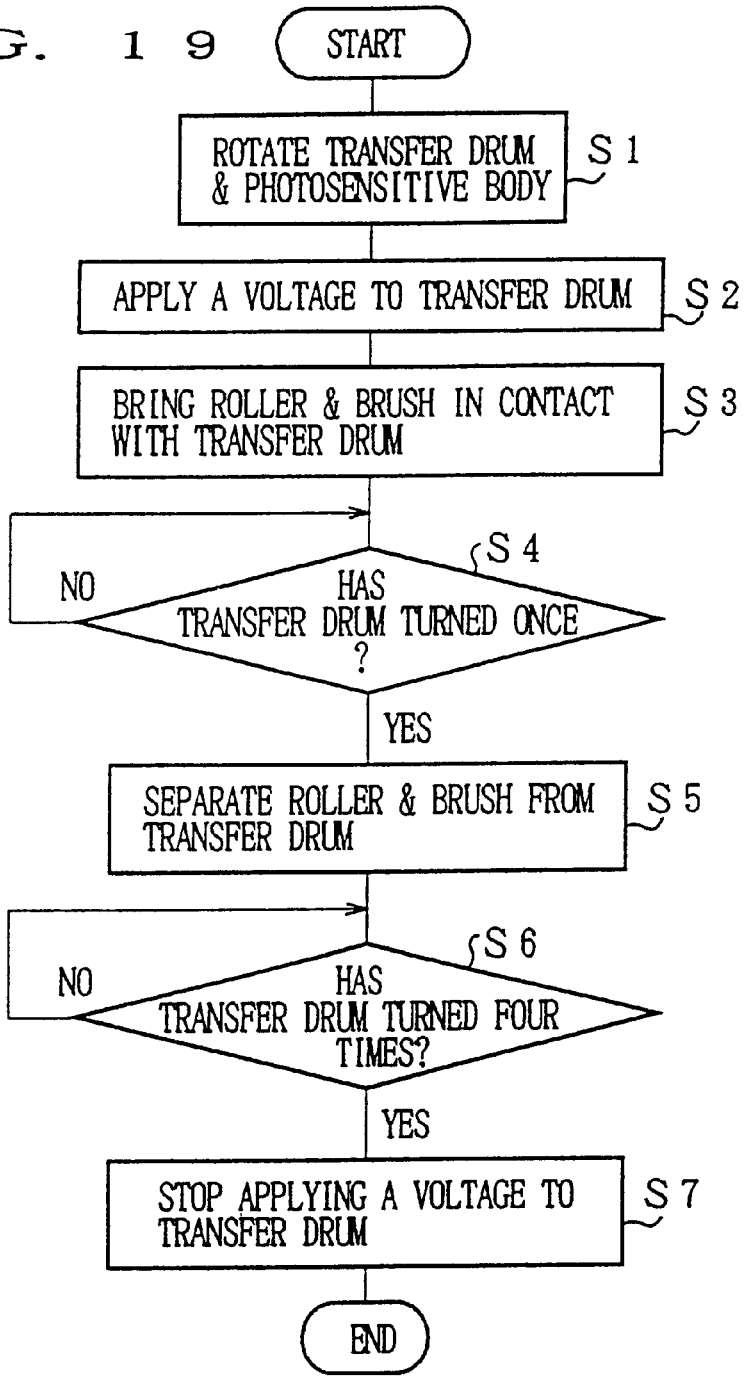
FIG. 19 is a flowchart detailing a charge removing job of the image forming apparatus shown in FIG. 16.

The process of toner-image transfer by the above image forming apparatus will be explained while referring to FIGS. 16 and 18 and the flowchart in FIG. 19. Assume that a full-color copy is made, and all the components mentioned below are under the control of the control device 148 shown in FIG. 14.

When an unillustrated power switch of the main body is turned on, the transfer drum 11 and photosensitive drum 15 are rotated in their respective directions (S1), and a 2500-V voltage is applied to the transfer drum 11 from the power source unit 32 (S2).

Subsequently, the transfer paper P is transported to a section between the pressing roller 111 and transfer drum 11, and the pressing roller 111 and conductive brush 112 are brought into contact with the transfer drum 11 (S3).

Then, whether the transfer drum 11 has made a full turn or not since the transfer paper P is wound around the transfer drum 11 is judged (S4). If the transfer drum 11 has made a full turn, the pressing roller 111 and conductive brush 112 are separated from the transfer drum 11 (S5).

Next, whether the transfer drum 11 has turned four times or not is judged; in other words, whether each of the toner images in four colors have been transferred onto the transfer paper P or not is judged (S6). If the transfer drum 11 has turned four times, the voltage supply to the transfer drum 11 is stopped (S7). Accordingly, the transfer paper P on which a full-color toner image is formed is separated from the transfer drum 11, and further transported to the fuser unit 4 (FIG. 2) so as to fuse the full-color toner image into place.

As has been explained, the image forming apparatus of the present embodiment includes the pressing roller 111 for securing the adhesion of the transfer paper P to the transfer drum 11, and the conductive brush 112 on a downstream side of the pressing roller 111 in a direction in which the transfer paper P is transported to charge the transfer paper P. According to this structure, the transfer paper P can adhere to the transfer drum 11 in a more secured manner while being charged more efficiently.

As a result, a sufficient amount of charges are supplied to the transfer paper P even when the humidity is high and a great amount of charges is necessary, thereby enabling the transfer drum 11 to attract the transfer paper P in a stable manner even when the humidity is high.

Thus, a toner image can be transferred onto the transfer paper P in a stable manner and an image is produced satisfactorily in a copy.

Note that if the transfer drum 11 is used continuously for a long period, (1) the electric potential of the transfer drum 11 becomes so high that the transfer drum 11 is not charged adequately, which may cause defects in a transferred toner image; and (2) the toner adheres to the surface of the transfer drum 11, which causes the back transfer on the transfer paper P. Thus, there occurs a problem that a toner image is not transferred onto the transfer paper P satisfactorily.

To eliminate this problem, an image forming apparatus which can remove the charges on the transfer drum 11 and clean the transfer drum 11 when the toner image has been transferred onto the transfer paper P so as to charge the transfer paper P more efficiently and hence enable the transfer paper P to adhere to the transfer roller 11 in a more secured manner will be explained in the following fifth through ninth embodiments.

[FIFTH EMBODIMENT]

Still another embodiment of the present invention will be explained in the following while referring to FIGS. 20 through 25.

Figure 20:
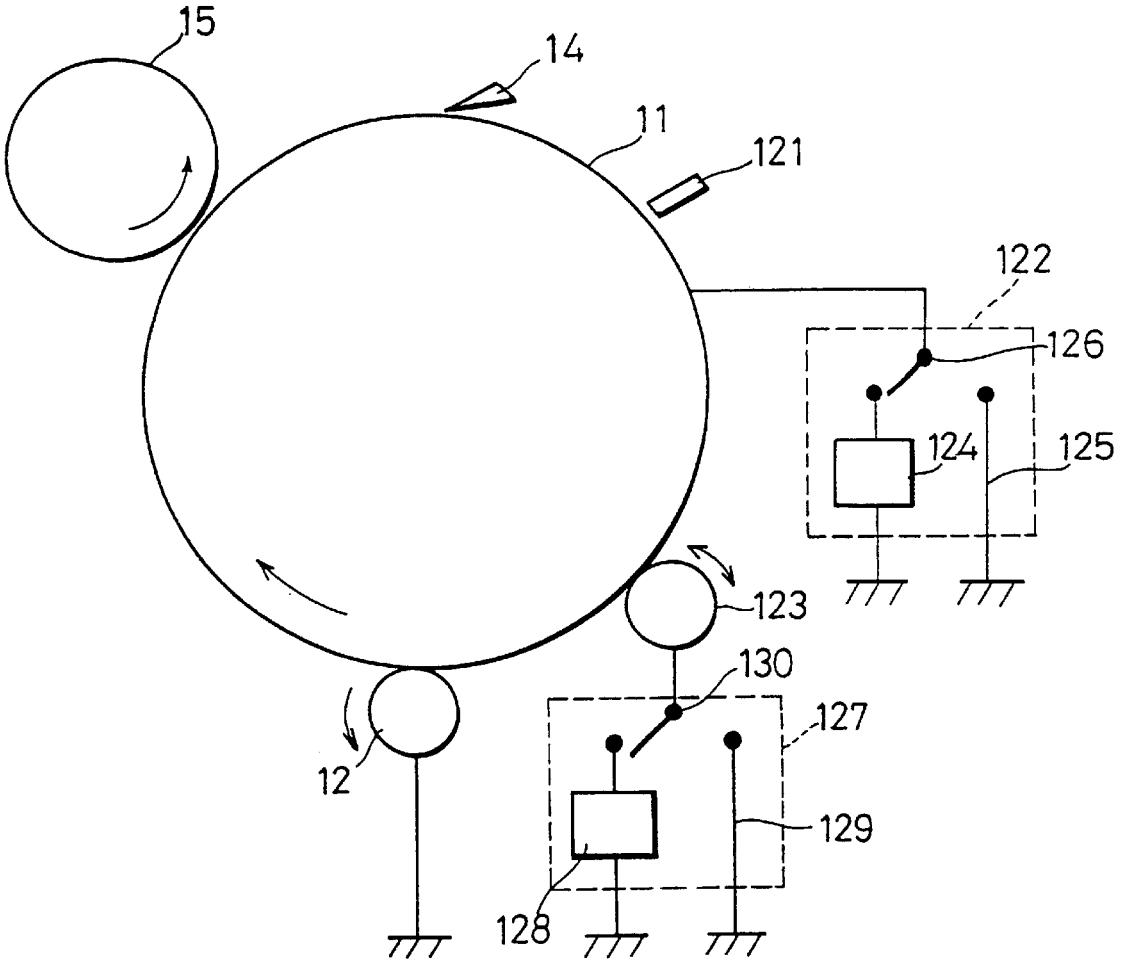
FIG. 20 is a schematic view showing a structure of an image forming apparatus in accordance with the fifth embodiment of the present invention.

As shown in FIG. 20, an image forming apparatus of the present embodiment includes the photosensitive drum 15 and transfer drum 11; and the separating claw 14, a cleaning blade 121 (toner cleaning means), a transfer drum's charge control device 122, a ground roller 123 (a conductive member and a conductive roller), and the ground roller 12 (potential difference generating means and an electrode member) are provided around the transfer drum 11 in this order from upstream to downstream in a direction in which the transfer drum 11 rotates.

The separating claw 14 separates the transfer paper P wound around the transfer drum 11 mechanically when a toner image has been transferred onto the transfer paper P.

The cleaning blade 121, which is as long as the width of the transfer drum 11, is provided so that it can move to touch and separate from the surface of the transfer drum 11. To be more specific, the cleaning blade 121 is separated from the transfer drum 11 while a toner image is transferred onto the transfer paper P, and brought into contact with the surface of the transfer drum 11 when the toner image has been transferred onto the transfer paper P. According to this structure, the toner adhering to the surface of the transfer drum 11 can be scraped off and the scraped toner is collected in an unillustrated collecting box.

The cleaning blade 121 is separated from the transfer drum 11 again when a following toner image is transferred onto the transfer paper P.

Note that the cleaning blade 121 is made of, for example, insulating elastic materials such as urethane, polyurethane, fluoro-rubber, and chloroprene, so that the cleaning blade 121 does not cause a flaw on the surface of the transfer drum 11 when the cleaning blade 121 is brought into contact with the transfer drum 11.

The cleaning blade 121 is pressed against the transfer drum 11 so as to remove the toner adhering to the surface of the transfer drum 11. The amount of thrust of the cleaning blade 121 into the transfer drum 11, or namely, the amount of the crossover of the cleaning blade 121 and transfer drum 11, and the corresponding cleaning effect are set forth in TABLE 22 below.

TABLE 22

| AMOUNT OF CROSSOVER (mm) | −0.5 OR LESS | 0.0 | 0.5 | 1.0 | 2.0 | 3.0 | 5.0 OR MORE |
|---|---|---|---|---|---|---|---|
| CLEANING EFFECT | X | ○ | ◎ | ◎ | ◎ | ◎ | ○ |

X: ALMOST NONE
Δ: POOR
○: FAIR
◎: EXCELLENT

TABLE 22 reveals that the cleaning effect can be realized when the cleaning blade 121 and transfer drum 11 are brought into contact with each other, and in particular, the cleaning effect is enhanced when the amount of the crossover of the cleaning blade 121 and transfer drum 11 is in a range between 0.5 mm and 3.0 mm.

The transfer drum's charge control device 122 includes a transfer drum's power source unit 124 for applying a voltage to the transfer drum 11, a grounding conductor 125 for removing the charges on the transfer drum 11, and a changeover switch 126 (second switching means) for selectively connecting the transfer drum 11 to the transfer drum's power source unit 124 and grounding conductor 125.

The changeover switch 126 switches the connection of the transfer drum 11 to the transfer drum's power source unit 124 when a toner image is transferred onto the transfer paper P, and to the grounding conductor 125 when the toner image has been transferred onto the transfer paper P. Thus, the transfer drum 11 is charged with a certain amount of charges through the connection with the transfer drum's power source unit 124 while the toner image is transferred onto the transfer paper P, whereas the charges on the transfer drum 11 are removed through the connection with the grounding conductor 125 when the toner image has been transferred onto the transfer paper P.

The ground roller 123, which is as long as the width of the transfer drum 11, is movable to touch and separate from the surface of the transfer drum 11. Note that the ground roller 123 is driven vertically by a driving mechanism such as the solenoids 12*b* formed on the both ends of the ground roller 123.

The ground roller 123 is connected to a charge removing means, charge control device 127. The charge removing means' charge control device 127 includes a charge removing means' power source unit 128 for applying a voltage to the ground roller 123, a grounding conductor 129 for removing the charges by grounding the ground roller 123, and a changeover switch 130 (first switching means) for selectively connecting the ground roller 123 to the charge removing means, power source unit 128 and grounding conductor 129.

The changeover switch 130 switches the connection of the ground roller 123 to the charge removing means' power source unit 128 when the transfer paper P passes through a section between the ground roller 123 and transfer drum 11, and to the grounding conductor 129 when the ground roller 123 is brought into tight contact with the transfer drum 11 after the transfer paper P is separated from the transfer drum 11.

Thus, a voltage is applied to the ground roller 123 so as to charge the transfer paper P in a polarity reversed to that of the transfer drum 11 through the connection with the charge removing means' power source unit 128, whereas the charges on the transfer drum 11 are removed by means of the ground roller 123 through the connection with the grounding conductor 129. In other words, charge removing means for removing the charges on the transfer drum 11 comprises the ground roller 123 and charge removing means' charge control device 127. According to this structure, the ground roller 123 is pressed against the transfer drum 11 by means of the solenoids 12*b* (FIG. 14) when the charges on the transfer drum 11 are to be removed.

The amount of thrust of the ground roller 123 into the transfer drum 11, or namely, the amount of crossover of the ground roller 123 and transfer drum 11, and the corresponding charge removing effect on the transfer drum 11 set forth in TABLE 23 below.

TABLE 23

| AMOUNT OF CROSSOVER (mm) | −0.5 OR LESS | 0.0 | 0.5 | 1.0 | 2.0 | 3.0 | 5.0 OR MORE |
|---|---|---|---|---|---|---|---|
| CHARGE REMOVING EFFECT | X | ○ | ◎ | ◎ | ◎ | ◎ | ○ |

X: ALMOST NONE
Δ: POOR
○: FAIR
◎: EXCELLENT

TABLE 23 reveals that the charge removing effect on the transfer drum 11 can be realized when the ground roller 123 and transfer drum 11 are brought into contact with each other, and in particular, the charge removing effect is enhanced when the amount of crossover is in a range between 0.5 mm and 3.0 mm.

Following is an explanation of a method of removing the charges on the transfer drum 11 by the above-structured image forming apparatus. Note that the switching operations of the transfer drum's charge control device 122 and charge removing means' charge control device 127 are under the control of the control device 148 shown in FIG. 14.

To begin with, the connection of the transfer drum 11 is switched to the grounding conductor 125 by the changeover switch 126 in the transfer drum's charge control device 122, and the connection of the ground roller 123 is switched to the grounding conductor 129 by the changeover switch 130 in the charge removing means' charge control device 127. Accordingly, the transfer drum 11 is grounded through two positions, and the charges are removed through these two positions.

Methods other than the above charge removing method are also applicable. For example, there is a method that neutralizes the charges on the transfer drum 11. To be more specific, the connection of the transfer drum 11 is switched to the transfer drum's power source unit 124 by the changeover switch 126 in the transfer drum's charging control device 122, while the connection of the ground roller 123 is switched to the charge removing means' power source unit 128 by the changeover switch 130 in the charge removing means, charge control device 127. Then, voltages having the same absolute value and reversed polarities are applied respectively to the transfer drum 11 and ground roller 123 from their respective power source units 124 and 128.

Further, there is a method in which the charges on the transfer drum 11 are removed by applying a voltage from either the transfer drum's power source unit 124 or charge removing means' power source unit 128, so that the charges are neutralized.

For example, the connection of the transfer drum 11 is switched to the transfer drum's power source unit 124 by the changeover switch 126 in the transfer drum's charge control device 122, and a voltage is applied to the transfer drum 11 from the transfer drum's power source unit 124 in a polarity reversed to a current polarity of the transfer drum 11, whereas the connection of the ground roller 123 is switched to the grounding conductor 129 by the changeover switch 130 in the charge removing means' charge control device 127.

There is still another method for removing the charges on the transfer drum 11 by neutralizing the charges. To be more specific, the connection of the transfer drum 11 is switched to the grounding conductor 125 by the changeover switch 126 in the transfer drum's charge control device 122, while the connection of the ground roller 123 is switched to the charge removing means' power source unit 128 by the changeover switch 130 in the charge removing means' charge control device 127. Accordingly, a voltage is applied to the ground roller 123 from the charge removing means' power source unit 128 in a polarity reversed to that of the transfer drum 11.

A ground roller 123 having an embossed surface is also used as the method for removing the charges on the transfer drum 11. In this case, the charge removing effect on the transfer drum 11 varies depending on the difference of elevation between the projections and depressions made on the surface as the result of embossing finish. The relation between the difference of elevation on the ground roller 123 and the charge removing effect on the transfer drum 11 is set forth in TABLE 24.

TABLE 24

| DIFFERENCE OF ELEVATION (μm) | 0.0 | 4.0 | 10.0 | 15.0 | 20.0 OR MORE |
|---|---|---|---|---|---|
| CHARGE REMOVING EFFECT | ○ | ⊙ | ⊙ | ○ | X |

X: ALMOST NONE Δ: POOR ○: FAIR ⊙: EXCELLENT

TABLE 24 reveals that the charge removing effect on the transfer drum 11 can be obtained when the difference of elevation on the ground roller 123 is in a range between 0.0 μm and 15.0 μm, and in particular, the charge removing effect is enhanced when the difference of elevation is in a range between 4.0 μm and 10.0 μm.

The ground roller 123 is structured in such a manner that it rotates together with the transfer drum 11 at the same speed when pressed against the transfer drum 11. In this case, the ground roller 123 is brought into contact with the transfer drum 11 as has been explained, and the charges on the transfer roller 11 can be removed through the ground roller 123.

As has been explained, the charge removing effect on the transfer drum 11 is realized by rotating the ground roller 123 together with the transfer drum 11, and the charge removing effect can be upgraded by giving a difference in the relative speed to the ground roller 123 with respect to the transfer drum 11. The relation between the difference in the relative speed of the ground roller 123 with respect to the transfer drum 11 and the charge removing effect on the transfer drum 11 is set forth in TABLE 25.

TABLE 25

| DIFFERENCE IN RELATIVE SPEED WITH TRANSFER DRUM 11 | SLOWER 10% OR MORE | SLOWER 5% | NO DIFFERENCE | FASTER 5% | FASTER 10% OR MORE |
|---|---|---|---|---|---|
| CHARGE REMOVING EFFECT | Δ | Δ | ○ | ⊙ | ⊙ |

X: ALMOST NONE Δ: POOR ○:FAIR ⊙: EXCELLENT

TABLE 25 reveals that the charge removing effect on the transfer drum 11 can be obtained when the ground roller 123 and transfer drum 11 rotate at the same speed, that is, when there is no difference in the relative speed between the ground roller 123 and transfer drum 11, and in particular, the charge removing effect is enhanced when the ground roller 123 is not less than 5% faster than the transfer drum 11 in the relative speed.

The charge removing and cleaning operations for the transfer drum 11 continue until the transfer drum 11 has made a full turn, and when these operations end, the cleaning blade 121 and ground roller 123 are separated from the transfer drum 11. The relation between the amount of the spacing between the cleaning blade 121 and transfer drum 11 and the cleaning effect is set forth in TABLE 26 below. Also, the relation between the amount of the spacing between the ground roller 123 and transfer drum 11 and the charge removing effect is set forth in TABLE 27 below.

TABLE 26

| AMOUNT OF SPACING (mm) | −0.5 OR LESS | 0.0 | 0.5 | 1.0 | 2.0 | 3.0 OR MORE |
|---|---|---|---|---|---|---|
| CLEANING EFFECT | X | X | ○ | ⊙ | ⊙ | ⊙ |

X: ALMOST NONE Δ: POOR ○: FAIR ⊙: EXCELLENT

TABLE 27

| AMOUNT OF SPACING (mm) | −0.5 OR LESS | 0.0 | 0.5 | 1.0 | 2.0 | 3.0 OR MORE |
|---|---|---|---|---|---|---|
| CHARGE REMOVING EFFECT | X | X | ○ | ⊙ | ⊙ | ⊙ |

X: ALMOST NONE Δ: POOR ○: FAIR ⊙: EXCELLENT

TABLE 26 reveals that the cleaning effect on the transfer drum 11 can be realized when the amount of the spacing between the cleaning blade 121 and transfer drum 11 is 0.5 mm or more, and in particular, the cleaning effect is enhanced when the amount of spacing is 1.0 mm or more. Also, TABLE 27 reveals that the charge removing effect on the transfer drum 11 can be realized when the amount of the spacing between the ground roller 123 and transfer drum 11 is 0.5 mm or more, and in particular, the charge removing effect is enhanced when the amount of spacing is 1.0 mm or more.

As has been explained, not only the post-transfer toner adhering to the surface of the transfer drum 11 can be removed, but also unwanted charges on the transfer drum 11 can be removed by providing the cleaning blade 121, transfer drum's charge control device 122, and the ground roller 123 serving as the charge removing means around the transfer drum 11.

Accordingly, the transfer drum 11 can be charged with an adequate amount of charges, in other words, the charges on the transfer drum 11 can be stabilized. As a result, the transfer drum 11 can attract the transfer paper P and transfer a toner image onto the transfer paper P in a stable manner, thereby producing a good-quality image in a copy.

Note that the ground roller 123 shown in FIG. 20 is used as the charge removing means of the present embodiment for removing the charges on the transfer drum 11. However, the charge removing means is not limited to the ground roller 123. A roller type conductive brush 131 shown in FIG. 21 or a comb-shaped conductive brush 132 composed of a conductive brush shown in FIG. 22 may be used instead of the ground roller 123. Further, a pad type conductive brush may be used as the charge removing means. In this case, the amount of thrust of the brush into the transfer drum 11 and the like and the corresponding effects are identical with those in the case of the comb-shaped conductive brush 132.

Like the roller type brush 101 of the second embodiment, the roller type conductive brush 131 is substantially as wide as the transfer drum 11, and presses against the transfer drum 11 when the charges on the transfer drum 11 are removed. The roller type brush 101 is driven by the same driving mechanism as that of the ground roller 123.

Also, like the comb-shaped brush 103 of the third embodiment, the comb-shaped conductive brush 132 has the brush surface substantially as wide as the transfer drum 11, and presses the transfer paper P against the transfer drum 11 when the charges on the transfer drum 11 are removed. The comb-shaped conductive brush 132 is also driven by the same driving mechanism as that of the ground roller 123.

The roller type conductive brush 131 and comb-shaped conductive brush 132 remove the charges on the transfer drum 11 at the same timing as the ground roller 123.

Thus, the followings are identical with the case when the ground roller 123 is used: the amount of the thrust of the brush surface of the roller type conductive brush 131 into the transfer drum 11 when they are pressed against each other, that is, the relation between the amount of crossover of the roller type conductive brush 131 and transfer drum 11 and the charge removing effect on the transfer drum 11; the relation between the applied voltage to the roller type conductive brush 131 and the charge removing effect on the transfer drum 11; the relation between the voltage applied either from the transfer drum's power source unit 124 or charge removing means' power source unit 128 and the charge removing effect on the transfer drum 11; and the relation between the amount of spacing between the roller type conductive brush 131 and transfer drum 11 and the charge removing effect on the transfer drum 11. The same can be said with the comb-shaped conductive brush 132.

Figure 21:
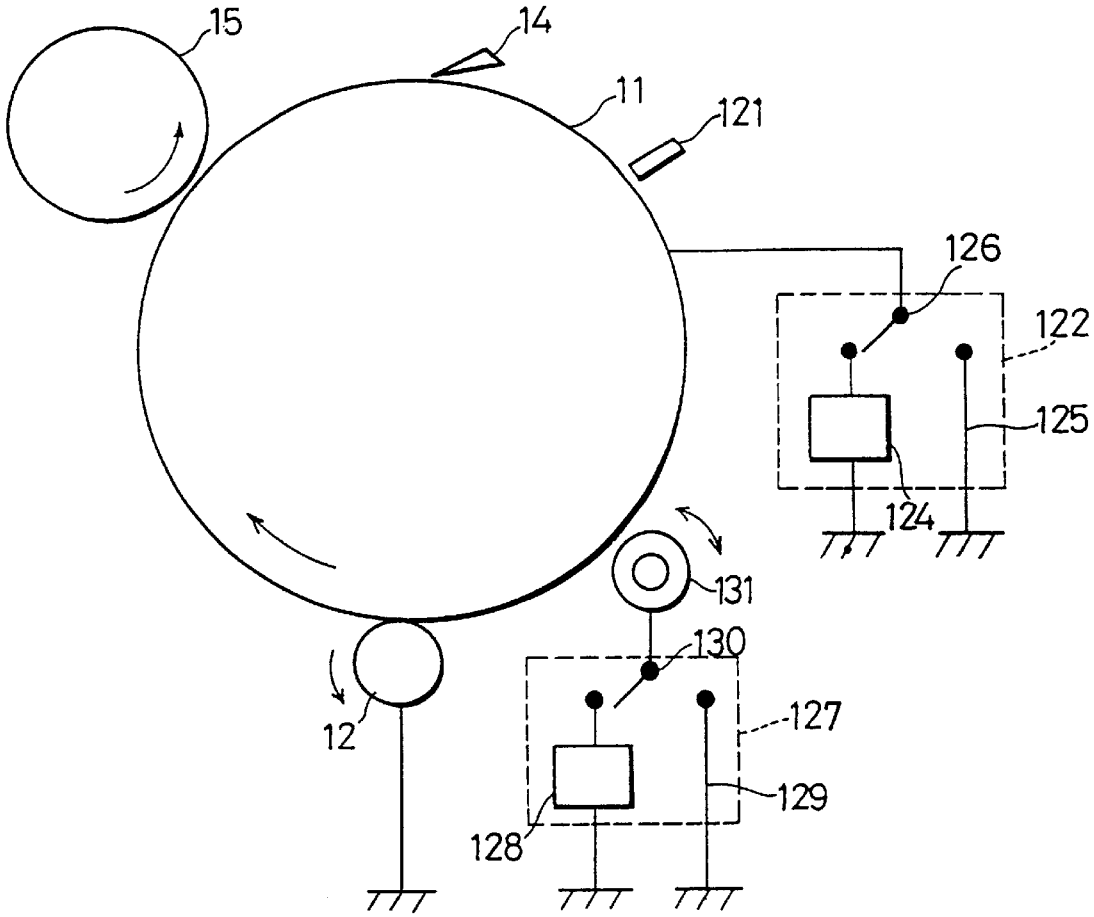
FIG. 21 is a schematic view showing another structure around a transfer drum shown in FIG. 20.

The roller type conductive brush 131 rotates in the direction indicated by an arrow in FIG. 21 while being pressed against the transfer drum 11. Thus, the relation between the rate of the rotation speed of the roller type conductive brush 131 with respect to the transfer drum 11 and the charge removing effect on the transfer drum 11 is identical with the relation between the difference in the relative speed of the ground roller 123 with respect to the transfer drum 11 and the charge removing effect on the transfer drum 11.

Each of the roller type conductive brush 131 and comb-shaped conductive brush 132 presses their respective tips of the brushes against the transfer drum 11. Thus, the charge removing effect varies depending on the value of the resistance of the brush, and the relation between the value of the resistance of the brush and the charge removing effect on the transfer drum 11 is set forth in TABLE 28 below.

TABLE 28

| BRUSH RESISTANCE VALUE (kΩ) | 70 OR MORE | 60 | 50 | 40 | 35 | 20 | 10 | 5 OR LESS |
|---|---|---|---|---|---|---|---|---|
| CHARGE REMOVING EFFECT | X | Δ | Δ | ○ | ⊙ | ⊙ | ⊙ | ⊙ |

X: ALMOST NONE
Δ: POOR
○: FAIR
⊙: EXCELLENT

TABLE 28 reveals that the charge removing effect on the transfer drum 11 can be realized when the value of the brush resistance is 40 kΩ or less, and in particular, the charge removing effect is enhanced when the resistance value of the brush resistance is 36 kΩ or less.

The charge removing effect also varies depending on the amount of brushes making contact with the transfer drum 11, or namely, the brush density. The relation between the brush density of the roller type conductive brush 131 and the charge removing effect on the transfer drum 11 is set forth in TABLE 29 below, and the relation between the intervals between the brush groups called as the fur pitch of the comb-shaped conductive brush 132 and the charge removing effect on the transfer drum 11 is set forth in TABLE 30 below. The definition of the fur pitch was given in the third embodiment.

TABLE 29

| Nos. OF BRUSHES (ps/cm$^2$) | 3000 OR LESS | 5000 | 10000 | 15000 | 20000 | 25000 | 30000 OR MORE |
|---|---|---|---|---|---|---|---|
| CHARGE REMOVING EFFECT | X | Δ | Δ | ○ | ⊙ | ⊙ | ○ |

X: ALMOST NONE
Δ: POOR
○: FAIR
⊙: EXCELLENT

TABLE 30

| FUR PITCH (mm) | 6.0 OR MORE | 3.0 | 2.0 | 1.6 | 0.5 | 0.3 OR LESS |
|---|---|---|---|---|---|---|
| CHARGE REMOVING EFFECT | X | Δ | ○ | ⊙ | ⊙ | ⊙ |

X: ALMOST NONE Δ: POOR ○: FAIR ⊙: EXCELLENT

TABLE 29 reveals that the charge removing effect on the transfer drum 11 can be realized when the brush density of the roller type conductive brush 131 is 15000 pieces/cm$^2$ or more, and in particular, the charge removing effect is enhanced when the brush density is 20000 pieces/cm$^2$ or more. Also, TABLE 30 reveals that the charge removing effect on the transfer drum 11 can be realized when the fur pitch of the comb-shaped conductive brush 132 is 3.0 mm or less, and in particular, the charge removing effect is enhanced when the fur pitch is 1.6 mm or less.

To remove the charges on the transfer drum 11 and attract the transfer paper P to the transfer drum 11 efficiently, the components forming the charge removing means, such as the ground roller 123, roller type conductive brush 131, and comb-shaped conductive brush 132, are made of conductive members. Preferable conductive members are: a stainless fiber, a carbon fiber, a copper-dyed acrylic fiber, a conductive non-woven fabric, a conductive sheet, etc.

Since the brush portion of the roller type conductive brush 131 and that of the comb-shaped conductive brush 132 are brought into contact with the surface of the transfer drum 11, the brush portion can scrape off the toner adhering to the transfer drum 11. Thus, the structures shown in FIGS. 23 and 24 omitting the cleaning blade 121 are also applicable. In short, the present embodiment can provide an image forming apparatus employing the roller type conductive brush 131 or comb-shaped conductive brush 132 serving as both the charge removing means and the cleaning means.

Figure 22:
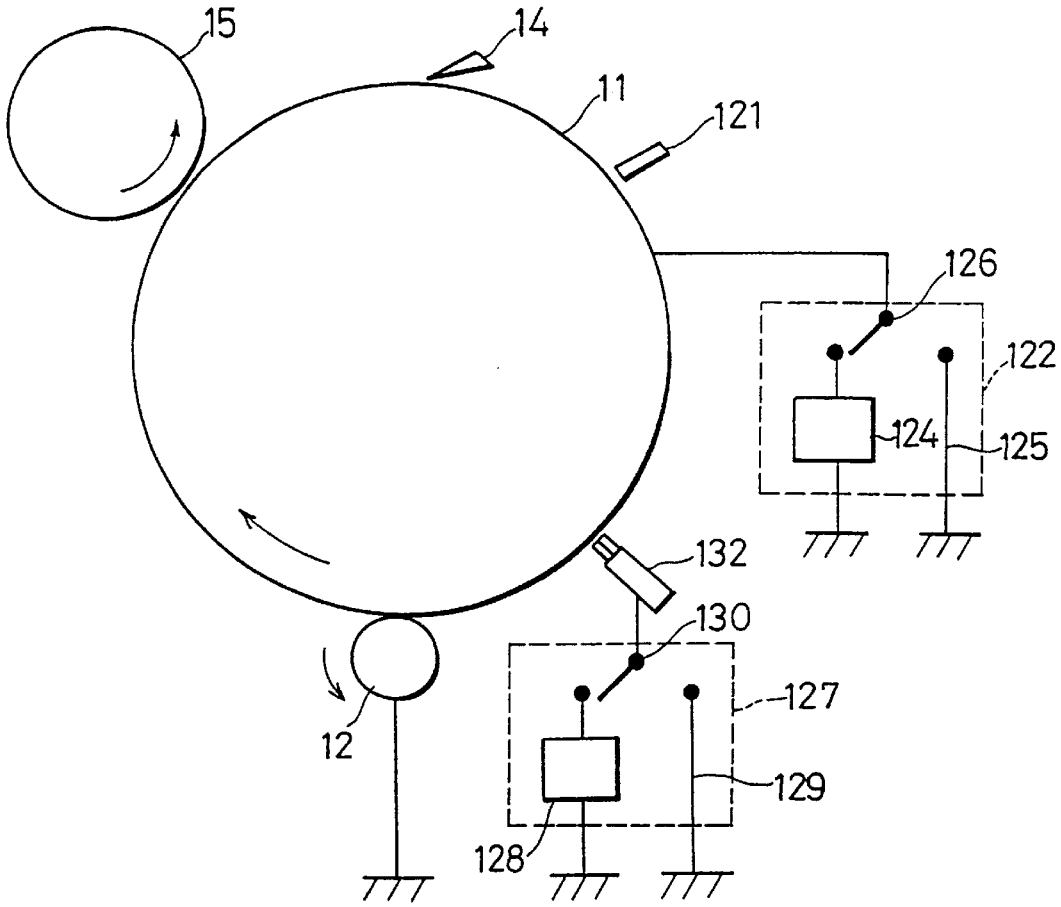
FIG. 22 is a schematic view showing still another structure around the transfer drum shown in FIG. 20.

Although the cleaning blade 121 is omitted, the cleaning effect and charge removing effect on the transfer drum 11 are identical with those realized by the image forming apparatuses of the structures shown in FIGS. 20 through 22, respectively.

Figure 25:
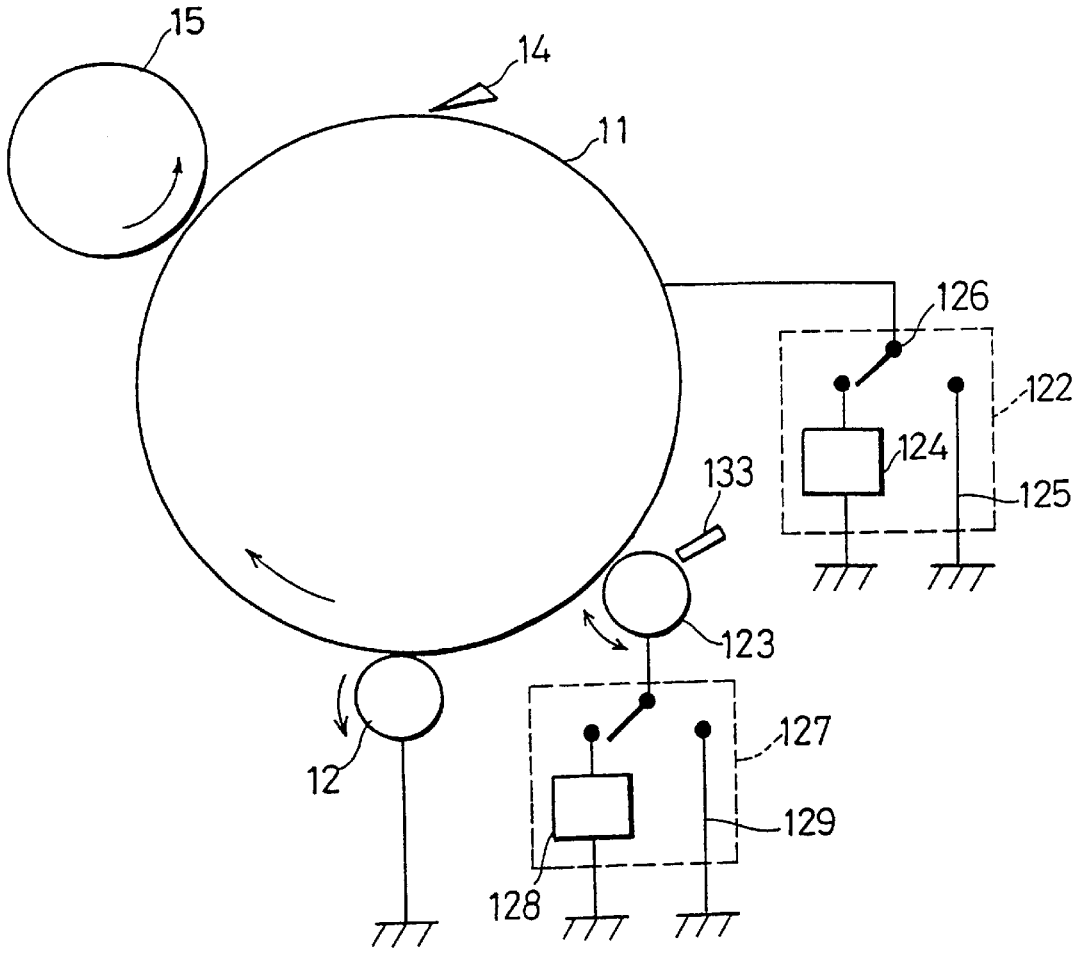
FIG. 25 is a schematic view showing still another structure around the transfer drum shown in FIG. 23.

There is another image forming apparatus which does not include the cleaning blade 121 around the transfer drum 11 but includes a cleaning blade 133 (roller cleaning means) for scraping off the toner adhering to the surface of the ground roller 123 as shown in FIG. 25.

More precisely, the ground roller 123 is pressed against the transfer drum 11 when it serves as the charge removing means. Accordingly, the toner adhering to the transfer drum 11 is transferred onto the surface of the ground roller 123, and the toner adhering to the ground roller 123 is scraped off by the cleaning blade 133. This means that the toner adhering to the transfer drum 11 is removed indirectly by the ground roller 123.

Figure 23:
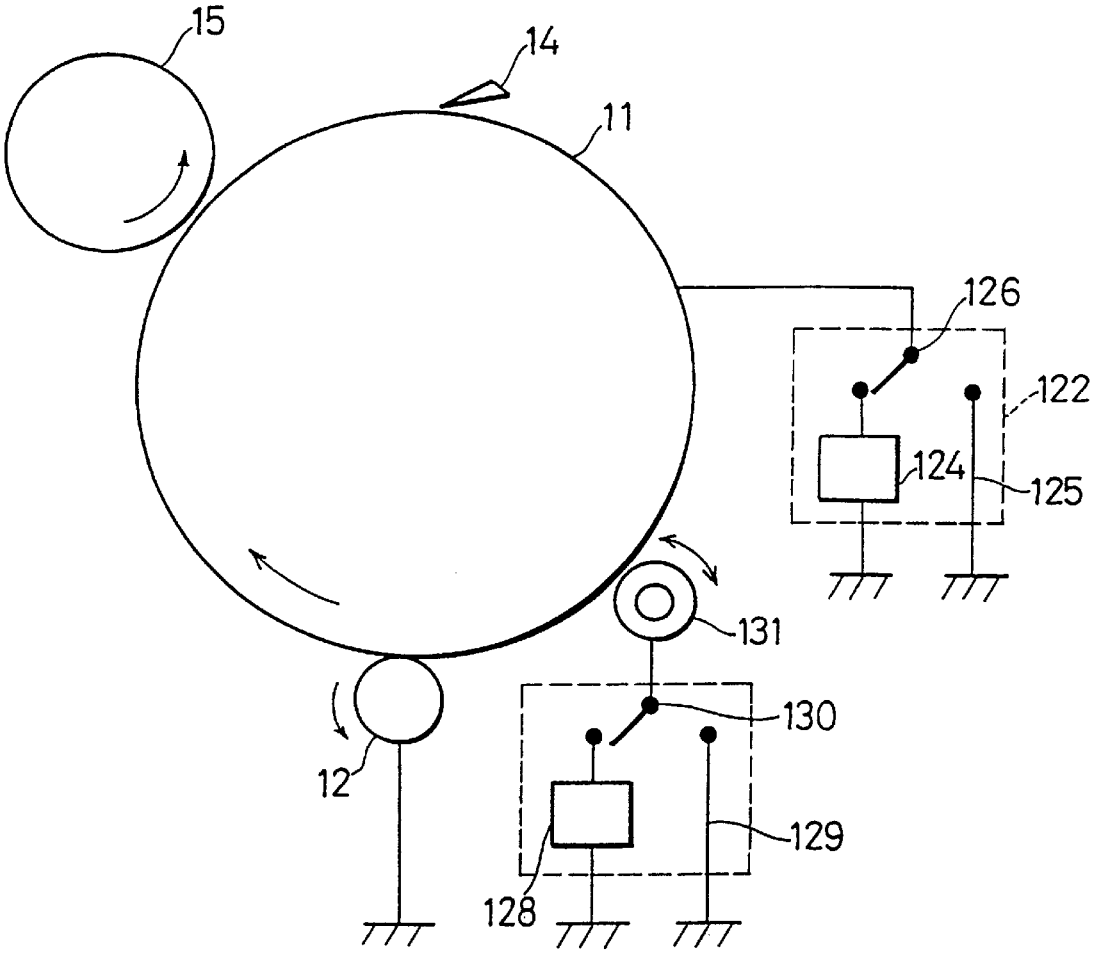
FIG. 23 is a schematic view showing a structure of a modified image forming apparatus of the fifth embodiment.
Figure 24:
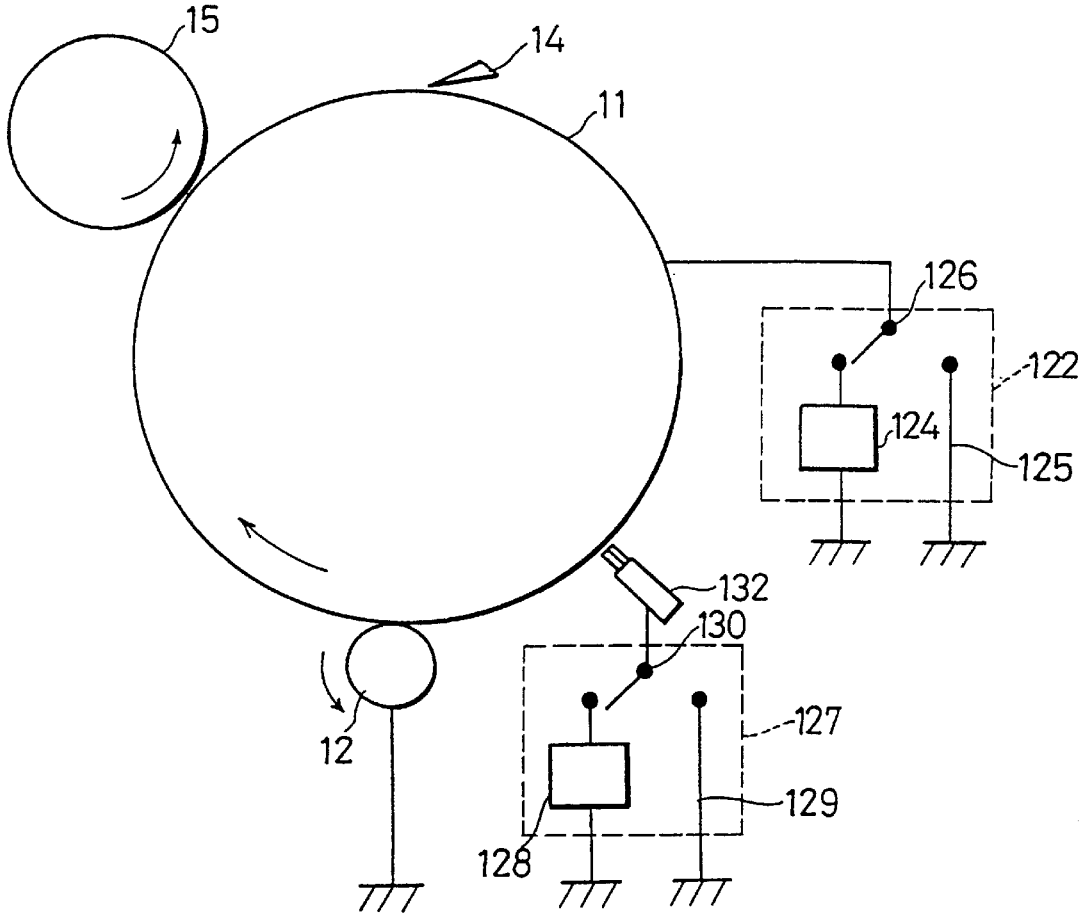
FIG. 24 is a schematic view showing another structure around a transfer drum shown in FIG. 23.

The charge removing effect and cleaning effect on the transfer drum 11 of the above image forming apparatus are identical with those realized by the image forming apparatuses of the structures omitting the cleaning blade 121 shown in FIGS. 23 and 24, respectively.

The charge removing means for the transfer drum 11 and the attracting means for attracting the transfer paper P to the transfer drum 11 are provided separately in the present embodiment. However, a single member may serve as both the charge removing means and the attracting means. A structure enabling a single member to serve as both the charge removing means and the attracting means will be explained in the sixth embodiment below.

[SIXTH EMBODIMENT]

Still another embodiment of the present invention will be explained in the following while referring to FIGS. 26 through 28.

Figure 26:
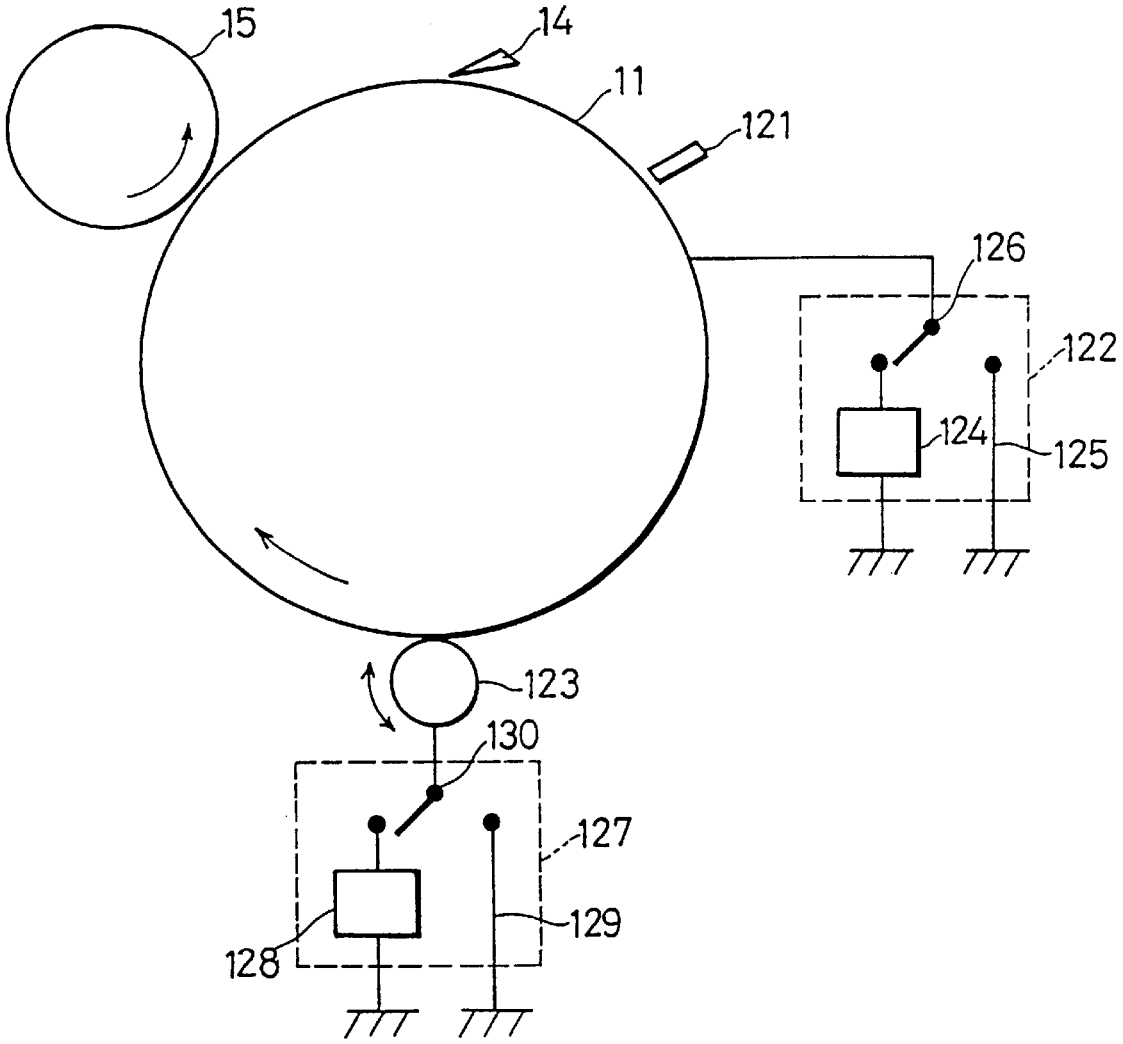
FIG. 26 is a schematic view showing a structure of an image forming apparatus in accordance with the sixth embodiment of the present invention.

As shown in FIG. 26, an image forming apparatus of the present embodiment includes the photosensitive drum 15 and transfer drum 11; and the separating claw 14, cleaning blade 121, transfer drum's charge control device 122, and ground roller 123 are provided around the transfer drum 11 in this order from upstream to downstream in a direction in which the transfer drum 11 rotates.

The ground roller 123, which is as long as the width of the transfer drum 11, is movable to touch and separate from the surface of the transfer drum 11. To be more specific, the ground roller 123 is separated from the transfer drum 11 when the power is just turned on, pressed against the transfer drum 11 with the transfer paper P in between when the transfer paper P is transported to a position where the ground roller 123 is brought into contact with the transfer drum 11, and rotated in the direction indicated by an arrow as the transfer drum 11 rotates. At this point, a voltage is applied to the ground roller 123 in a polarity reversed to that of the voltage applied to the transfer drum 11. Accordingly, the transfer paper P is charged in a polarity reversed to that of the transfer drum 11, thereby enabling the transfer drum 11 to attract the transfer paper P. In short, the ground roller 123 serves as the attracting means for attracting the transfer paper P to the transfer drum 11.

The ground roller 123 is separated from the transfer drum 11 when the transfer drum 11 makes a full turn while the transfer paper P is wound around the same, and pressed against the transfer drum 11 again when the transfer drum 11 has turned four times and the transfer paper P is separated from the transfer drum 11 by the separating claw 14.

Note that when the transfer paper P is transported to the section between the ground roller 123 and transfer drum 11, the ground roller 123 is separated from the transfer drum 11 temporarily, so that the transfer paper P passes through the section while the ground roller 123 is being pressed against the transfer drum 11.

The ground roller 123 is moved vertically by the solenoids **12*b* (FIG. 14) provided on the both ends of the ground roller 123** as was in the first embodiment.

The ground roller 123 is connected to the charge removing means' charge control device 127 having the same function explained in the fifth embodiment. Thus, a voltage such that charges the ground roller 123 in a polarity reversed to that of the transfer drum 11 is applied through the connection with the charge removing means, power source unit 128, and the charges on the transfer drum 11 are removed by means of the ground roller 123 through the connection with the grounding conductor 129.

The same charge removing effect on the transfer drum 11 as that of the fifth embodiment is realized when the ground roller 123 is used.

The charges on the transfer drum 11 may be removed by the methods other than the above charge removing method. For example, the connection of the transfer drum 11 is switched to the transfer drum's power source unit 124 by the changeover switch 126 in the transfer drum's charge control device 122, whereas the connection of the ground roller 123 is switched to the charge removing means' power source unit 128 by the changeover switch 130 in the charge removing means' charge control device 127. Then, voltages having the same absolute value and reversed polarities are applied respectively to the transfer drum 11 and ground roller 123 from their respective power source units 124 and 128.

The same charge removing effect on the transfer drum 11 as that of the fifth embodiment is also realized by the above method.

Further, there is still another method, in which the charges on the transfer drum 11 are removed by applying a voltage from either the transfer drum's power source unit 124 or charge removing means' power source unit 128.

For example, the connection of the transfer drum 11 is switched to the transfer drum's power source unit 124 by the changeover switch 126 in the transfer drum's charge control device 122, and a voltage is applied to the transfer drum 11 from the transfer drum's power source unit 124 in a polarity reversed to a current polarity of the transfer drum 11, whereas the connection of the ground roller 123 is switched to the grounding conductor 129 by the changeover switch 130 in the charge removing means' charge control device 127. Accordingly, the charges on the transfer drum 11 are neutralized when a voltage is applied to the transfer drum 11 from the transfer drum's power source unit 124.

There is still another method for removing the charges on the transfer drum 11 by neutralizing the charges. To be more specific, the connection of the transfer drum 11 is switched to the grounding conductor 125 by the changeover switch 126 in the transfer drum's charge control device 122, while the connection of the ground roller 123 is switched to the charge removing means' power source unit 128 by the changeover switch 130 in the charge removing means' charge control device 127. Accordingly, the charges on the transfer drum 11 are neutralized when a voltage is applied to the transfer drum 11 from the charge removing means' power source unit 128 in a polarity reversed to a current polarity of the transfer drum 11.

The same charge removing effect on the transfer drum 11 as that of the fifth embodiment is also realized by the above method.

A ground roller 123 with an embossed surface is also used as a method for removing the charges on the transfer drum 11. In this case, although the charge removing effect on the transfer drum 11 varies depending on the difference of elevation on the surface made as the result of embossing finish, the same charge removing effect on the transfer drum 11 as that of the fifth embodiment is also realized by the above method.

The conductive drum 123 is structured in such a manner that it rotates together with the transfer drum 11 at the same speed when it is pressed against the transfer drum 11. In this case, the ground roller 123 makes contact with the transfer drum 11 as has been explained, and the charges on the transfer drum 11 can be removed through the ground roller 123.

As has been explained, the charge removing effect on the transfer drum 11 is realized by rotating the ground roller 123 together with the transfer drum 11, and the charge removing effect can be upgraded by giving a difference in the relative speed to the ground roller 123 with respect to the transfer drum 11. The relation between the difference in the relative speed of the ground roller 123 with respect to the transfer drum 11 and the charge removing effect on the transfer drum 11 is set forth in TABLE 31.

TABLE 31

| DIFFERENCE IN RELATIVE SPEED WITH TRANSFER DRUM 11 | SLOWER 10% OR MORE | SLOWER 5% | NO DIFFER-ENCE | FAST-ER 5% | FASTER 10% OR MORE |
|---|---|---|---|---|---|
| CHARGE REMOVING EFFECT | Δ | Δ | ○ | ⊙ | ⊙ |

X: ALMOST NONE Δ: POOR ○: FAIR ⊙: EXCELLENT

TABLE 31 reveals that the charge removing effect on the transfer drum 11 can be obtained when the ground roller 123 and transfer drum 11 rotate at the same speed, that is, when there is no difference between the ground roller 123 and transfer drum 11 in relative speed, and in particular, the charge removing effect is enhanced when the ground roller 123 is not less than 5% faster than the transfer drum 11 in relative speed.

The charge removing and cleaning operations for the transfer drum 11 continue until the transfer drum 11 has made a full turn, and when these operations end, the cleaning blade 121 and ground roller 123 are separated from the transfer drum 11. The relation between the amount of the spacing between the cleaning blade 121 and transfer drum 11 and the cleaning effect is set forth in TABLE 32 below. Also, the relation between the amount of the spacing between the ground roller 123 and transfer drum 11 and the charge removing effect is set forth in TABLE 33 below.

TABLE 32

| AMOUNT OF SPACING (mm) | −0.5 OR LESS | 0.0 | 0.5 | 1.0 | 2.0 | 3.0 OR MORE |
|---|---|---|---|---|---|---|
| CLEANING EFFECT | X | X | ○ | ⊙ | ⊙ | ⊙ |

X: ALMOST NONE Δ: POOR ○: FAIR ⊙: EXCELLENT

TABLE 33

| AMOUNT OF SPACING (mm) | −0.5 OR LESS | 0.0 | 0.5 | 1.0 | 2.0 | 3.0 OR MORE |
|---|---|---|---|---|---|---|
| CHARGE REMOVING EFFECT | X | X | ○ | ⊙ | ⊙ | ⊙ |

X: ALMOST NONE Δ: POOR ○: FAIR ⊙: EXCELLENT

TABLE 32 reveals that the cleaning effect on the transfer drum 11 can be realized when the amount of the spacing between the cleaning blade 121 and transfer drum 11 is 0.5 mm or more, and in particular, the cleaning effect is enhanced when the amount of spacing is 1.0 mm or more. Also, TABLE 33 reveals that the charge removing effect on the transfer drum 11 can be realized when the amount of the spacing between the ground roller 123 and transfer drum 11 is 0.5 mm or more, and in particular, the charge removing effect is enhanced when the amount of spacing is 1.0 mm or more.

As has been explained, not only the post-transfer toner adhering to the surface of the transfer drum 11 can be removed, but also unwanted charges on the transfer drum 11 can be removed by providing the cleaning blade 121, transfer drum's charge control device 122, and the ground roller 123 serving as the charge removing means around the transfer drum 11.

Accordingly, the transfer drum 11 can be charged with an adequate amount of charges, that is, the charges on the transfer drum 11 can be stabilized. As a result, the transfer drum 11 can attract the transfer paper P and transfer a toner image onto the transfer paper P in a stable manner, thereby producing a good-quality image in a copy.

Note that the ground roller 123 shown in FIG. 26 is used as the charge removing means of the present embodiment for removing the charges on the transfer drum 11. However, the charge removing means is not limited to the ground roller 123. A roller type conductive brush 131 shown in FIG. 27 or a comb-shaped conductive brush 132 composed of a conductive brush shown in FIG. 28 may be used instead of the ground roller 123. Further, a pad type conductive brush may be used as the charge removing means. In this case, the amount of thrust of the brush into the transfer drum 11 and the like and the corresponding effects are identical with those in the case of the comb-shaped conductive brush 132.

Like the roller type brush 101 of the second embodiment, the roller type conductive brush 131 is substantially as wide as the transfer drum 11, and presses the transfer paper P against the transfer drum 11 when the transfer paper P passes through a section between the transfer drum 11 and the roller conducive rush 131. The roller type conductive brush 131 is driven by the same driving mechanism as that of the ground roller 12 of the first embodiment.

Also, like the comb-shaped brush 103 of the third embodiment, the comb-shaped conductive brush 132 has the brush surface substantially as wide as the transfer drum 11, and presses the transfer paper P against the transfer drum 11 when the transfer paper P passes through a section between the transfer drum and comb-shaped conductive brush 132. The comb-shaped conductive brush 132 is also driven by the same driving mechanism as that of the ground roller 12 of the first embodiment.

The roller type conductive brush 131 and comb-shaped conductive brush 132 remove the charges on the transfer drum 11 in the same mechanism as that of the ground roller 123.

Thus, the followings are identical when the ground roller 123 is used: the amount of the thrust of the brush surface of the roller type conductive brush 131 into the transfer drum 11 when they are pressed against each other, that is, the relation between the amount of crossover of the roller type conductive brush 131 and transfer drum 11 and the charge removing effect on the transfer drum 11; the relation between the applied voltage to the roller type conductive brush 131 and the charge removing effect on the transfer drum 11; the relation between the voltage applied either from the transfer drum's power source unit 124 or charge removing means' power source unit 128 and the charge removing effect on the transfer drum 11; and the relation between the amount of spacing between the roller type conductive brush 131 and transfer drum 11 and the charge removing effect on the transfer drum 11. The same can be said with the comb-shaped conductive brush 132.

Figure 27:
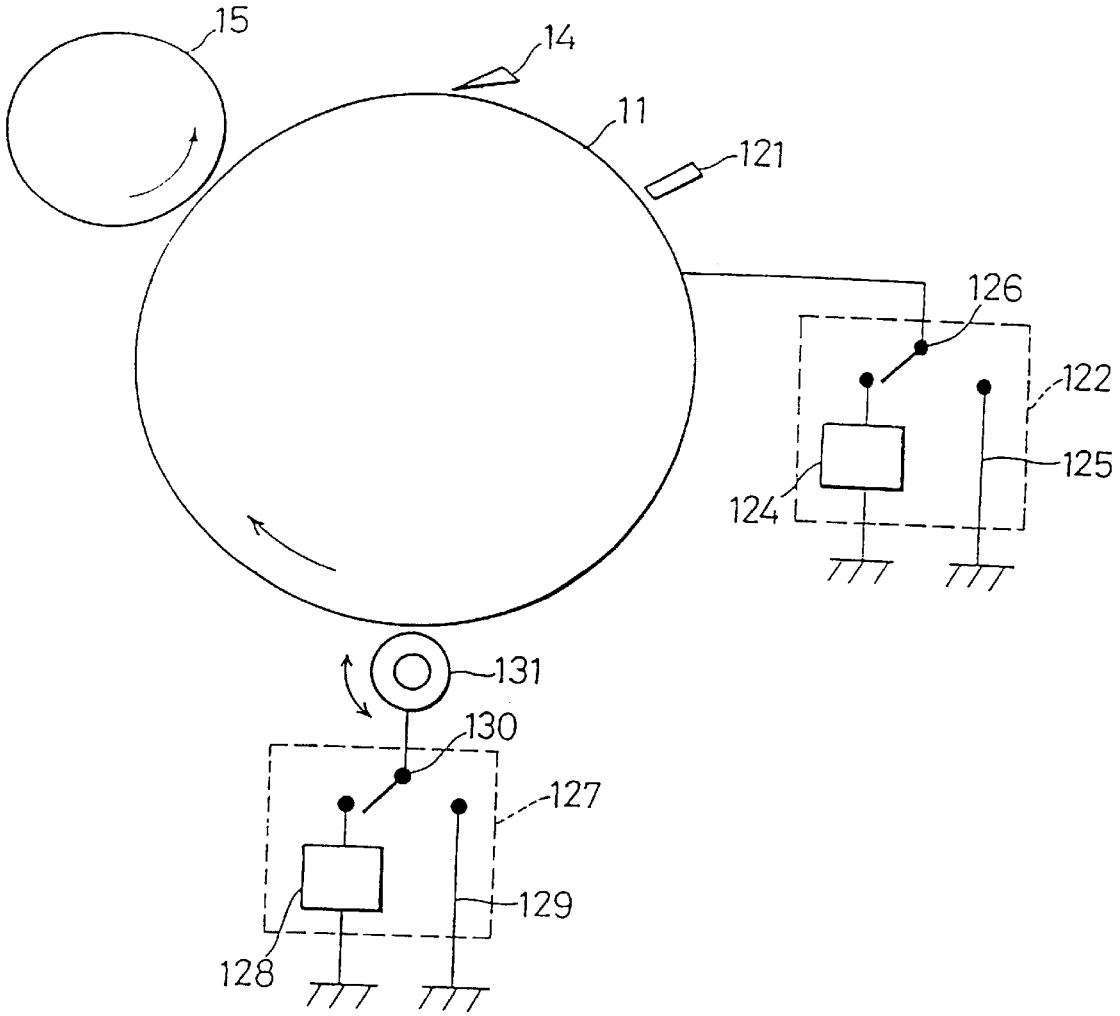
FIG. 27 is a schematic view showing another structure around a transfer drum shown in FIG. 26.
Figure 28:
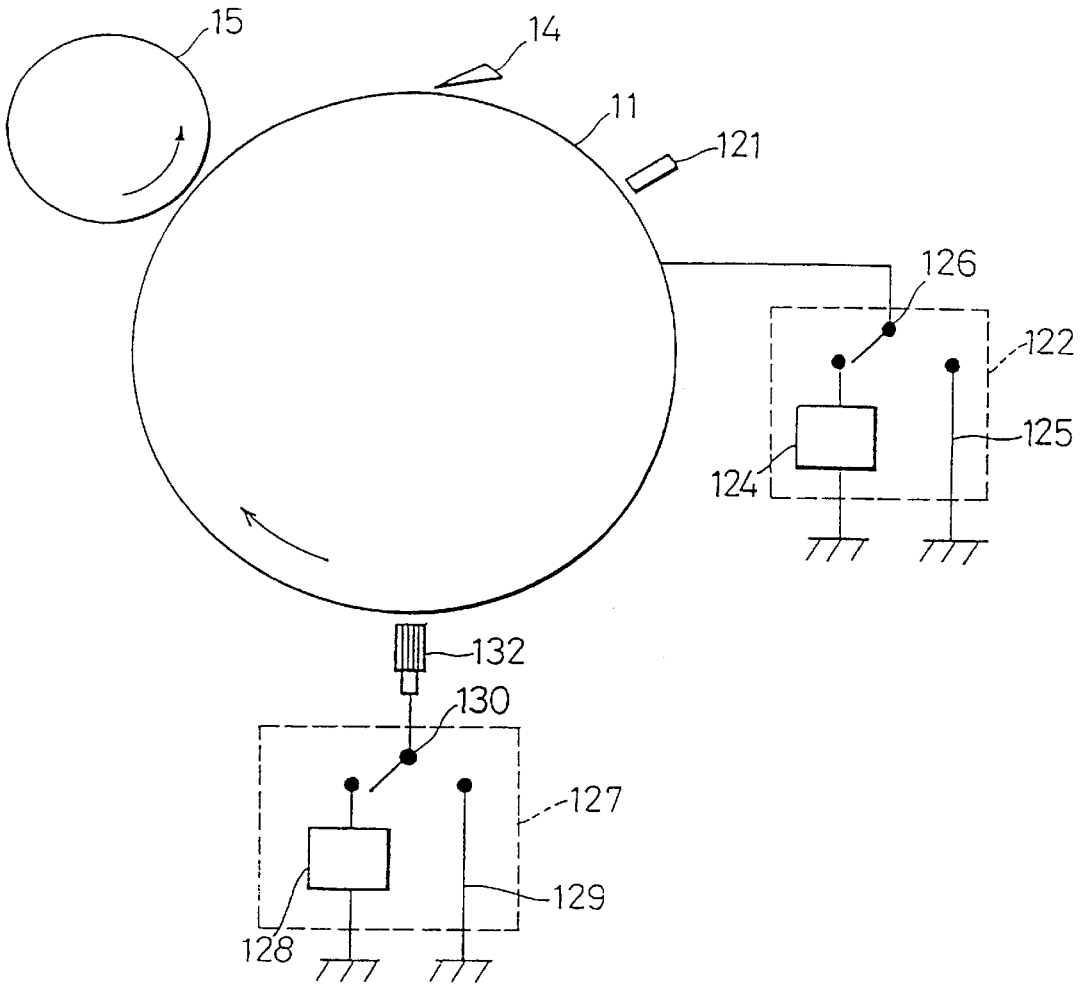
FIG. 28 is a schematic view showing still another structure around the transfer drum shown in FIG. 26.

The roller type conductive brush 131 rotates in the direction indicated by an arrow in FIG. 27 while being pressed against the transfer drum 11. Thus, the relation between the rate of the rotation speed of the roller type conductive brush 131 with respect to the transfer drum 11 and the charge removing effect on the transfer drum 11 is identical with the relation between the difference in the relative speed of the ground roller 123 with respect to the transfer drum 11 and the charge removing effect on the transfer drum 11.

Each of the roller type conductive brush 131 and comb-shaped conductive brush 132 presses their respective tips of the brushes against the transfer drum 11. Thus, the charge removing effect varies depending on the value of the brush resistance, and the relation between the value of the brush resistance and the charge removing effect on the transfer drum 1 is set forth in TABLE 34 below.

TABLE 34

| BRUSH RESISTANCE VALUE (kΩ) | 70 OR MORE | 60 | 50 | 40 | 35 | 20 | 10 | 5 OR LESS |
|---|---|---|---|---|---|---|---|---|
| CHARGE REMOVING EFFECT | X | Δ | Δ | ○ | ⊙ | ⊙ | ⊙ | ⊙ |

X: ALMOST NONE
Δ: POOR
○: FAIR
⊙: EXCELLENT

TABLE 34 reveals that the charge removing effect on the transfer drum 11 can be realized when the value of the brush resistance is 40 kΩ or less, and in particular, the charge removing effect is enhanced when the value of the brush resistance is 36 kΩ or less.

The charge removing effect also varies depending on the amount of brush making contact with the transfer drum 11, or namely, the brush density. The relation between the brush density of the roller type conductive brush 131 and the charge removing effect on the transfer drum 11 is set forth in TABLE 35 below, and the relation between the intervals between the brush groups called as the fur pitch of the comb-shaped conductive brush 132 and the charge removing effect on the transfer drum 11 is set forth in TABLE 36 below. The definition of the fur pitch was already given in the third embodiment.

TABLE 35

| Nos. OF BRUSH (ps/cm$^2$) | 3000 OR LESS | 5000 | 10000 | 15000 | 20000 | 25000 | 30000 OR MORE |
|---|---|---|---|---|---|---|---|
| CHARGE REMOVING EFFECT | X | Δ | Δ | ○ | ⊙ | ⊙ | ○ |

X: ALMOST NONE Δ: POOR ○: FAIR ⊙EXCELLENT

TABLE 36

| FUR PITCH (mm) | 6.0 OR MORE | 3.0 | 2.0 | 1.6 | 0.5 | 0.3 OR LESS |
|---|---|---|---|---|---|---|
| CHARGE REMOVING EFFECT | X | Δ | ○ | ⊙ | ⊙ | ⊙ |

X: ALMOST NONE Δ: POOR ○: FAIR ⊙: EXCELLENT

TABLE 35 reveals that the charge removing effect on the transfer drum 11 can be realized when the brush density of the roller type conductive brush 131 is 15000 pieces/cm$^2$ or more, and in particular, the charge removing effect is enhanced when the brush density is 20000 pieces/cm$^2$ or more. Also, TABLE 36 reveals that the charge removing effect on the transfer drum 11 can be realized when the fur pitch of the comb-shaped conductive brush 132 is 3.0 mm or less, and in particular, the charge removing effect is enhanced when the fur pitch is 1.6 mm or less.

As has been explained, the ground roller 123, roller type conductive brush 131, comb-shaped conductive brush 132, etc. serve as both the charge removing means and the attracting means. To remove the charges on the transfer drum 11 and attract the transfer paper P to the transfer drum 11 efficiently, these components are made of conductive members. Preferable conductive members are: a stainless fiber, a carbon fiber, a copper-dyed acrylic fiber, a conductive non-woven fabric, a conductive sheet, etc.

Since a single component serves as both the transfer drum's charge removing means and the attracting means for attracting the transfer paper P to the transfer drum 11, the image forming apparatus of the present embodiment demands fewer components, thereby making the image forming apparatus more compact and less expensive.

As has been explained, the ground roller 123, roller type conductive brush 131, and comb-shaped conductive brush 132 employed as the charge removing means for the transfer drum 11 in the fifth and sixth embodiments remove the charges on the transfer drum 11 when they are brought into contact with the transfer drum 11. Further, a pad type conductive brush may be used as the charge removing means. In this case, the amount of thrust of the brush into the transfer drum 11 and the like and the corresponding effects are identical with those in the case of the comb-shaped conductive brush 132.

In addition to the above methods where the conductive member is brought into contact with the transfer drum 11, there is another charge removing method employing charge removing means that does not touch the transfer drum 11, for example, an atmospheric discharge charger. Charge removing means for the transfer drum 11 employing an atmospheric discharge charger will be explained in the seventh embodiment.

[SEVENTH EMBODIMENT]

Still another embodiment of the present invention will be explained in the following while referring to FIGS. 29 and 30.

Figure 29:
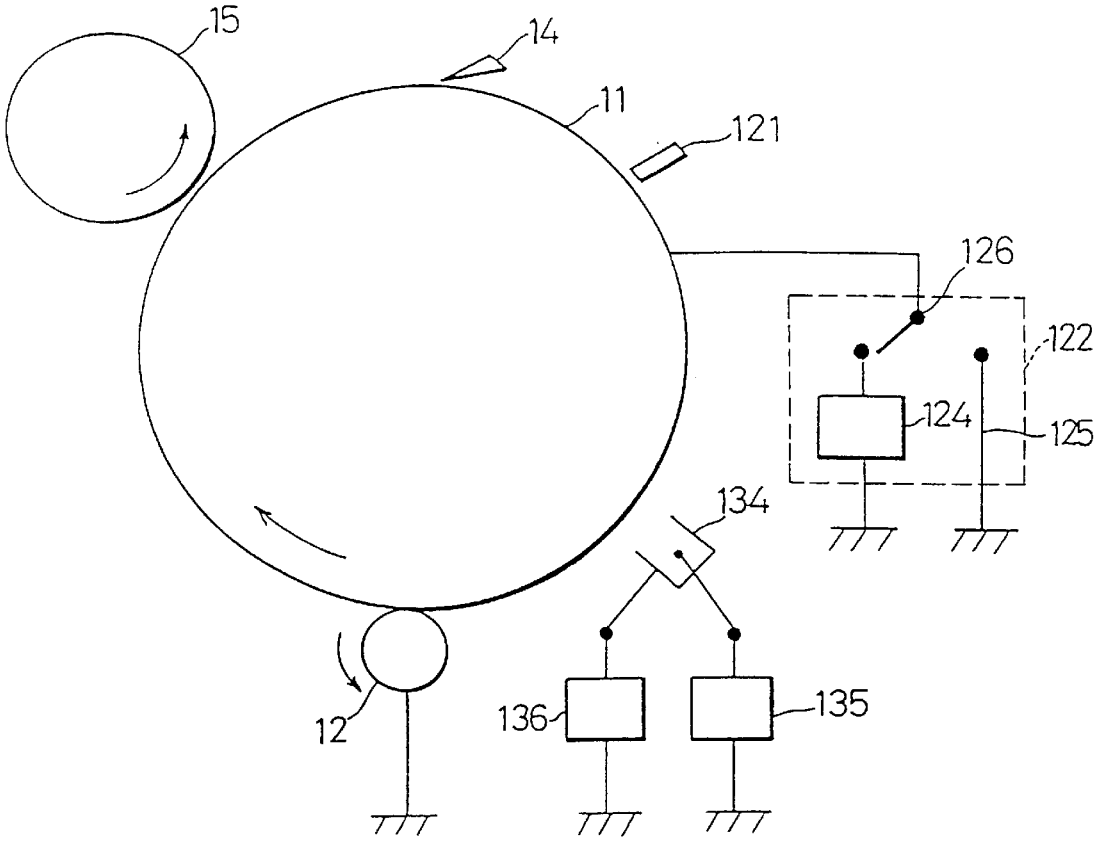
FIG. 29 is a schematic view showing a structure of an image forming apparatus in accordance with the seventh embodiment of the present invention.
Figure 30:
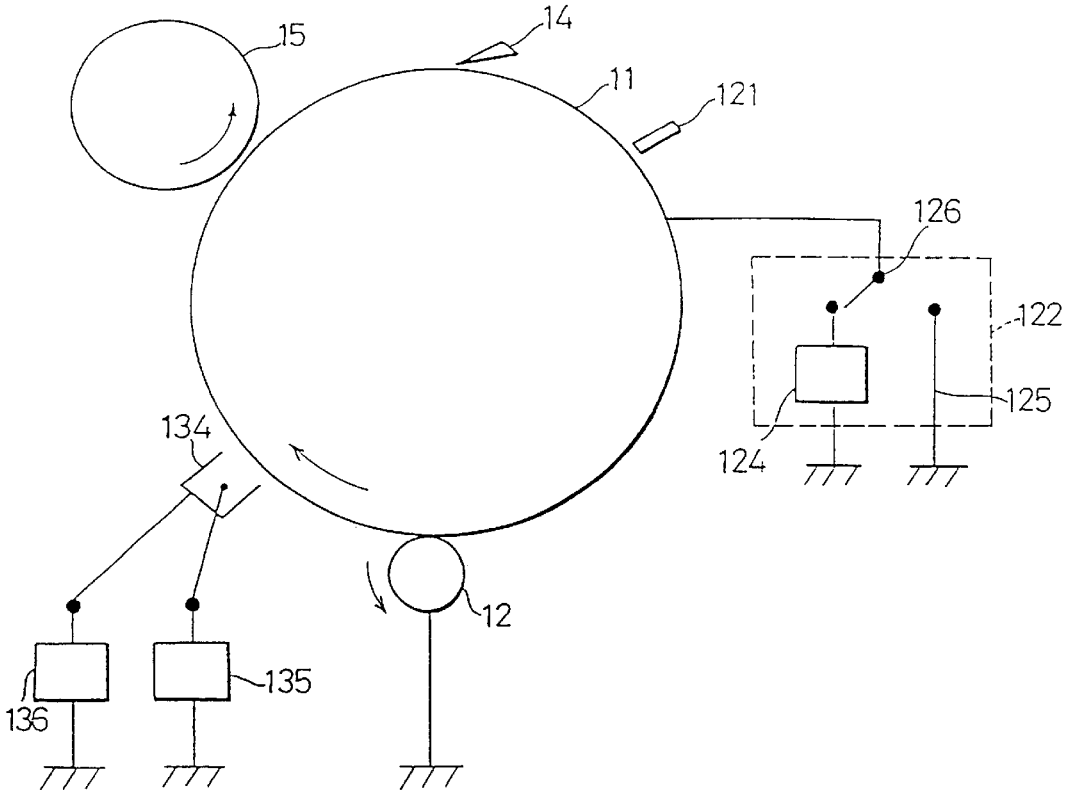
FIG. 30 is a schematic view showing another structure around a transfer drum shown in FIG. 29.

As shown in FIG. 29, an image forming apparatus of the present embodiment includes a corona charger 134 instead of the charge removing means such as the ground roller 123 used in the fifth and sixth embodiments.

The corona charger 134 is connected to a wire's voltage supplying device 135 and a grid's voltage supplying device 136, so that voltages are applied to the corona charger 134 respectively from the wire's voltage supplying device 135 and the grid's voltage supplying device 136 to charge the transfer drum 11. The corona charger 134 charges the transfer drum 11 in a polarity reversed to a current polarity of the transfer drum 11.

The cleaning operation and charge removing operation for the transfer drum 11 will be explained in the following.

The changeover switch 126 of the transfer's drum charge control device 122 switches the connection of the transfer drum 11 to the grounding conductor 125 from the transfer drum's power source unit 124 immediately after the transfer process ends and the transfer paper P is separated from the transfer drum 11 by the separating claw 14.

Subsequently, the cleaning blade 121 is pressed against the transfer drum 11 to scrape off the residual toner on the transfer drum 11. Note that the relation between the amount of the thrust of the cleaning blade 121 into the transfer drum 11 and the charge removing effect on the transfer drum 11 is the same as that of the fifth embodiment.

Then, at the moment when a point from which the cleaning blade 121 has started to scrape off the residual toner reaches a position opposing the corona charger 134, a voltage is applied to the corona charger 134 to start the charge removing operation.

In the charge removing operation, the connection of the transfer drum 11 is switched to the transfer drum's power source unit 124 by the changeover switch 126, so that a certain voltage is applied to the transfer drum 11, and at the same time, voltages are applied to the corona charger 134 from the wire's voltage supplying device 135 and grid's voltage supplying device 136. As a result, unwanted charges on the transfer drum 11 are removed.

As has been explained, the same charge removing effect on the transfer drum 11 as that realized in each of the above embodiments can be obtained when the corona charger 134 is used as the charge removing means.

In addition, since the corona charger 134 serving as the charge removing means for the transfer drum 11 does not touch the transfer drum 11 directly in the present embodiment, extra charges caused by the friction between the transfer drum 11 and charge removing means can be prevented. Also, since the corona charger 134 and transfer drum 11 are spaced apart, there will be no flaw on the surface of the transfer drum 11 by the charge removing means.

Note that the corona charger 134 is provided on an upstream side of the ground roller 12 in the present embodiment; however, the position of the corona charger 134 is not limited to the above. The corona charger 134 can be provided in any position in the vicinity of the transfer drum 11. For example, the corona charger 134 may be provided on a downstream side of the ground roller 12 as shown in FIG. 30. In this case, the corona charger 134 can apply a voltage to the transfer paper P transported from the ground roller 12 side in a polarity reversed to that of the voltage applied to the transfer drum 11. Thus, the corona charger 134 can serve as a secondary charger for the transfer paper P in case that the transfer paper P is not charged sufficiently, thereby making it possible to enhance the adhesion degree of the transfer paper P to the transfer drum 11.

As has been explained, according to the structure of the present embodiment, the charge removing means does not touch the transfer drum 11 so as to prevent the charge removing means from causing a flaw on the surface of the transfer drum 11. However, the charge removing means for the transfer drum 11 is made of a separate member in the above structure, thereby presenting a problem that the manufacturing costs increase. To eliminate this problem, an inexpensive image forming apparatus which can readily remove the charges on the transfer drum 11 without employing separate charger removing means will be explained in the eighth embodiment.

[EIGHTH EMBODIMENT]

Still another embodiment of the present invention will be explained in the following while referring to FIGS. 31 through 33.

Figure 31:
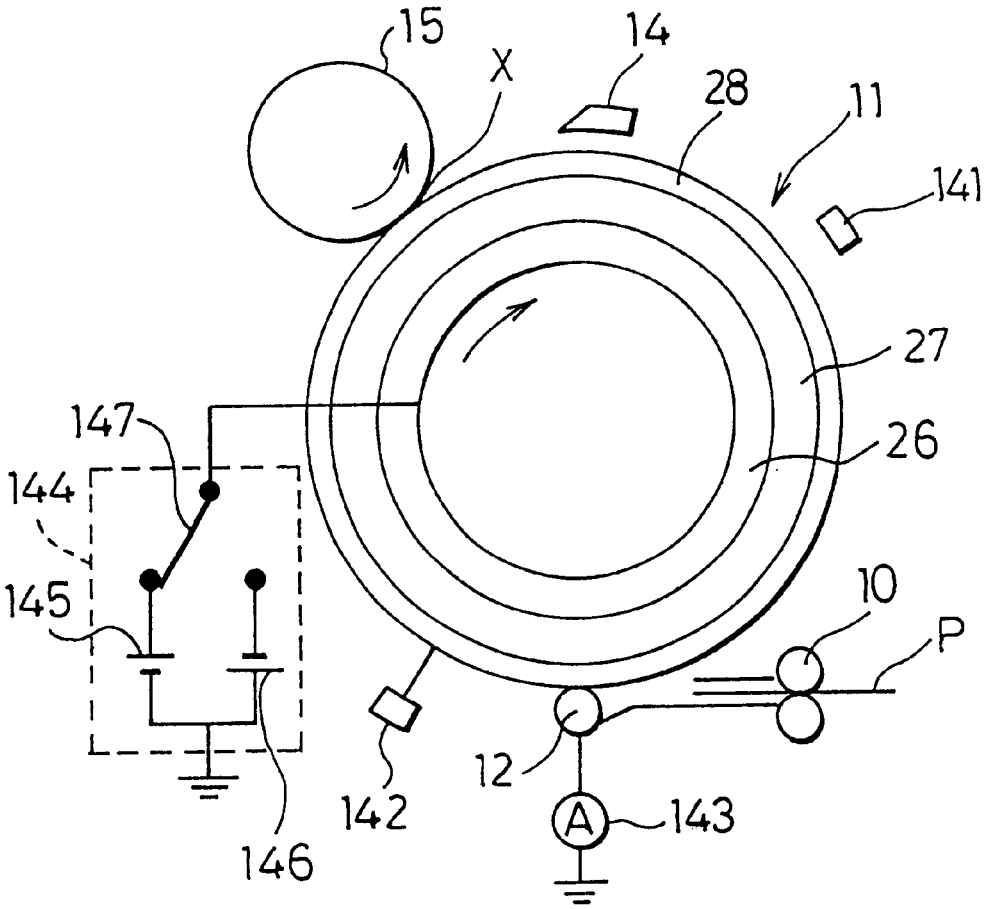
FIG. 31 is a schematic view showing a structure of an image forming apparatus in accordance with the eighth and ninth embodiments of the present invention.

As shown in FIG. 31, an image forming apparatus of the present embodiment includes the photosensitive drum 15, transfer drum 11, ground roller 12, etc; and a temperature and humidity sensor 141 for measuring the temperature and humidity around the transfer drum 11 and a surface potential electrometer 142 for measuring a surface potential of the transfer drum 11 are provided around the transfer drum 11.

The ground roller 12 is connected to an ammeter 143 for measuring a current flowing through the ground roller 12 when a voltage is applied to the transfer drum 11.

The conductive layer 26 forming the transfer drum 11 is connected to a voltage supplying device 144. The voltage supplying device 144 includes a charging-use power source unit 145 for charging the transfer drum 11, and a charge-removing-use power source unit 146 for removing the charges on the transfer drum 11. The connection of the transfer drum 11 is switched to the charging-use power source unit 145 from the charge-removing-use power source unit 146 and vice versa by a changeover switch 147.

The charging-use power source unit 145 and charge-removing-use power source unit 146 respectively apply voltages to the transfer drum 11 in polarities reversed to each other. In other words, a voltage is applied to the transfer drum 11 from the charging-use power source unit 145 during the transfer process, and another voltage is applied to the transfer drum 11 from the charge-removing-use power source unit 146 when the charges on the transfer drum 11 are being removed after the transfer process ends. The voltages are applied to the transfer drum 11 under the control of a control device 149 shown in FIG. 32.

The control device 149 is connected to a ROM 150, a RAM 151, and a charge removing voltage value computing unit 152. The ROM 150 serves as storage means for storing the value of a charge removing voltage to be applied to the transfer drum 11 in accordance with the temperature and humidity inside of the image forming apparatus. The RAM 151 serve as another storage means for temporarily storing measurement data from a measuring device such as the temperature and humidity sensor 141. The charge removing voltage value computing unit 152 serves as computing means for computing the value of a charge removing voltage based on the measurement data from the measuring device such as the temperature and humidity sensor 141.

More specifically, when the charges on the transfer drum 11 are removed, the control device 149 switches the changeover switch 147 to the charge-removing-use power source unit 146, and reads out a charge removing voltage value corresponding to the temperature and humidity inside of the image forming apparatus measured by the temperature and humidity sensor 141 from the ROM 150, so that a voltage having the same value as the readout value is applied to the transfer drum 11 from the charge-removing-use power source 146.

In general, the electric potential of the transfer drum 11 rises or falls unnecessarily in response to the temperature and humidity after the transfer process ends. To eliminate this, the values of charge removing voltages to be applied to eliminate such an unwanted electric potential at each level of the temperature and humidity are found and stored before the image forming apparatus is manufactured. Thus, when the user uses the image forming apparatus, the unwanted electric potential of the transfer drum 11 is eliminated by applying a voltage having the same value of the charge removing voltage for the current temperature and humidity stored in advance.

In the following, a job to find the value of a charge removing voltage for humidity H and temperature T when manufacturing the main body of the image forming apparatus will be explained while referring to FIG. 31 and the flowchart in FIG. 33. Note that the value of a charge removing voltage is found based on the measurement by the temperature and humidity sensor 141 provided around the transfer drum 11 as shown in FIG. 31.

To begin with, the temperature and humidity sensor 141 sets the temperature T to −20° C. (T=−20° C.) and the humidity H to 10% (H=10%) inside of the main body of the image forming apparatus (hereinafter referred to simply as the main body) (S11).

Then, the residual potential of the transfer drum 11 is measured by an unillustrated electrometer such as a surface potential probe (S12). The ground roller 12 is brought into contact with the transfer drum 11, and let stand until the transfer drum 11 becomes free of the residual potential (S13).

When the transfer drum 11 becomes free of the residual potential, the ground roller 12 is separated from the ground roller 12, so that the transfer drum 11 is charged at a certain electric potential by the charging-use power source unit 145 of the voltage supply device 144 (S14).

Then, an adequate voltage is applied to the transfer drum 11 from the charge-removing-use power source unit 146 of the voltage supplying device 144 in a polarity reversed to that of the voltage applied from the charging-use power source unit 145, and the transfer drum 11 is rotated once while the ground roller 12 is being brought into contact with the transfer drum 11 (S15).

Subsequently, the residual potential of the transfer drum 11 is measured (S16), and whether the absolute value of the residual potential is 50V or less is judged (S17). If the absolute value of the residual potential is 50V or less, the temperature T and humidity H inside of the main body at this point, and the value of the charge removing voltage applied from the charge-removing-use power source unit 146 are written into the ROM 150 of the control device 149. (S18); otherwise, the flow returns to S12.

Then, the humidity H inside of the main body is measured (S19), and whether the humidity H inside of the main body is 90% or not is judged (S20). If the humidity H is 90%, then the temperature T inside of the main body is measured (S21), and whether the temperature T inside of the main body is 40° C. or not is judged (S22). If the temperature T is 40° C., the job ends.

On the other hand, if the humidity H is not 90% in S20, then 5% is added to the measured humidity H, and the flow returns to S12 (S23). If the temperature T is not 40° C. in S22, then the humidity H is set to 10% and 5° C. is added to the measured temperature T, and the flow returns to S12 (S24).

The adequate applied voltage in the reversed polarity referred in S15 is a voltage higher than an initial discharge voltage found by Paschen's law and smaller than the charging voltage in an absolute value. In effect, a voltage is repeatedly applied to the transfer drum 11 in S17 while being changed by 50V from the initial voltage until the absolute value of the residual potential of the transfer drum 11 becomes 50V or less. The voltage is changed by 50V is because the threshold of the residual potential of the transfer drum 11 is ±50V or less.

An increase and a decrease in the temperature and humidity are set to the amounts specified in S23 and S24, respectively, so that there will be no significant change in the charged state of the transfer drum 11.

As has been explained, the temperature T and humidity H inside of the main body and the corresponding value of the charge removing voltage are found during the charge removing job for the transfer drum 11 performed when the main body is manufactured, and stored in the ROM 150 in advance.

Accordingly, when the user uses the main body, the control unit 149 performs the charge removing job for the transfer drum 11 based on the measured value from the temperature and humidity sensor 141 inside of the main body. To be more specific, the humidity H and temperature T inside of the main body are measured by the temperature and humidity sensor 141, then the value of a charge removing voltage corresponding to the measured humidity H and temperature T is read out from the ROM 150, and then the charge removing voltage is applied to the transfer drum 11. Subsequently, the transfer drum 11 is turned once while the ground roller 12 is being brought into contact with the transfer drum 11 to remove the charges on the transfer drum 11. Note that this charge removing job starts immediately after the transfer paper P is separated from the transfer drum 11 when the transfer process ends.

Thus, with the image forming apparatus of the present embodiment, the charges on the transfer drum 11 can be removed only by measuring the temperature and humidity inside of the main body. As a result, the charges on the transfer drum 11 can be removed stably, and hence the adhesion degree of the transfer paper P to the transfer drum 11 can be enhanced, thereby making it possible to transfer a toner image onto the transfer paper P in a stable manner without causing defects in the transferred toner image.

The value of the charge removing voltage to be applied to the transfer drum 11 is determined based on the temperature and humidity inside of the main body in the present embodiment. However, the value of the charge removing voltage can be determined by other methods. For example, the value of the charge removing voltage may be determined based on the value of a current flowing through the ground roller 12 during the charge removing job for the transfer drum 11, or the surface potential of the transfer drum 11 when the charge removing job starts, which will be explained in the ninth embodiment.

[NINTH EMBODIMENT]

Still another embodiment of the present invention will be explained in the following while referring to FIGS. 31, 32, and 34 through 36.

Figure 32:
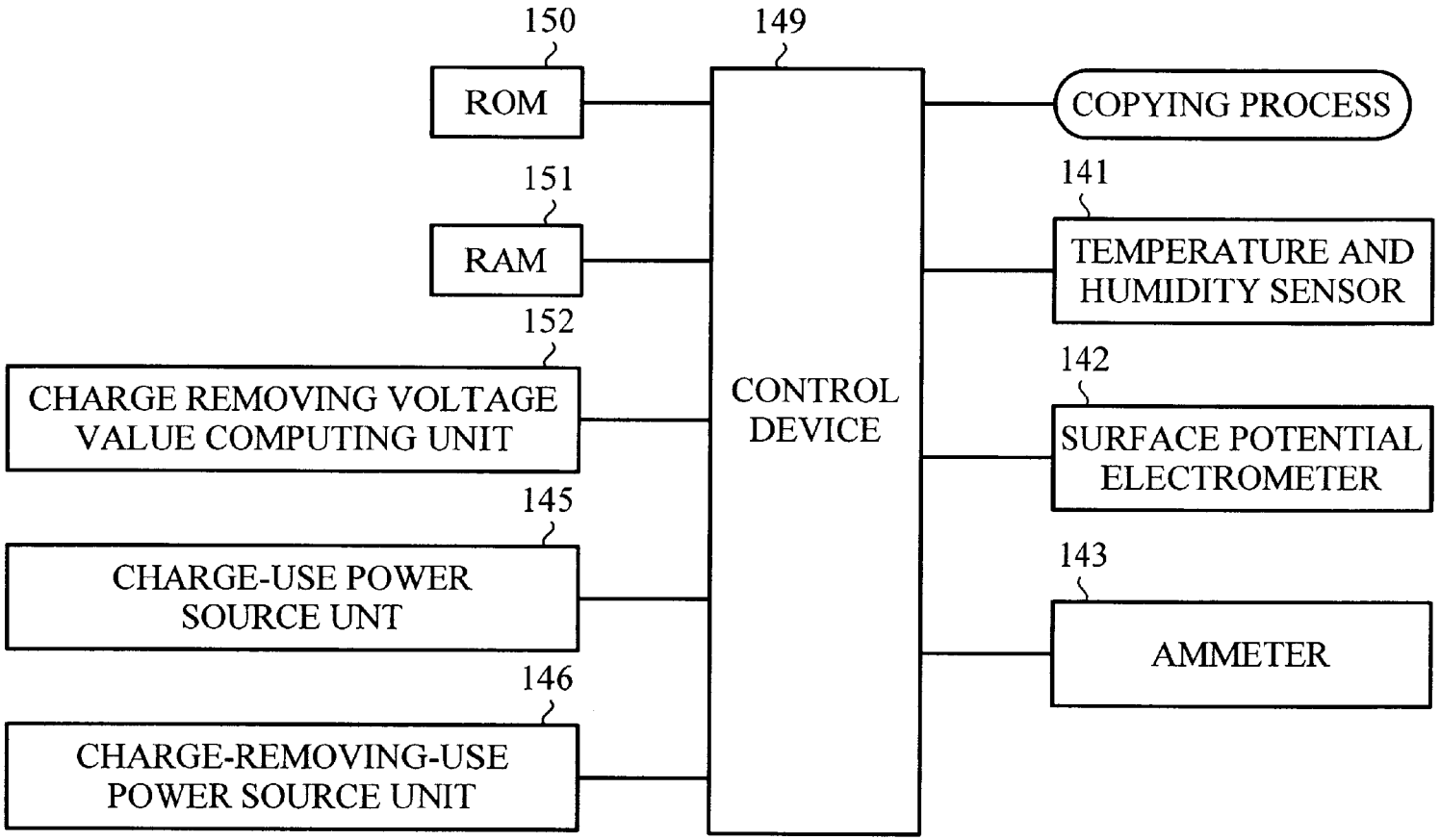
FIG. 32 is a block diagram of a control device installed in the above image forming apparatus.
Figure 33:
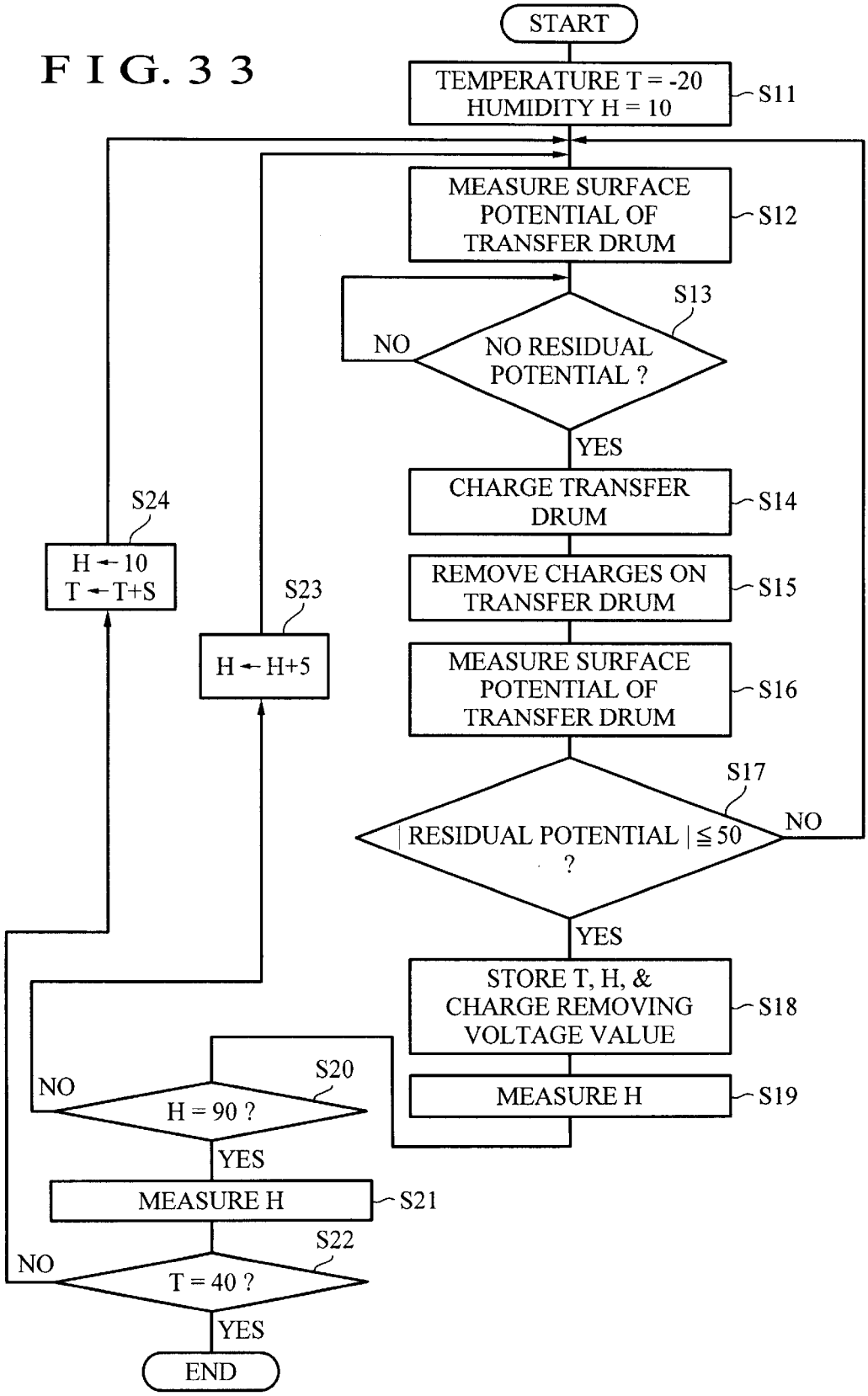
FIG. 33 is a flowchart detailing a charge removing job for a transfer drum shown in FIG. 31.

As shown in FIG. 32, the control device 149 is further connected to a charge removing voltage value computing unit 152 in an image forming apparatus of the present embodiment. The charge removing voltage value computing unit 152 computes the value of a charge removing voltage to be applied to the transfer drum 11 based on the value of the current flowing through the ground roller 12 measured by the ammeter 143.

The charge removing voltage value computing unit 152 performs a computation based on the value of a current flowing through the ground roller 12 when the charge removing voltage is applied to the transfer drum 11 while the ground roller 12 is brought into contact with the transfer drum 11 after the transfer process ends.

The value Ig of a current flowing through the ground roller 12 is in the same polarity as that of the charge removing voltage, and the larger the current value Ig, the fewer the remaining charges on the transfer drum 11. Thus, the value of a charge removing voltage is anti-proportional to the current value Ig. Also, according to Paschen's law, the charge removing effect can not be realized until a voltage over a certain value is applied.

In view of the foregoing, a value of a charge removing voltage $V_R$ to be applied to the transfer drum 11 is determined by Expression (1) below by the charge removing voltage value computing unit 152.

$$V_R=-a/Ig+b \tag{1}$$

where a is a positive coefficient determined by the charging/discharging characteristics of the dielectric layer 28 forming the transfer drum 11, and b is the initial charge removing voltage value in a polarity reversed to that of the charge removing voltage found by Paschen's law; the positive coefficient a is large when the dielectric layer 28 readily causes the remaining charges on the transfer drum 11.

To be more specific, let $a=2.0\times10^{-3}$, and $b=-1200$, then, given the current value $Ig=2.0\times10^{-6}$ (A), we get the charge removing voltage value $V_R=-1600$ (V), and given the current value $Ig=1.5\times10^{-5}$ (A), we get the charge removing voltage value $V_R=-1333$ (V).

Once the charge removing voltage $V_R$ is determined using Expression (1), the charge removing voltage $V_R$ is applied to the transfer drum 11. Subsequently, the transfer drum 11 is rotated once while the ground roller 12 is being brought into contact with the transfer drum 11 to remove the charges on the transfer drum 11. Note that the above charge removing job is performed immediately after the transfer paper P is separated from the transfer drum 11 when the transfer process ends.

The charge removing voltage value $V_R$ is determined based on the value of the current flowing through the ground roller 12 in the present embodiment. However, the charge removing voltage value $V_R$ may be determined based on the surface potential of the transfer drum 11 measured by the surface potential electrometer 142.

In this case, the charge removing voltage value computing unit 152 computes the value of a charge removing voltage to be applied to the transfer drum 11 based on the value of the surface potential of the transfer drum 11 measured by the surface potential electrometer 142.

In other words, the charge removing voltage value $V_R$ is directly proportional to a polarity reversed to that of the surface potential $V_S$ of the transfer drum 11 after the transfer process ends. Note that the charge removing effect can not be realized until a voltage over a certain value is applied according to Paschen's law.

In view of the foregoing, the charge removing voltage value $V_R$ to be applied to the transfer drum 11 can be determined by Expression (2) below by the charge removing voltage value computing unit 152.

$$V_R = V_S \times c + d \quad (2)$$

where c is a positive coefficient determined by the charging/discharging characteristics of the dielectric layer 28 forming the transfer drum 11, and d is the initial charge removing voltage value in a polarity reversed to that of the charge removing voltage found by Paschen's law; the positive coefficient c is large when the dielectric layer 28 readily causes the remaining charges on the transfer drum 11.

To be more specific, let c=0.8, and d=−1200, then, given the surface potential $V_S$=−500 (V), we get the charge removing voltage value $V_R$=−1600 (V), and given the surface potential $V_S$=−800 (V), we get the charge removing voltage value $V_R$=−1840 (V).

Once the charge removing voltage $V_R$ is determined using Expression (2), the charge removing voltage $V_R$ is applied to the transfer drum 11. Subsequently, the transfer drum 11 is rotated once while the ground roller 12 is being brought into contact with the transfer drum 11 to remove the charges on the transfer drum 11. Note that the above charge removing job is performed immediately after the transfer paper P is separated from the transfer drum 11 when the transfer process ends.

As has been explained, the charges on the transfer drum 11 are removed by determining the value of a charge removing voltage during the charge removing job based on either the value of a current flowing through the ground roller 12 or the surface potential of the transfer drum 11 in the present embodiment. As a result, the charges on the transfer drum 11 can be removed stably, and the adhesion degree of the transfer paper P to the transfer drum 11 can be enhanced, thereby making it possible to transfer a toner image onto the transfer paper P in a stable manner without causing defects in the transferred toner image.

The transfer drum 11 of the present embodiment is of a three-layer structure including the conductive layer 26, semi-conductive layer 27, and dielectric layer 28 as shown in FIG. 31. However, the structure of the transfer drum 11 is not limited to the above three-layer structure. The transfer drum 11 can be of any structure as long as the conductive layer 26 and dielectric layer 28 are placed at the inner most and outer most of the drum, respectively.

Figure 34:
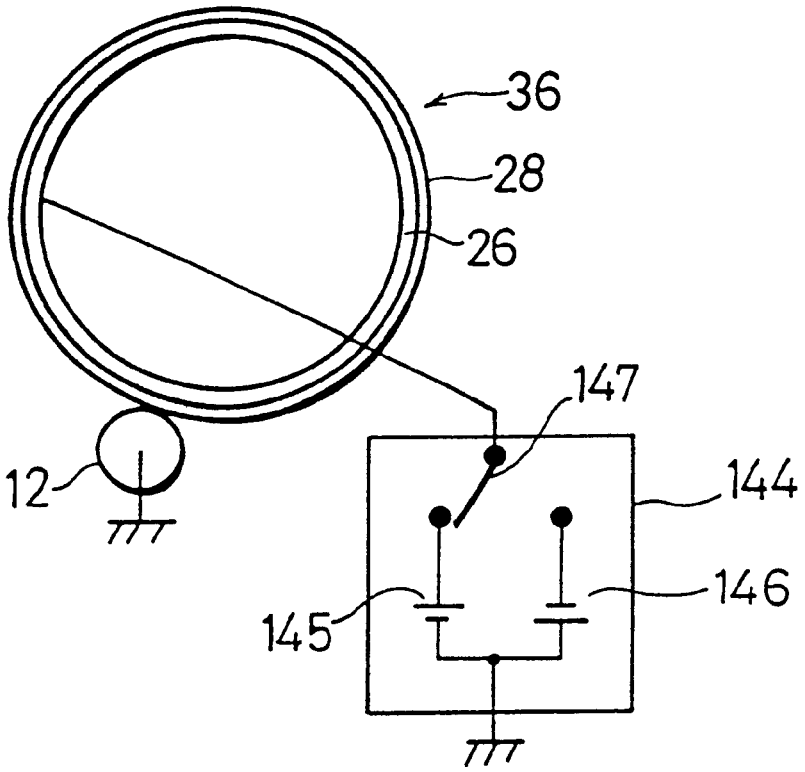
FIG. 34 is a schematic view showing another structure of the transfer drum shown in FIG. 31.

For example, a transfer drum 36 shown in FIG. 34 may be used instead of the transfer drum 11, which comprises the conductive layer 26 serving as the inner most layer and the dielectric layer 28 serving as the outer most layer. In this case, a voltage is applied to the conductive layer 26 by the voltage supplying device 144.

Figure 35:
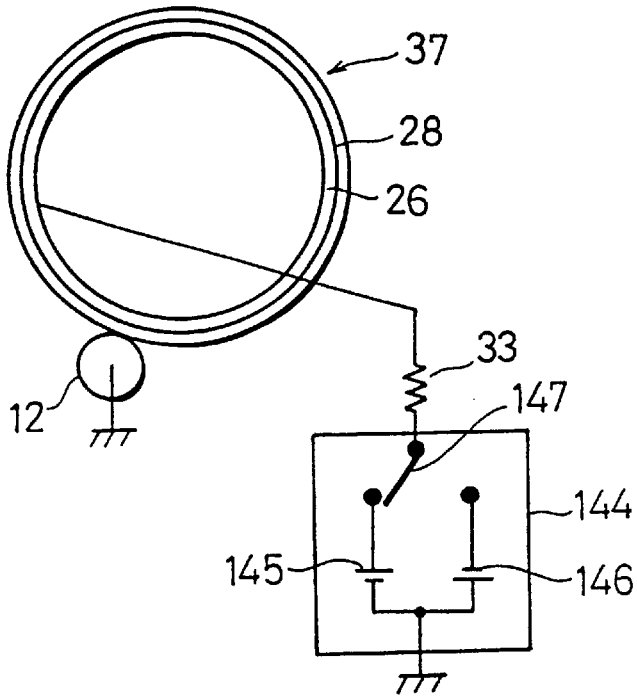
FIG. 35 is a schematic view showing still another structure of the transfer drum shown in FIG. 31.

Besides the transfer drum 36, a transfer drum 37 shown in FIG. 35 may be used, which comprises the conductive layer 26 serving as the inner most layer and the dielectric layer 28 serving as the outer most layer. The conductive layer 26 of the transfer drum 37 is connected to the power source unit 32 through a resistor 33. The resistor 33 has the same resistance value as that of the semi-conductive layer 27 of the above mentioned transfer drum 11. A voltage is applied to the conductive layer 26 from the voltage supplying unit 144 in this case also.

Figure 36:
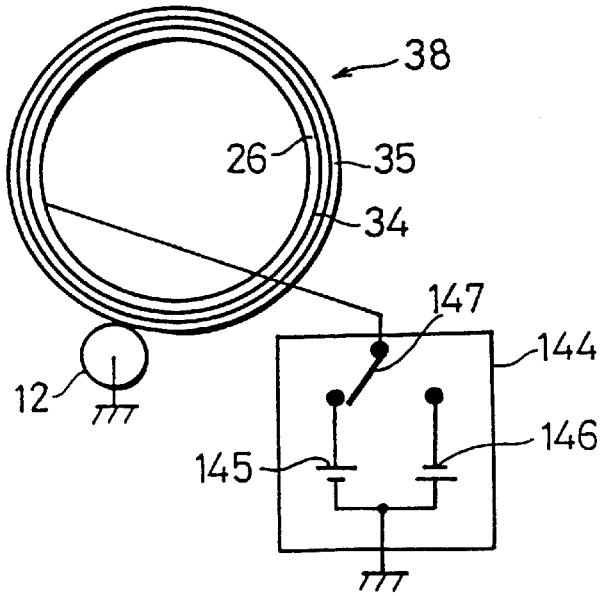
FIG. 36 is a schematic view showing still another structure of the transfer drum shown in FIG. 31.

Further, other than the above alternatives, a transfer drum 38 shown in FIG. 36 may be used. The transfer drum 38 comprises the conductive layer 26 serving as the inner most layer, and a two-layer film made of a semi-conductive film 34 (placed inner side) having substantially the same dielectric constant and resistance value as those of the semi-conductive layer 27 of the transfer drum 11 and a dielectric film 35 (placed outer side) having substantially the same dielectric constant and resistance value as those of the dielectric layer 28 of the transfer drum 11; the conductive layer 26 and the semi-conductive film 34 are layered from inward to outward in this order. A voltage is applied to the conductive layer 26 from the voltage supplying device 144 in this case also.

Further, the charges on the transfer drum 11 are removed by applying a charge removing voltage corresponding to the amount of the residual charges on the transfer drum 11 in the present embodiment.

Incidentally, the adhesion of the transfer paper P to the transfer drum 11 and the transfer of a toner image are assumed to be affected considerably by the dielectric constant and resistance value of the dielectric layer 28 in the transfer drum 11, and the adhesion among the conductive layer 26, semi-conductive layer 27, and dielectric layer 28. Thus, the manufacturing method of the transfer drum 11, in which the conductive layer 26, semi-conductive layer 27, and dielectric layer 28 adhere to each other in an improved manner, will be explained in the tenth embodiment.

[TENTH EMBODIMENT]

Still another embodiment of the present invention will be explained in the following while referring to FIGS. 37 through 43.

Figure 37:
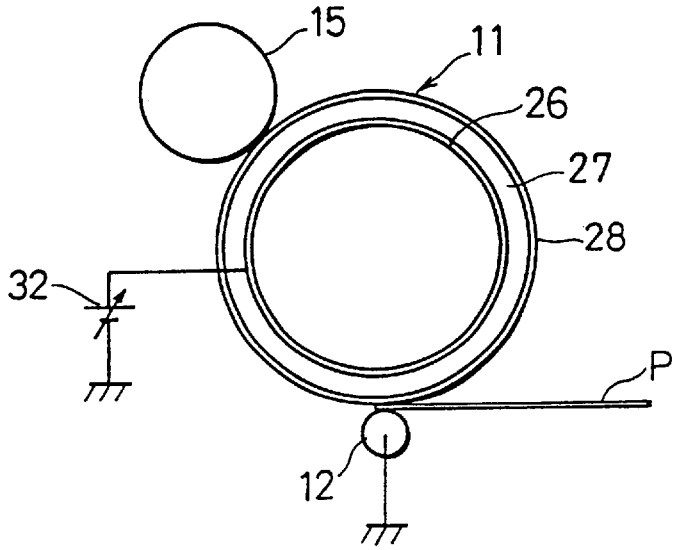
FIG. 37 is a schematic view showing a structure of an image forming apparatus in accordance with the tenth embodiment of the present invention.

As shown in FIG. 37, an image forming apparatus of the present embodiment includes the transfer drum 11 like the counterpart in each of the above embodiments. The transfer drum 11 comprises the (cylindrical) conductive layer 26 made of a conductive metal layer, semi-conductive layer 27, and dielectric layer 28. The conductive layer 26 is connected to the power source unit 32, so that a charging voltage or charge removing voltage is applied to the conductive layer 26. The semi-conductive layer 27 is made of a semi-conductive material such as urethane and silicon. When the semi-conductive layer 27 is made of urethane foam, urethane is directly placed on the conductive layer 26 through foaming. As a result, the adhesion between the conductive layer 26 and semi-conductive layer 27 is enhanced, and the transfer drum 11 can attract the transfer paper P and transfer a toner image onto the transfer paper P more efficiently.

For example, the semi-conductive layer 27 made of urethane is fixed on the conductive layer 26 by:

(1) heating a bead-shape raw material to trigger a primary blowing, (2) letting the heated material to stand, then curing and drying for an adequate period;

(3) filling the material in a metal mold made of the conductive layer 26; and (4) heating the material again to fill the spaces within the particles through a secondary blowing to form the mold through anastomosis.

The blow molding of the semi-conductive layer 27 is not limited to the above and the semi-conductive layer 27 may be molded through the blowing in other methods.

Also, when the semi-conductive layer 27 is made of silicon rubber, silicon rubber can be directly molded on the conductive layer 26. As a result, the adhesion between the conductive layer 26 and semi-conductive layer 27 can be enhanced, and the transfer drum 11 can attract the transfer paper P and transfer a toner image onto the transfer paper P more efficiently.

To mold silicon rubber on the conductive layer 26 while saving the manufacturing costs, a rubber sheet is wound around the semi-conductive layer 26 first, and then done with compression molding vulcanization. However, the molding method is not limited to the above, and the semi-conductive layer 27 can be molded by the other methods.

The dielectric layer 28 is formed on the semi-conductive layer 27 after the semi-conductive layer 27 is formed on the conductive layer 26. The dielectric layer 28 is made of a dielectric material such as PVDF (polyvinylidene fluoride). When the dielectric layer 28 is made of PVDF, the dielectric layer 28 is made into a seamless cylindrical thin film sheet to be fixed to the semi-conductive layer 27.

Figure 38:
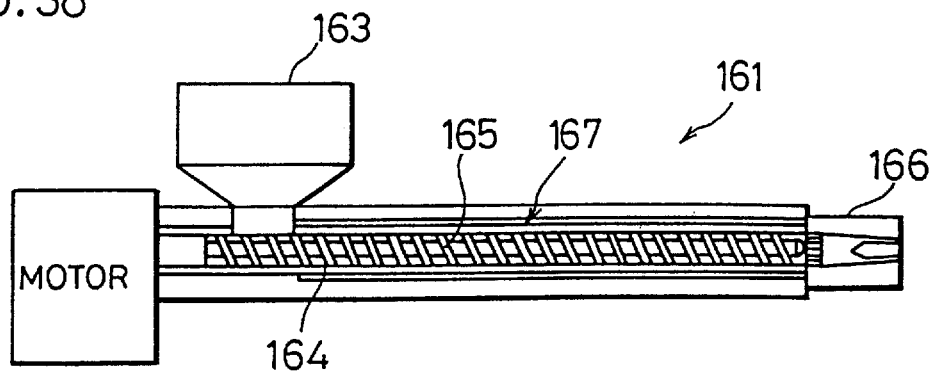
FIG. 38 is a schematic view showing a structure of an extruding machine used in a process of manufacturing a transfer drum shown in FIG. 37.

The manufacturing method of the seamless cylindrical thin film sheet made of PVDF will be explained in the following while referring to FIGS. 38 through 40. FIG. 38 shows a typical extruding machine 161 which heats a raw material and squeezes out the heated material, while FIG. 40 shows a receiving machine 162 which receives the raw material squeezed out from the extruding machine 161 and cuts the same into a certain size.

To begin with, a raw material of PVDF is supplied into a raw material hopper 163 in the extruding machine 161, and the raw material is supplied to a cylinder 164 from the raw material hopper 163.

The raw material supplied into the cylinder 164 is transported to a die unit 166 having a circular opening by a screw 165 provided in the cylinder 164. At this point, the raw material is heated in the cylinder 164 by a heating-cooling unit 167 to be plasticized. The shape and thickness of the raw material thus plasticized are determined by the die unit 166.

Figure 39:
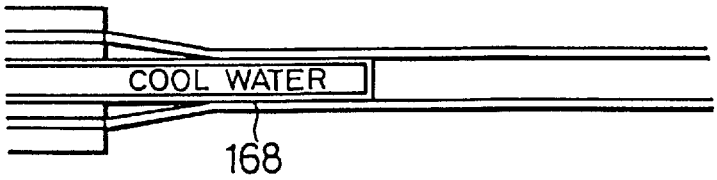
FIG. 39 is a view explaining the process of manufacturing the transfer drum shown in FIG. 37.
Figure 40:
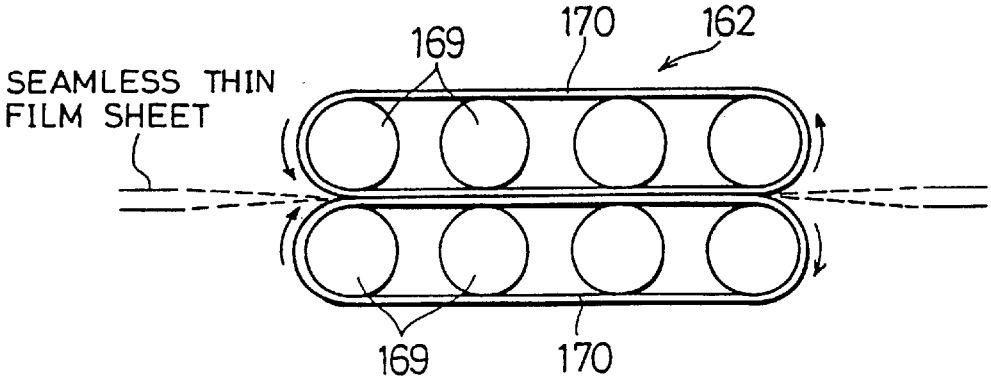
FIG. 40 is a schematic view showing a structure of a receiving machine used in the process of manufacturing the transfer drum shown in FIG. 37.

As shown in FIG. 39, the die unit 166 limits the shape and specification of the raw material plasticized by a cooling unit 168 in the heating-cooling unit 167, which is known as sizing.

The raw material squeezed out through the circular opening of the die unit 166 is received by the receiving machine 162 shown in FIG. 40 and cut into a certain size. As shown in FIG. 40, the receiving machine 162 used in the present embodiment comprises a pair of rubber belts 170 each including a plurality of nip rolls 169. The receiving machine 162 receives the raw material in a section between the two rubber belts 170 and cuts the raw material into a certain size.

According to the above manufacturing method, the raw material is squeezed out through the circular opening of the die unit 166 and received to be made into a cylindrical seamless thin film sheet.

The cylindrical seamless thin film sheet of PVDF is fixed onto the semi-conductive layer 27 through thermal contraction. The thermal contraction is a mechanism wherein a molecular anisotropic, which is formed through a change in structure caused by the deformation of a thermo-melt polar change polymer, tries to restore to its original orientation when heated again. The thermal contraction includes a dry method and a wet method. The dry method is advantageous in that the changes in physical properties of PVDF such as the resistance value and dielectric constant are rather small. In other words, if the dielectric layer 28 is made of PVDF, the transfer paper P can adhere to the transfer drum 11 and a toner image can be transferred onto the transfer paper P in a more stable manner when the dielectric layer 28 is adhered to the semi-conductive layer 27 through thermal contraction by the dry method.

Thus, when the dielectric layer 28 is a cylindrical seamless thin film sheet of PVDF, the dielectric layer 28 can adhere to the semi-conductive layer 27 through thermal contraction as has been explained in the above, which upgrades the adhesion of the transfer paper P to the transfer drum 11 and makes the toner image transfer highly efficient even when a number of copies are made.

Embossing finish may be applied to the dielectric layer 28 as a method for adhering the semi-conductive layer 27 and dielectric layer 28 to enhance the charging and discharging characteristics of the dielectric layer 28. Embossing finish is the finish to form the projections and depressions of a few microns on the surface of a sheet almost at regular intervals. The embossing finish is usually applied to a sheet by sandwiching the sheet by a pair of rollers having the projections and depressions on the surfaces thereof.

Figure 41:
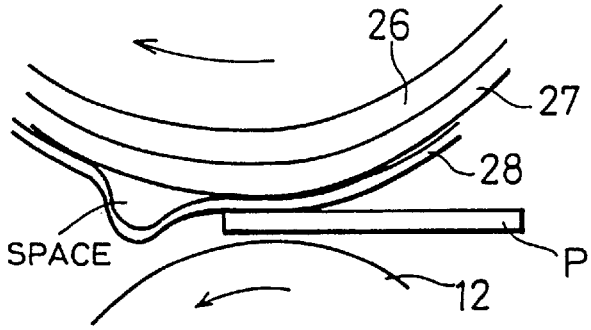
FIG. 41 is a view explaining a degree of adhesion between a dielectric layer and a semi-conductive layer of the transfer drum shown in FIG. 37 when the embossing finish is not applied to the dielectric layer.

In general, the dielectric layer 28 with the non-embossed surface causes smaller friction when brought into contact with the semi-conductive layer 27. Thus, as shown in FIG. 41, the semi-conductive layer 27 contracts when the ground roller 12 is pressed against the dielectric layer 28, and a space develops between the semi-conductive layer 27 and dielectric layer 28, thereby separating the semi-conductive layer 27 and dielectric layer 28. As a result, the transfer drum 11 can not attract the transfer paper P stably and hence the surface of the transfer paper P can not be charged uniformly.

Figure 42:
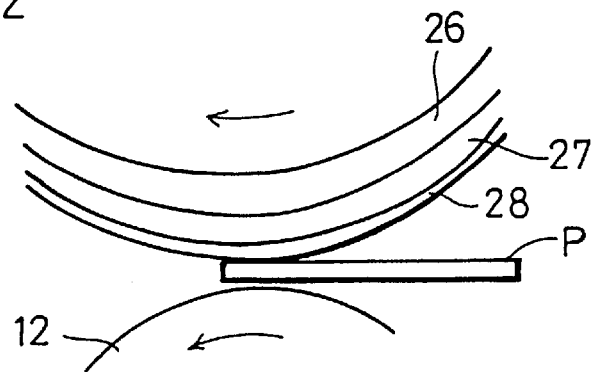
FIG. 42 is a view explaining a degree of adhesion between the dielectric layer and semi-conductive layer of the transfer drum shown in FIG. 37 when the embossing finish is applied to the dielectric layer.

On the other hand, the dielectric layer 28 with the embossed surface causes rather large friction when brought into contact with the semi-conductive layer 27. Thus, as shown in FIG. 42, the semi-conductive layer 27 and dielectric layer 28 keep contact with each other even when the semi-conductive layer 27 contracts as the ground roller 12 is pressed against the dielectric layer 28. Accordingly, no space will be developed between the semi-conductive layer 27 and dielectric layer 28, and hence, the adhesion between the semi-conductive layer 27 and dielectric layer 28 can be maintained. As a result, the transfer drum 11 can attract the transfer paper P stably, and accordingly, the surface of the transfer paper P can be charged uniformly.

The relation between the difference of elevation of the projections and depressions formed on the surface of the dielectric layer 28 as the result of embossing finish and the adhesion effect on the transfer paper P to the transfer drum 11 is set forth in TABLE 37.

TABLE 37

| DIFFERENCE OF ELEVATION (μm) | 0.0 | 4.0 | 10.0 | 15.0 | 20.0 OR MORE |
|---|---|---|---|---|---|
| ADHESION EFFECT | X | ⊙ | ⊙ | ○ | ○ |

X: ALMOST NONE Δ: POOR ○: FAIR ⊙: EXCELLENT

TABLE 37 reveals that the adhesion effect on the transfer paper P to the transfer drum 11 can be realized when the difference of elevation of the projections and depressions as the result of the embossing finish is 4.0 μm or more, and in particular, the adhesion effect is enhanced when the difference of elevation is in a range between 4.0 μm and 10.0 μm.

Thus, the projections and depressions formed on the surface of the dielectric layer 28 as the result of the embossing finish improve not only the adhesion between the dielectric layer 28 and semi-conductive layer 27, but also the charging and discharging characteristics of the dielectric layer 28. When the dielectric layer 28 is made of urethane foam, the adhesion to the semi-conductive layer 27 and the charging characteristics of the dielectric layer 28 can be improved further.

Alternatively, a single thin film sheet made of the semi-conductive layer 27 and dielectric layer 28, or namely, a one-piece two-layer polymer film sheet (one-piece sheet), may be used as a method for adhering the semi-conductive layer 27 to the dielectric layer 28. In the following, a manufacturing method of the one-piece two-layer polymer film sheet and a method for fixing the one-piece two-layer polymer film to the conductive layer 26 through the thermal contraction will be explained.

Figure 43:
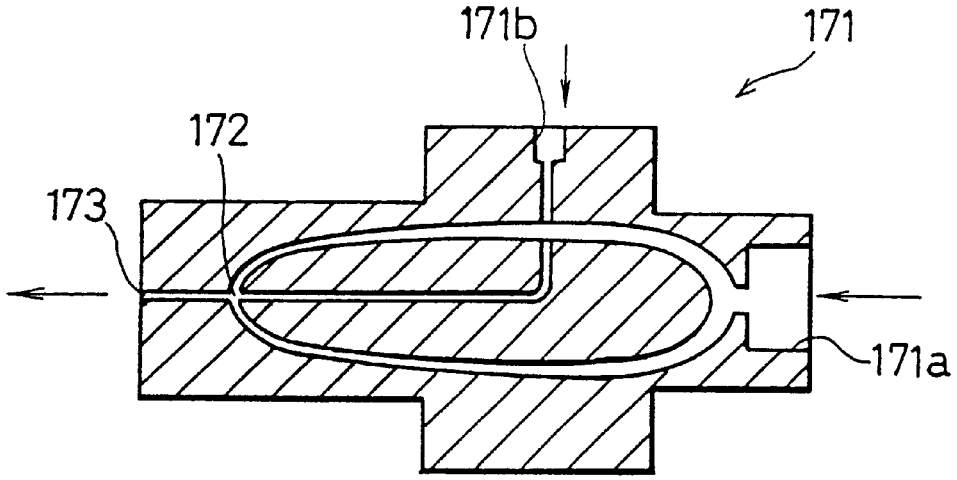
FIG. 43 is a cross sectional view of a metal mold used in another method for manufacturing the transfer drum shown in FIG. 37.

As shown in FIG. 43, the one-piece two-layer polymer film sheet is made by a molding machine 171 of a two-layer die structure.

The molding machine 171 is of the two-layer die structure comprising a dielectric layer's die 171*a* provided on the side of the molding machine 171 and a semi-conductive layer's die 171*b* provided on the top of the molding machine 171. Raw materials are press-fit through each die to merge at a confluence 172 of the two dies, and squeezed out through a common ejection opening 173 in the form of a two-layer film.

To be more specific, a resin for the outer layer forming the dielectric layer 28 is press-fit into the dielectric layer's die 171*a* by an unillustrated extruding machine. At the same time, another resin for the internal surface coating film forming the semi-conductive layer 27 is press-fit into the semi-conductive layer's die 171*b*, which passes by a spidal die through a spider. The resins are press-fit into each of the dies 171*a*•171*b* in this way to merge at the confluence of the two dies 171*a*•171*b*, and squeezed out through the ejection opening 173 in the form of a two-layer film, that is, one-piece two-layer polymer film sheet.

The sheet thus squeezed out is cooled to be hardened by the air sizing method or wet vacuum sizing method.

The dielectric constant and resistance value of the one-piece two-layer film sheet thus formed can be easily set to any desired value. Thus, the one-piece two-layer polymer sheet can have the same dielectric constants and resistance values as those of the dielectric layer 28 and semi-conductive layer 27 when they are formed separately. This means that the one-piece two-layer polymer sheet retains the same characteristics including the charging efficiency as those retained when the dielectric layer 28 and semi-conductive layer 27 are formed separately.

The one-piece two-layer polymer sheet thus made is fixed onto the conductive layer 26 through the thermal contraction, which has been explained in the above.

As has been explained, the charging efficiency and charge removing efficiency can be upgraded by adhering the semi-conductive layer 27 and dielectric layer 28 to each other. As a result, the adhesion degree of the transfer paper P to the transfer drum 11 can be improved while a toner image can be transferred onto the transfer paper P satisfactorily.

In the first through tenth embodiments, attention was focused on the transfer drum 11, and explained therein were the adhesion effect on the transfer paper P to the transfer drum 11, charge removing effect, and charging effect realized by controlling the voltage applied to the transfer drum 11 or the like. The eleventh embodiment discusses the adverse effect on the transfer drum 11 resulted from the charges on the photosensitive drum 15.

[ELEVENTH EMBODIMENT]

Still another embodiment of the present invention will be explained in the following while referring to FIGS. 44 and 45.

Figure 44:
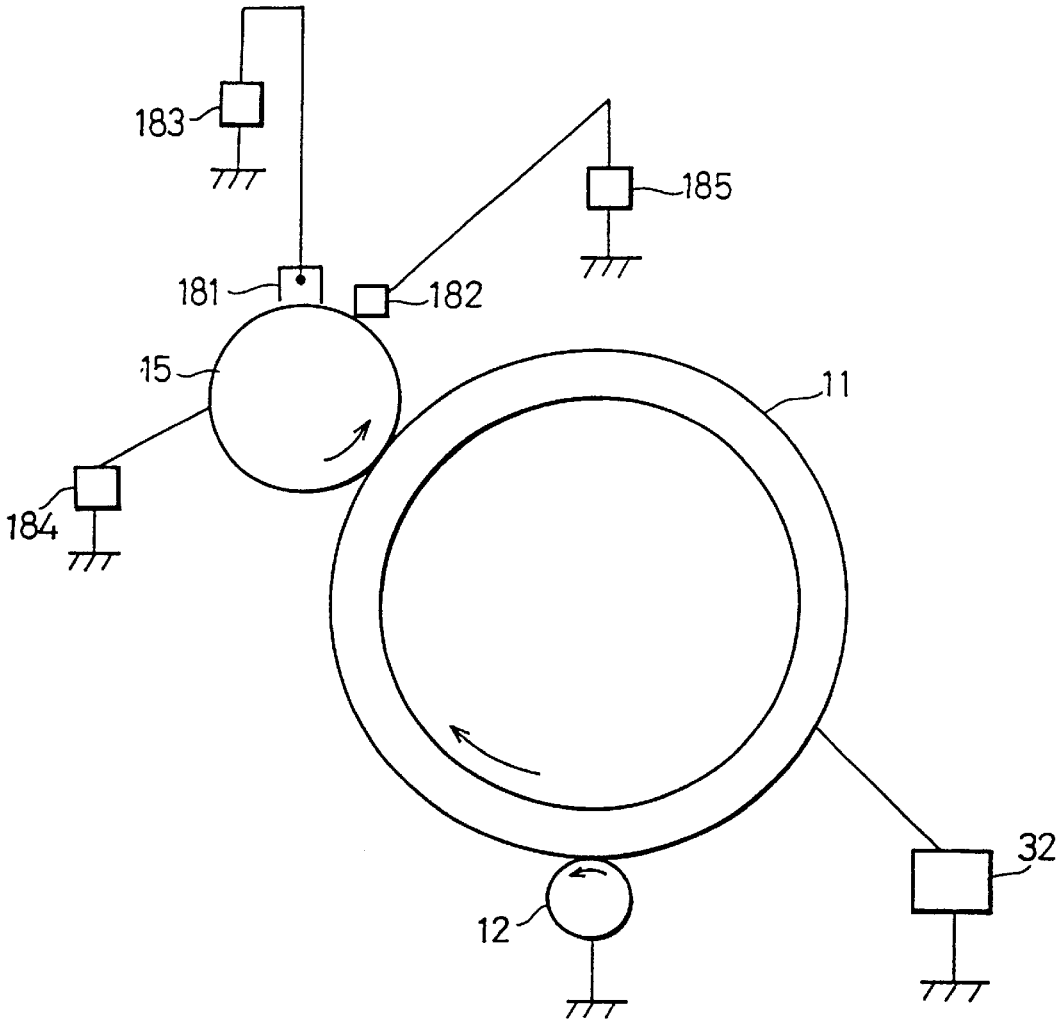
FIG. 44 is a schematic view showing a structure of an image forming apparatus in accordance with the eleventh embodiment of the present invention.
Figure 45:
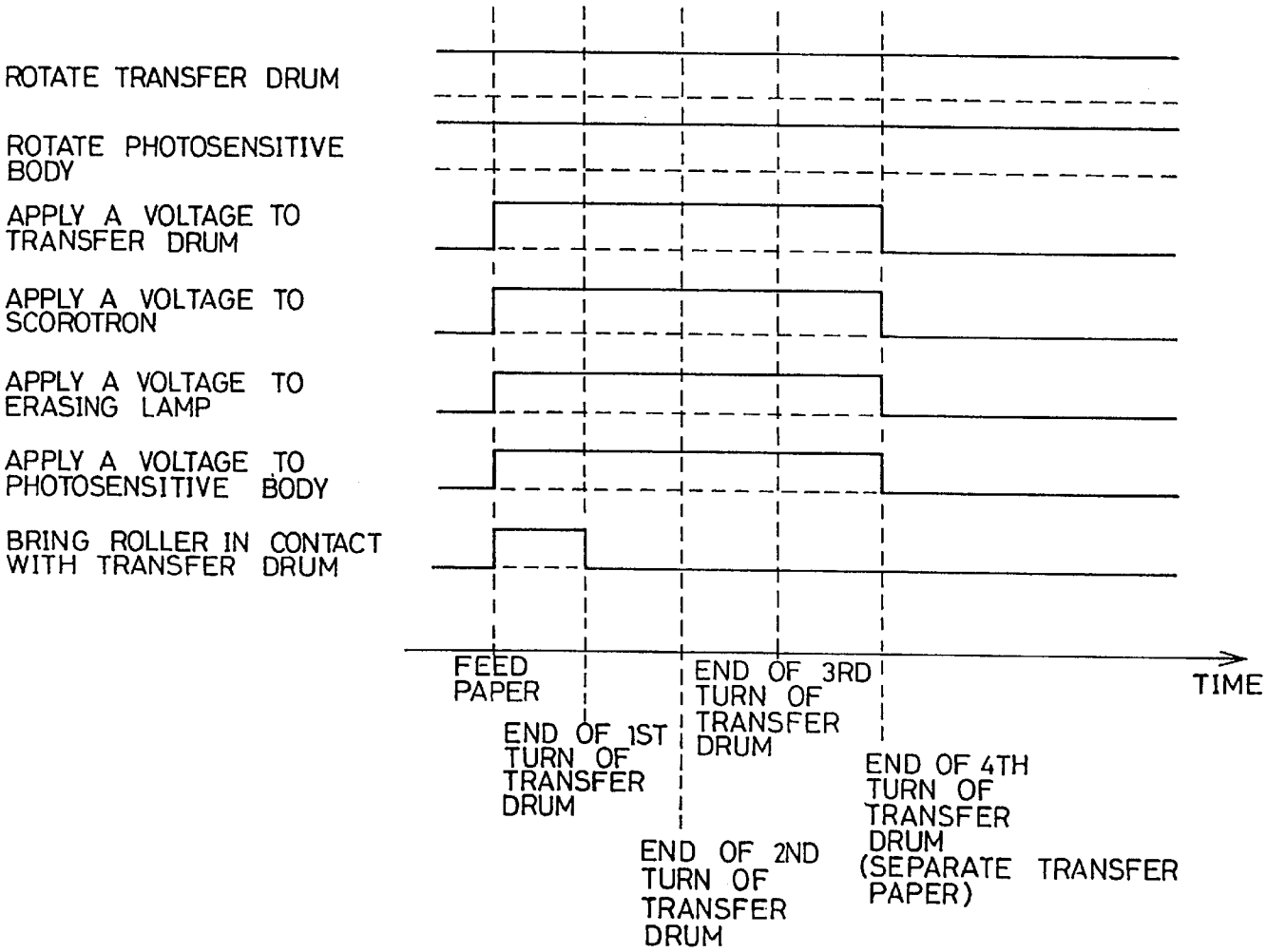
FIG. 45 is a timing chart showing the timing of operation of each component of the image forming apparatus shown in FIG. 44.

As shown in FIG. 44, an image forming apparatus of the present embodiment includes the photosensitive drum 15, power source unit 32, ground roller 12 around the transfer drum 11.

A scorotron 181 and an erasing lamp 182 are provided around the photosensitive drum 15. The scorotron 181 serving as charging means charges the surface of the photosensitive drum 15 uniformly, and the erasing lamp 182, which is provided between the transfer point X and scorotron 181, removes the charges on the surface of the photosensitive drum 15 or serves as charge amount control means for controlling the amount of charges on the surface of the photosensitive drum 15.

The scorotron 181, photosensitive drum 15, erasing lamp 182 are connected to their respective voltage applying means: a scorotron's power source unit 183, photosensitive drum's power source unit 184, and an erasing lamp's power source unit 185.

The photosensitive drum's power source unit 184 applies a voltage to the internal of the photosensitive drum 15 in a polarity reversed to that of the voltage of the scorotron's power source unit 183, so that the surface of the photosensitive drum 15 is charged in a stable manner by the scorotron 181.

The erasing lamp 182 removes the negative charges remaining on the photosensitive drum 15, and controls the surface potential of the photosensitive drum 15 by controlling a voltage of the erasing lamp's power source unit 185.

A process for removing the charges on the photosensitive drum 15 in the above-structured image forming apparatus will be explained while referring to FIGS. 44 and 45. Note that each member forming the image forming apparatus—the transfer drum 11, ground roller 12, photosensitive drum 15, scorotron's power source unit 183, and erasing lamp's power source unit 185—operate at the timing based on the time chart shown in FIG. 45. The image forming apparatus also performs the process of the toner-image transfer explained in the first embodiment while referring to FIGS. 6 and 7. Thus, the photosensitive drum 15 and transfer drums 11 are positively charged by the scorotron 181 and power source unit 32, respectively.

Each member forming the image forming apparatus is driven under the control of the control device 149 shown in FIG. 32. Assume that the image forming apparatus is to make a full color copy in the explanation below.

To begin with, the transfer drum 11 and photosensitive drum 15 are rotated. The rotation of the transfer drum 11 and photosensitive drum 15 continues until the transfer process ends.

Then, the transfer paper P is fed into the section between the transfer drum 11 and ground roller 12, while at the same time, voltages are applied to the transfer drum 11 from the power source unit 32, to the scorotron 181 from the scorotron's power source unit 183, to the photosensitive drum 15 from the photosensitive drum's power source 184, and to the erasing lamp 182 from the erasing lamp's power source unit 185, respectively.

Substantially at the same timing as the above, the ground roller 12 is moved toward the transfer drum 11, so that the transfer paper P is sandwiched by the transfer drum 11 and ground roller 12. Accordingly, charges are induced on the transfer paper P, thereby allowing the transfer paper P to adhere to the transfer drum 11 electrostatically.

Next, when the transfer drum 11 with the transfer paper P being wound around has turned once, the ground roller 12 is separated from the transfer drum 11. The transfer paper P adheres to the transfer drum 11 until the transfer drum 11 turns four times, that is, until all of the toner images in four colors are transferred onto the transfer paper P. When all the toner images have been transferred onto the transfer paper P, each of the above power source unit is turned off, and the transfer paper P is forcefully separated from the transfer drum 11 by the separating claw 14 (shown in FIG. 2), and transported further to the fuser unit.

Since the photosensitive drum 15 is negatively charged while the transfer drum 11 is positively charged, if the erasing lamp 182 is not employed, the negative potential of the photosensitive drum 15 moves to the transfer drum 11 at a point known as the transfer point X where the transfer drum 11 and photosensitive drum 15 are brought into contact with each other, thereby lowering the surface potential of the transfer drum 11. As a result, the transfer drum 11 attracts the transfer paper P insufficiently, thereby possibly causing defects in a transferred toner image.

To eliminate the above problem, the erasing lamp 182 is provided in the present embodiment. To be more specific, the negative charges on the surface of the photosensitive drum 15 are removed when the erasing lamp 182 is turned on during the transfer process. Thus, no charges will move to the transfer drum 11 from the photosensitive drum 15, and the surface potential of the transfer drum 11 remains at a constant level. As a result, the transfer drum 11 can attract the transfer paper P in a stable manner and a toner image can be transferred onto the transfer paper P satisfactorily.

The relation between the surface potential of the photosensitive drum 15 and the charging effect on the transfer drum 11 is set forth in TABLE 38.

TABLE 38

| SURFACE POTENTIAL (V) | −600 OR LESS | −400 | −200 | 0 | 100 | 800 OR MORE |
|---|---|---|---|---|---|---|
| CHARGING EFFECT | X | Δ | ○ | ⊙ | ○ | X |

X: ALMOST NONE Δ: POOR ○: FAIR ⊙: EXCELLENT

TABLE 38 reveals that the charging effect on the transfer drum 11 can be realized when the surface potential of the photosensitive drum 15 is in a range between −200V and 100V, and in particular, the charging effect is enhanced when the surface potential is 0V.

As has been explained, according to the above-structured image forming apparatus, the residual charges on the photosensitive drum 15 can be removed when the transfer ends, thereby eliminating the adverse effect on the transfer drum 11 resulted from the residual charges on the photosensitive drum 15.

As a result, the transfer drum 11 can be charged in a stable manner, and hence defects in a transferred image caused by insufficient adhesion of the transfer paper P to the transfer drum 11 can be eliminated, thereby making it possible to transfer a toner image satisfactorily onto the transfer paper P.

[TWELFTH EMBODIMENT]

Still another embodiment will be explained in the following while referring to FIGS. 47 through 57.

In the present embodiment, the transfer process depending on the kind of a sheet of transfer body (hereinafter referred to as a transfer sheet) P will be explained.

Figure 47:
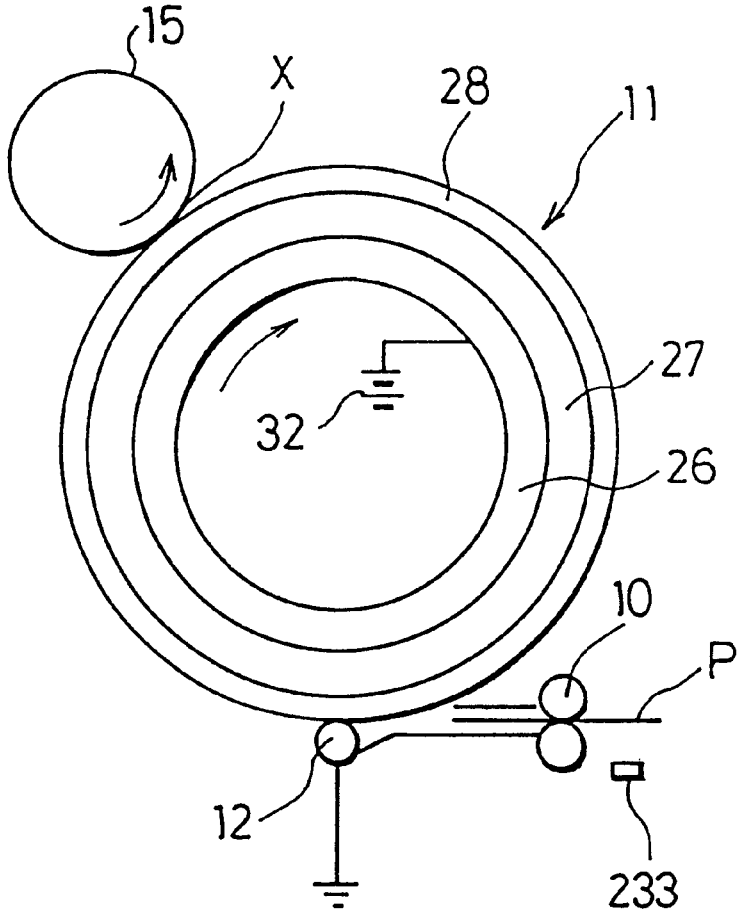
FIG. 47 is a schematic view showing a structure of an image forming apparatus in accordance with the twelfth embodiment of the present invention.

To begin with, the structure of the transfer drum 11 of the present embodiment will be explained while referring to FIG. 47. The transfer drum 11 employs the cylindrical conductive layer 26 made of aluminum as the base material, and the semi-conductive layer 27 made of elastic urethane foam is formed on the top surface of the conductive layer 26. Further, the dielectric layer 28 made of either polyvinylidene fluoride or PET (polyethylene terephtalate) is formed on the top surface of the semi-conductive layer 27. The conductive layer 26 is connected to the power source unit 32 serving as voltage applying means, so that a voltage is applied across the conductive layer 26 constantly. The grounded conductive ground roller 12 and pre-curl roller 10 are provided around the transfer drum 11.

It is known that, if the transfer sheets P are made of different materials, there is a difference in the amount of charges on the transfer sheet P charged during the nip time, a time required for an arbitrary point on the transfer sheet P to pass by the nip width between the ground roller 12 and transfer drum li.

Here, a method of adjusting the nip time will be explained. As shown in FIG. 47, an image forming apparatus of the present embodiment includes a transfer sheet detecting sensor 233 for detecting the kind of the transfer sheet P. The transfer sheet detecting sensor 233 is connected to control means (the control device shown in FIG. 14) so as to detect the kind of the transfer sheet P to be transported to the transfer drum 11 by evaluating the physical properties thereof under the control of the control means before it is attracted to the transfer drum 11 electrostatically. In other words, the transfer sheet detecting sensor 233 detects whether the transfer sheet P is a paper or an OHP sheet of a synthetic resin by evaluating the transmittance of the transfer sheet P, or whether the transfer sheet P is a cardboard or a thin paper by evaluating the thickness of the transfer sheet P. The nip time is adjusted based on the kind of the transfer sheet P thus detected (for example, a paper or an OHP sheet of a synthetic resin, or the thickness).

The nip time is determined by the two following factors: (1) the nip width between the transfer drum 11 and ground roller 12, and (2) the rotation speed (circumferential speed) of the transfer drum 11. The nip width can be adjusted by changing the hardness of the semi-conductive layer 27. Note that the hardness of the semi-conductive layer 27 is indicated by the above-explained ASKER C. The relation between the hardness in ASKER C and the adhesion effect on the transfer sheet P is set forth in TABLE 39 below.

TABLE 39

| HARDNESS | 10 | 15 | 20 | 25 | 30 | 40 | 50 | 60 | 70 | 80 | 90 |
|---|---|---|---|---|---|---|---|---|---|---|---|
| ADHESION EFFECT | X | X | Δ | ○ | ○ | ○ | ○ | Δ | Δ | Δ | X |

The hardness is indicated in ASKER C stipulated by Japanese Rubber Association.

In TABLE 39, a mark ○ indicates that the adhesion effect is excellent, and the transfer sheet P adheres to the transfer drum 11 electrostatically in a stable manner while the transfer drum 11 rotates four times (while the toner images in four colors are transferred onto the transfer sheet P). A mark Δ indicates that the adhesion effect is poor, and although the transfer sheet P adheres to the transfer drum 11 electrostatically while the transfer drum 11 rotates four times, the top or bottom end of the transfer sheet P separates from the transfer drum 11. A mark × -indicates that the adhesion effect is nil, and the transfer sheet P separates from the transfer drum 11 while the transfer drum 11 rotates four times.

TABLE 39 reveals that the adhesion effect on the transfer sheet P can be obtained when the hardness of the semi-conductive layer 27 is in a range between 20 and 80 in ASKER C. In other words., it is preferable if the semiconductive layer 27 has the hardness of 20 to 80 in ASKER C, because the transfer sheet P can adhere to the transfer drum 11 electrostatically while the transfer drum rotates four times, and it is most preferable if the semi-conductive layer 27 has the hardness of 25 to 50 in ASKER C, because the transfer sheet P can adhere to the transfer drum 11 electrostatically in a more stable manner.

The semi-conductive layer 27 having a hardness smaller than 20 in ASKER C is not suitable, because the semi-conductive layer 27 is not sufficiently hard and the transfer sheet P curls in an opposing direction (a direction that does not go along the transfer drum 11). As a result, the transfer sheet P can not adhere to the transfer drum 11 electrostatically in a stable manner.

The semi-conductive layer 27 having a hardness more than 80 in ASKER C is not suitable either, because the semi-conductive layer 27 becomes too rigid and makes the nip width between the transfer drum 11 and ground roller 12 narrower, thereby making it impossible for the transfer sheet P to adhere to the transfer drum 11 electrostatically a in a stable manner. Further, when the semi-conductive layer 27 becomes too rigid, an excessive contacting pressure is applied to the section between the photosensitive drum 15 and transfer drum 11, and thus degrades the durability of the photosensitive drum 15.

Figure 48:
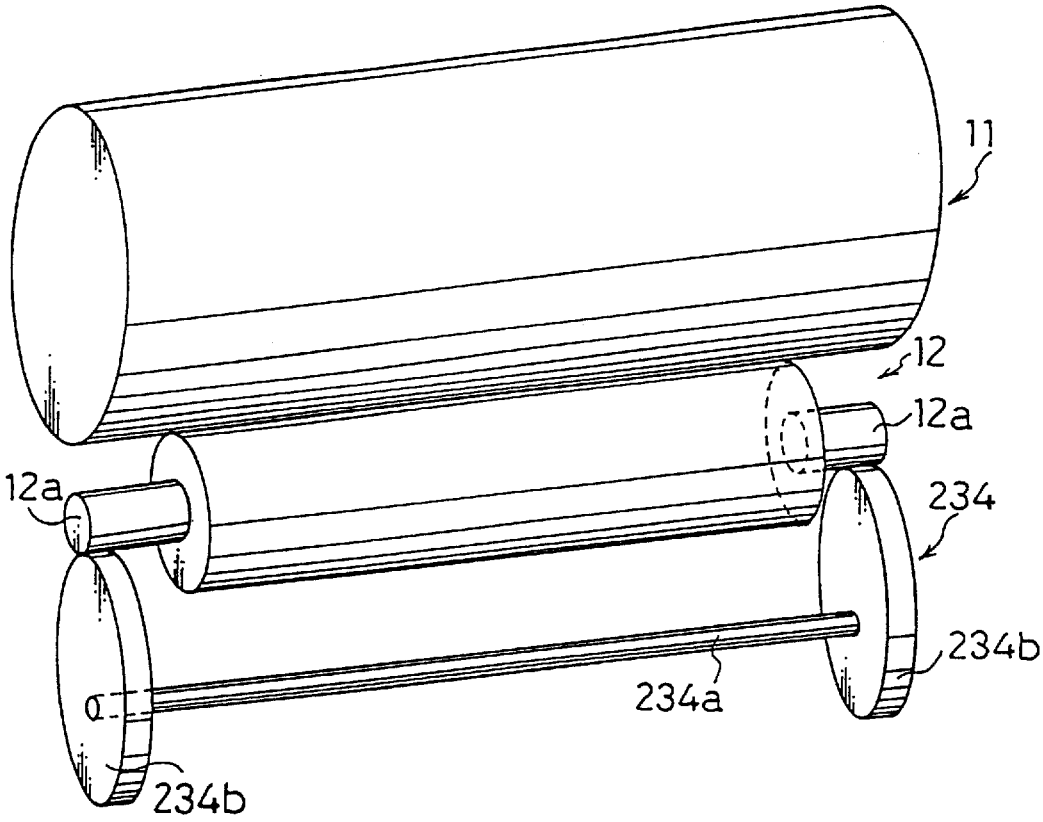
FIG. 48 is a view explaining a structure to change a contacting pressure between a transfer drum and a conductive roller shown in FIG. 47.

The nip width can be adjusted by changing the contacting pressure applied to the section between the transfer drum 11 and ground roller 12. For example, an eccentric cam 234 is provided below the ground roller 12 as shown in FIG. 48 to press the ground roller 12, and the contacting pressure can be changed by adjusting a pressing force of the eccentric cam 234 with respect to the ground roller 12. The eccentric cam 234 comprises an axis 234*a* and two pressing members 234*b* made of identical elliptic plane plates provided at the both ends of the axis 234*a*, respectively. The eccentric cam 234 is designed in such a manner that the pressing members 234*b* are brought into contact with a rotating axis 12*a* of the ground roller 12, which extends in a longitudinal direction from the centers of the side surfaces of the ground roller 12 in the longitudinal direction. The axis 234*a* supports each of the pressing members 234*b* at an off-center thereof, and is placed in parallel to the ground roller 12.

Figure 49:
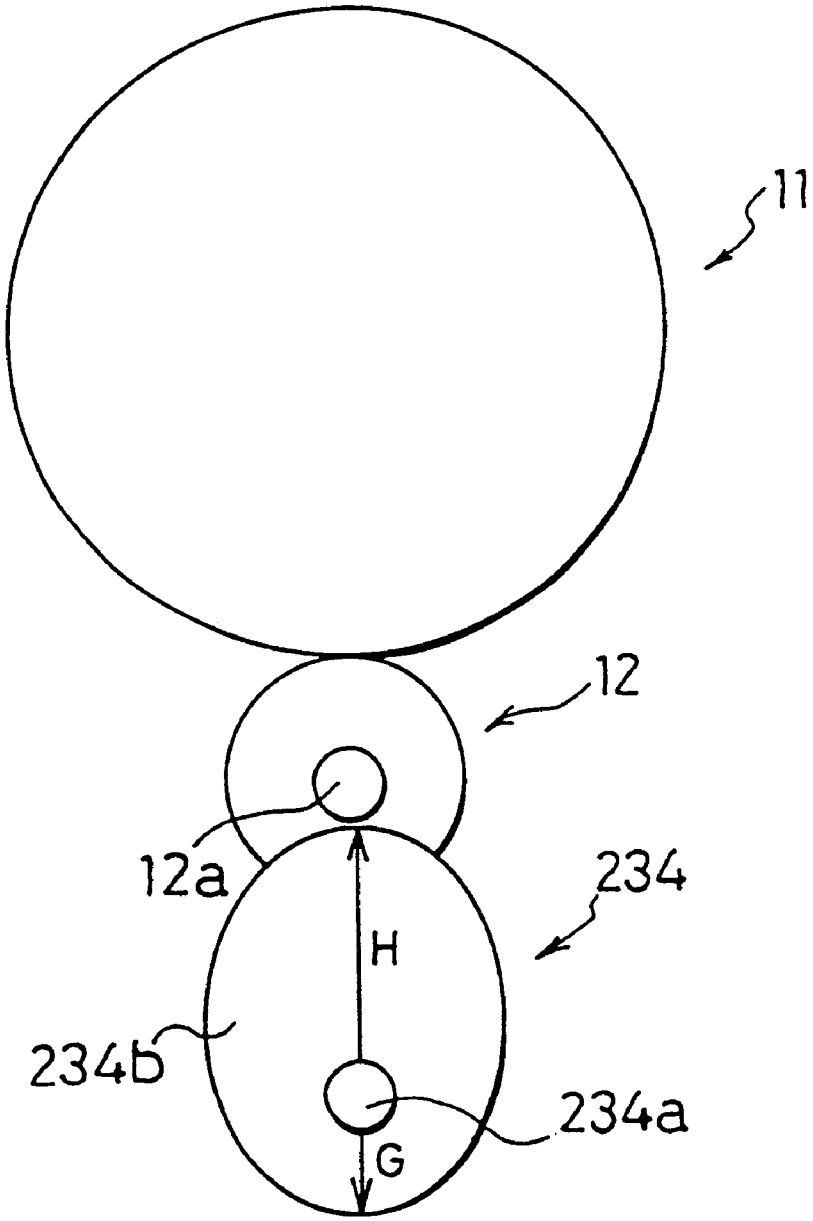
FIG. 49 is a side view explaining a structure to change the contacting pressure between the transfer drum and conductive roller shown in FIG. 47.

The contacting pressure between the transfer drum 11 and ground roller 12 reaches its maximum when the distance between the axis 234*a* and rotating axis 12*a* is the longest (a distance from the axis 234*a* to the peripheral portion of the pressing member 234*b* becomes H as shown in FIG. 49 illustrating the side view of the transfer drum 11, ground roller 12, and eccentric cam 234). The contacting pressure between the transfer drum 11 and ground roller 12 drops to its minimum when the distance between the axis 234*a* and rotating axis 12*a* is the shortest (a distance from the axis 234*a* to the peripheral portion of the pressing member 234*b* becomes G as shown in FIG. 49). According to the above structure, the pressing force of the eccentric cam 234 with respect to the ground roller 12 is adjusted when the eccentric cam 234 is rotated, and as a result, the contacting pressure between the transfer drum 11 and ground roller 12 is adjusted. Note that pressing members 234*b* can be of any shape as long as a portion brought into contact with the rotating axis 12*a*, or namely, the peripheral portion, is curved. Thus, the pressing member 234*b* may be a circular plate or sphere. The relation between the nip width and the adhesion effect on the transfer sheet P is set forth in TABLE 40 below. The nip width referred herein is defined as a width of a close contacting portion between the transfer drum 11 and ground roller 12 in a direction in which the transfer sheet P moves.

TABLE 40

| NIP WIDTH | 0.0 | 0.5 | 1.0 | 2.0 | 3.0 | 4.0 | 5.0 | 6.0 | 7.0 |
|---|---|---|---|---|---|---|---|---|---|
| ADHESION EFFECT | X | Δ | ○ | ○ | ○ | ○ | Δ | X | X |

UNIT: mm

In TABLE 40, a mark ○ indicates that the adhesion effect is excellent, and the transfer sheet P adheres to the transfer drum 11 electrostatically in a stable manner while the transfer drum 11 rotates four times (while the toner images in four colors are transferred onto the transfer sheet P). A mark Δ indicates that the adhesion effect is poor, and although the transfer sheet P adheres to the transfer drum 11 electrostatically while the transfer drum 11 rotates four times, the top or bottom end of the transfer sheet P separates from the transfer drum 11. A mark × indicates that the adhesion effect is nil, and the transfer sheet P separates from the transfer drum 11 while the transfer drum 11 rotates four times.

TABLE 40 reveals that when the nip width is set in a range between 0.5 mm and 5.0 mm, the transfer sheet P can adhere to the transfer drum 11 electrostatically while the transfer drum 11 rotates four times. In other words, it is preferable to set the nip width in a range between 0.55 mm and 5.0 mm in terms of a dynamical strength (mechanical strength), and it is most preferable to set the nip width in a range between 1.0 mm and 4.0 mm. The nip width narrower than 0.5 mm is not preferable, because the ground roller 12 is not rotatably driven by the transfer drum 11, and hence the transfer drum 11 can neither attract the transfer sheet P while it rotates four times nor transport the transfer sheet P in a stable manner. The nip width wider than 5.0 mm is not preferable either, because a nip pressure becomes so strong that the transfer sheet P is curled in an opposing direction (a direction that does not go along the transfer drum 11). As a result, the transfer sheet P can not adhere to the transfer drum 11 electrostatically in a stable manner.

As has been explained, when the transfer drum 11 rotates at a constant speed, the nip time can be changed easily by changing the hardness of the semi-conductive layer 27 and/or the contacting pressure between the transfer drum 11 and ground roller 12. Alternatively, the nip time can be adjusted by making the nip width invariable while making the rotation speed of the transfer drum 11 variable. In this case, note that the transfer drum 11 must be slowed down to extend the nip time, and the transfer efficiency per minute degrades when the transfer drum 11 rotates slower. Thus, it is preferable to change the nip time by adjusting the hardness of the semi-conductive layer 27 and/or the contacting pressure between the transfer drum 11 and ground roller 12.

The relation between the kinds of the transfer sheets P and the amount of the charges given to the transfer sheet P during the nip time will be explained while referring to FIGS. 50 through 53.

Figure 50:
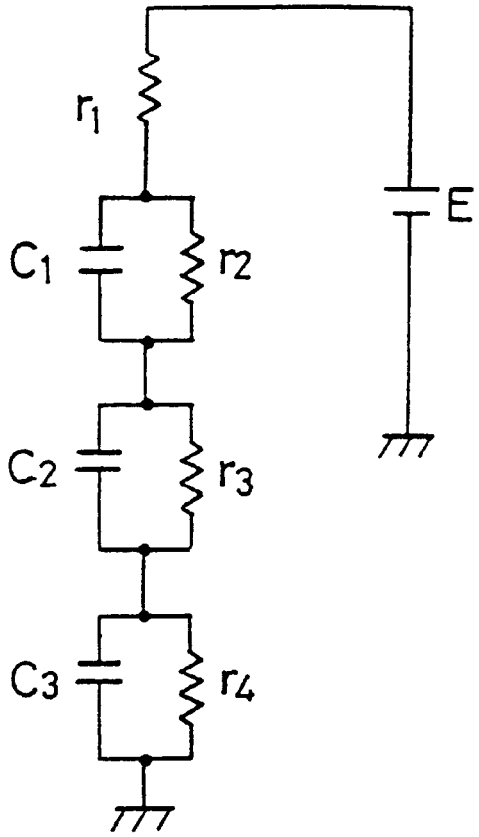
FIG. 50 is a schematic circuit diagram showing an equivalent circuit of a charge injecting mechanism between the transfer drum and conductive roller shown in FIG. 47.

FIG. 50 shows a charge injecting mechanism after the above-explained Paschen's discharge. The charge injection is equivalent to the accumulation of the charges within a capacitor (condenser) due to the current flowing through the circuit. To be more specific, a capital letter E represents a voltage applied to the conductive layer 26 from the power source unit 32, r1 represents a resistance of the semiconductive layer 27, r2 represents a resistance of the dielectric layer 28, r3 represents a resistance of the transfer sheet P, and r4 represents a resistance of the nip between the ground roller 12 and transfer drum 11. Also, C1 represents an electrostatic capacity of the dielectric layer 28, C2 represents an electrostatic capacity of the transfer sheet P, and C3 represents an electrostatic capacity of the nip between the ground roller 12 and transfer drum 11.

To find the amount of charges accumulated in C2, a potential difference between the electric potential in C2 in the above equivalent circuit and an initial electric potential, which is in effect the amount of charges (electric potential) given by Paschen's discharge, is found in the first place; and in the second place, an electric potential is found by taking the Paschen's discharge and charge injection into account. The analytic equation of a final electric potential (V2) of the transfer sheet P thus found is as follows:

$$V=\alpha\times(\beta\times e^{B}-\gamma\times e^{C})$$

where α, β, γ, B, and C are constants depending on the circuit.

Figure 51:
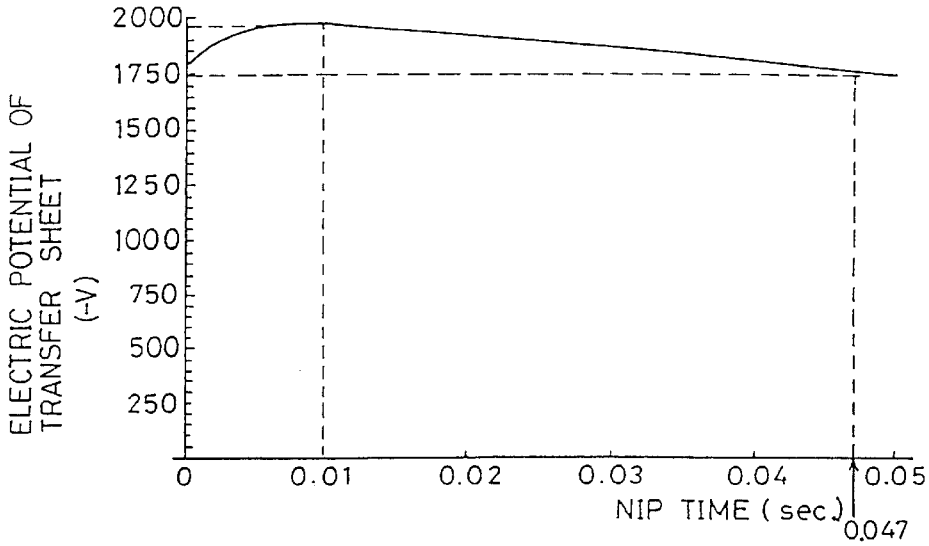
FIG. 51 is a graph showing a relation between the amount of charges on a transfer sheet and a nip time.

FIG. 51 is a graph showing the relation between the nip time and the electric potential (amount of charges) of the transfer sheet P when the amount of charges injected during the nip time is found by the above analytic equation, assuming that the resistance value (volume resistivity) of the semi-conductive layer 27 is $10^7$ Ω·cm, the resistance value (volume resistivity) of the dielectric layer 28 is $10^9$ Ω·cm, an applying voltage is 3.0 KV, and the transfer sheet P is a paper. The graph in FIG. 51 reveals that the amount of charges of the transfer sheet P reaches its maximal value over the nip time.

Let the rotation speed of the transfer drum 11 be 85 mm/sec., the nip width between the transfer drum 11 and ground roller 12 be 4 mm, then we get the nip time of 0.047 sec. It is understood from FIG. 51 that the amount of charges of the transfer sheet P is reduced to −1740V from the initial amount of −1800V when the nip time of 0.047 sec has passed, meaning that the electrostatic adhesion of the transfer sheet P becomes weaker.

To make the amount of charges after the charge injection at least as large as the initial amount, the nip time is adjusted either by narrowing the nip width (for example, narrowed to 3 mm), or increasing the rotation speed of the transfer drum 11 (for example, increased to 95 mm/sec.). Further, to enhance the efficiency of the charge injection, either the nip width is set to 0.85 mm or the rotation speed of the transfer drum 11 is set to 400 mm/sec., so that the charge injection occurs when the amount of charges of the transfer sheet P reaches its maximal value (at the nip time of 0.01 sec.). As has been explained, the nip time in which the charge injection occurs efficiently can be found by:

1) finding an optimal nip width in terms of static electricity using the relation between the nip time and the amount of injected charges during the nip time; and
2) finding an optimal nip width by taking the optimal nip width in terms of static electricity thus found and an optimal nip width in terms of the above-explained mechanical strength into account.

Thus, when the amount of the charges of the transfer sheet P reaches its maximal value over the nip time, the transfer sheet P can adhere to the dielectric layer 28 of the transfer drum 11 electrostatically in a stable manner by setting the nip time in such a manner that the amount of charges of the transfer sheet P will not drop below the initial amount. Further, the charges can be injected and the transfer sheet P can be charged more efficiently if the amount of charges reaches its maximal value during the nip time. As a result, the transfer sheet P can adhere to the dielectric layer 28 electrostatically in a more stable manner. Thus, the transfer sheet P will not separate from the transfer drum 11 before the toner images in respective colors formed on the photosensitive drum 15 have been transferred onto the transfer sheet P. As a result, the toner images can be transferred onto the transfer sheet P from the photosensitive drum 15 satisfactorily, thereby making it possible to steadily produce an image in a stable manner.

Figure 52:
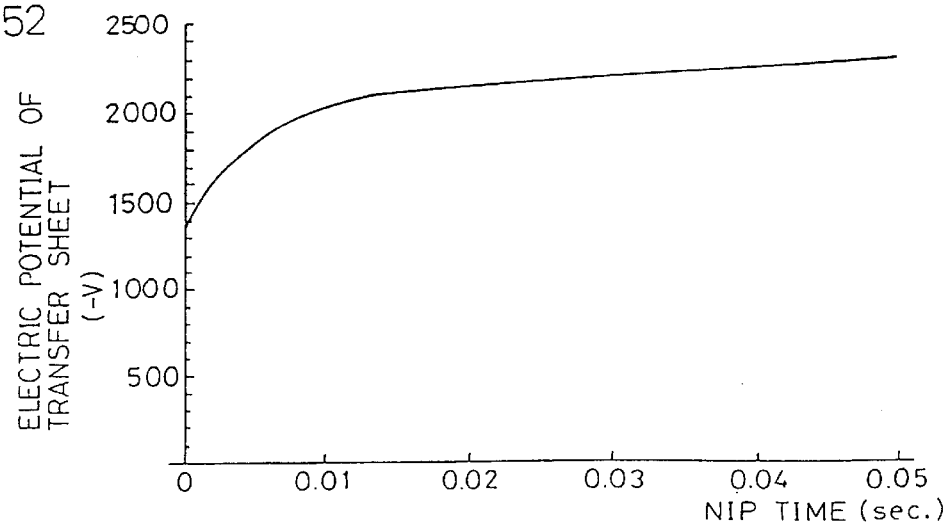
FIG. 52 is a graph showing a relation between the amount of charges on the transfer sheet and the nip time under a condition different to that of FIG. 51.

FIG. 52 is a graph showing the relation between the nip time and the electric potential (amount of charges) of the transfer sheet P when the amount of charges injected during the nip time is found by the above analytic equation, assuming that the resistance value (volume resistivity) of the semi-conductive layer 27 is $10^7$ Ω·cm, the resistance value (volume resistivity) of the dielectric layer 28 is $10^9$ Ω·cm, an applying voltage is 3.0 KV, and the transfer sheet P is an OHP sheet of a synthetic resin.

The graph in FIG. 52 reveals that the amount of charges of the transfer sheet P tends to increase as the nip time extends when the transfer sheet P is the OHP sheet of the synthetic resin. This means that the charges are injected constantly as long as the nip time is set so as to satisfy the mechanical nip condition shown in FIG. 39 or 40 (the hardness of the semi-conductive layer 27 is set to 20 to 80 in ASKER C, or the nip width between the transfer drum 11 and ground roller 12 is set to 0.5 mm to 5.0 mm). The relation between the potential difference of the transfer sheet P before and after the charge injection and the adhesion effect on the transfer sheet P and printing efficiency is set forth in TABLE 41 below.

TABLE 41

| POTENTIAL DIFFERENCE | 0 | 200 | 400 | 600 | 800 | 1000 | 1200 | 1400 | 1600 OR MORE |
|---|---|---|---|---|---|---|---|---|---|
| ADHESION EFFECT AND PRINTING EFFICIENCY | ○ | ○ | ○ | ○ | ○ | ○ | X | X | X |

In TABLE 41, a mark ○ indicates that the adhesion effect is excellent and printing efficiency is fair, and the transfer sheet P adheres to the transfer drum 11 electrostatically in a stable manner while the transfer drum 11 rotates four times (while the toner images in four colors are transferred onto the transfer sheet P). A mark × indicates the adhesion effect is nil or the printing efficiency is low, and the transfer sheet P separates from the transfer drum 11 while the transfer drum 11 rotates four times.

TABLE 41 reveals that, where there is a potential difference exceeding 1000V before and after the charge injection, the adhesion force is reduced and the transfer sheet P separates from the transfer drum 11 while the transfer drum 11 rotates four times. It is assumed that mechanical causes are responsible for such separation of the transfer sheet P. More specifically, when the nip time is extended to increase the amount of charges to be injected by widening the nip width, the nip pressure between the transfer drum 11 and ground roller 12 increases, which causes the transfer sheet P to curl in an opposing direction (a direction that does not go along the transfer drum 11). Alternatively, the nip time can be extended to increase the amount of charges to be injected by decreasing the process speed, or decreasing the rotation speed of the transfer drum 11. In this case, however, the printing efficiency per minute is degraded, because the process speed such that can give an amount of injected charges to yield a potential difference over 1000V is too slow. Thus, it is most preferable when a potential difference before and after the charge injection is in a range of 0V±1000V (0V or more and 1000V or less in an absolute value).

Thus, when the amount of charges of the transfer sheet P increases as the nip time extends, the transfer sheet P can adhere to the dielectric layer 28 electrostatically in a stable manner, if the nip time is set in such a manner that the potential difference of the transfer sheet P before and after the charge injection (before and after the transfer sheet P passes through the section between the transfer drum 11 and ground roller 12) is in a range of 0V±1000V. Accordingly, the transfer sheet P will not separate from the transfer drum 11 before all the toner images in four colors formed on the photosensitive drum 15 are transferred onto the transfer sheet P. As a result, the toner images can be transferred onto the transfer sheet P satisfactorily, thereby making it possible to steadily produce an image.

Figure 53:
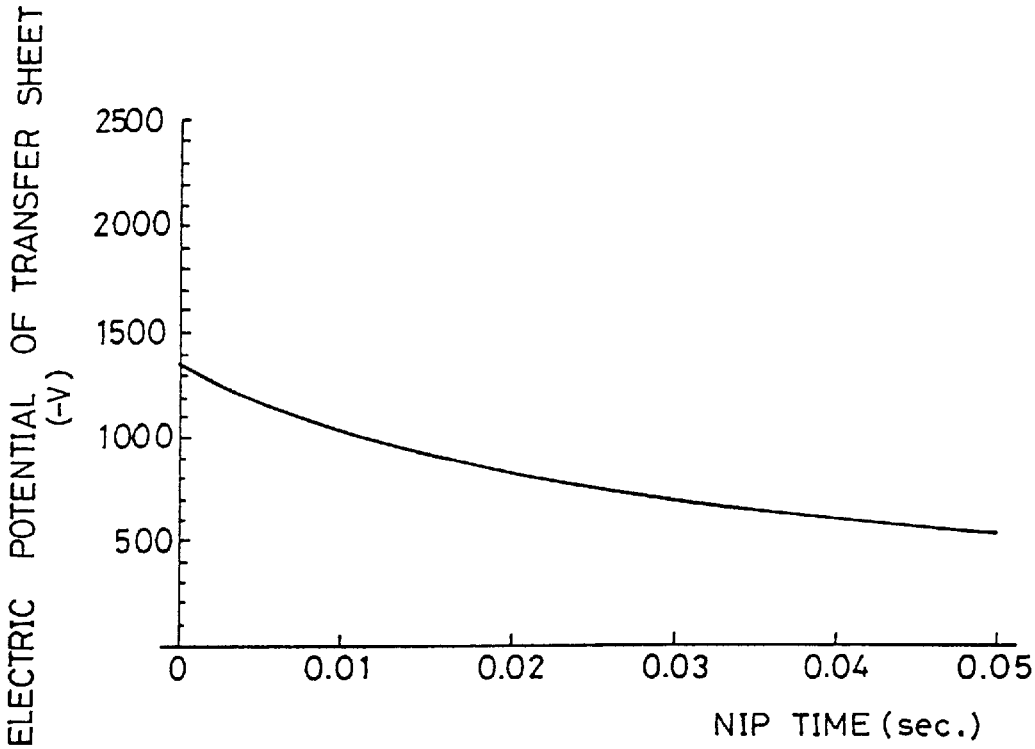
FIG. 53 is a graph showing a relation between the amount of charges on the transfer sheet and the nip time under a condition different to those of FIGS. 51 and 52.

FIG. 53 is a graph showing the relation between the nip time and the electric potential (amount of charges) of the transfer sheet P when the amount of charges injected during the nip time is found by the above analytic equation, assuming that the resistance value (volume resistivity) of the semi-conductive layer 27 is increased to $10^9$ Ω·cm, the resistance value (volume resistivity) of the dielectric layer 28 is increased to $10^{10}$ Ω·cm, an applying voltage is 3.0 KV, and the transfer sheet P is a paper.

The graph in FIG. 53 shows that no charge is injected after the transfer sheet P has passed through the nip width and the amount of charges of the transfer sheet P tends to decrease from the initial value as the nip time extends when the semi-conductive layer 27 and dielectric layer 28 have a large resistance value. The relation between a percentage of the electric potential after the charge injection of the electric potential before the charge injection and the adhesion effect is set forth in TABLE 42A.

TABLE 42A

| PERCENTAGE OF ELECTRIC POTENTIAL (after/before) | 10 OR LESS | 20 | 30 | 40 | 50 | 60 | 70 | 80 | 90 OR MORE |
|---|---|---|---|---|---|---|---|---|---|
| ADHESION EFFECT | X | X | X | X | ○ | ○ | ○ | ○ | ○ |

UNIT: %

In TABLE 42A, a mark ○ indicates that the adhesion effect is excellent, and the transfer sheet P adheres to the transfer drum 11 electrostatically in a stable manner while the transfer drum 11 rotates four times (while the toner images in four colors are transferred onto the transfer sheet P). A mark × indicates the adhesion effect is nil, and the transfer sheet P separates from the transfer drum 11 while the transfer drum 11 rotates four times.

TABLE 42A reveals that if the electric potential after the charge injection is 50% or more of the electric potential (amount of charges) before the charge injection, or namely, the initial electric potential (initial amount of charges), then the transfer sheet P can adhere to the transfer drum 11 electrostatically in a stable manner while the transfer drum 11 rotates four times.

Thus, when the amount of charges of the transfer sheet P tends to drop below the initial amount of charges as the nip time extends, the transfer sheet P can adhere to the transfer drum electrostatically in a stable manner if the nip time is set in such a manner that:

1) the mechanical nip condition specified in TABLE 39 or TABLE 40 (the hardness of the semi-conductive layer 27 is set in a range between 20 and 80 in ASKER C or the nip width between the transfer drum 11 and ground roller 12 is set in a range between 0.5 mm and 5.0 mm) is satisfied; and 2) the amount of the charges transfer sheet P is 50% or more of the initial amount of charges.

For example, if the nip time is set to 0.01 sec. by setting the nip width to 0.85 mm or the rotation speed of the transfer drum 11 to 400 mm/sec., then the above-specified mechanical nip condition is satisfied and the amount of charges of the transfer sheet P is 50% or more of the initial amount of charges.

Thus, when the amount of charges of the transfer sheet P drops below the initial amount of charges as the nip time extends, the transfer sheet P can adhere to the dielectric layer 28 electrostatically in a stable manner if the nip time is set so as to keep the amount of charges of the transfer sheet P at least 50% of the initial amount of charges. Accordingly, the transfer sheet P will not separate from the transfer drum 11 before all the toner images in four colors formed on the photosensitive drum 15 are transferred onto the transfer sheet P. As a result, the toner images can be transferred onto the transfer sheet P satisfactorily, thereby making it possible to steadily produce an image.

It is acknowledged that the graphs in FIGS. 51 through 53 are applied to the relation between the nip time and the amount of charges of the transfer sheet P when the kind of the transfer sheet P, the physical properties (volume resistivity) of the semi-conductive layer 27 and/or dielectric layer 28, or an applied voltage is changed.

In other words, the relation between the nip time and the amount of charges of the transfer sheet P can be classified into three patterns specified below regardless of the physical properties (resistances) of the semi-conductive layer 27 and dielectric layer 28, applied voltage, and the kind of the transfer sheet P:

PATTERN I: the amount of charges of the transfer sheet P reaches its maximal value over the nip time;

PATTERN II: the amount of charges of the transfer sheet P increases as the nip time extends; and PATTERN III: the amount of charges of the transfer sheet P decreases as the nip time extends.

Thus, if the relation between the nip time and the amount of charges of each kind of transfer sheet P with arbitrary semi-conductive layer 27 and/or dielectric layer 28 is found in advance, it becomes easy to check how the nip time should be changed for a particular kind of transfer sheet P to enable the transfer sheet P to adhere to the dielectric layer 28 electrostatically in a stable manner, when the physical properties (resistances) of the semi-conductive layer 27 and/or dielectric layer 28, an applied voltage, or the kind of the transfer sheet P is changed.

Also, if the relation between the nip time and the amount of charges of each kind of transfer sheet P is found in advance, the nip time can be changed to an optimal nip time for a particular kind of transfer sheet P, so that an adequate amount of charges will be given efficiently to enable the transfer sheet P to adhere to the dielectric layer 28 electrostatically in a stable manner. Further, changing the nip time based on the relation between the amount of charges of the transfer sheet P and the nip time in this way enables the transfer sheet P to adhere to the dielectric layer 28 electrostatically in a stable manner.

As has been explained, the charges can be injected efficiently by changing the nip time depending on the kind of the transfer sheet P detected by the transfer sheet detecting sensor 233, thereby enabling electrostatic adhesion of the transfer sheet P to the transfer drum 11 in a stable manner.

Note that there is no limitation as to the means for detecting the kind of the transfer sheet P. Also, the kind of the transfer sheet P can be detected by any criterion. The user may judge the kind of the transfer sheet P visually, and change the nip means based on his judgment. However, the nip time may be changed automatically to the one such that enables the transfer sheet P to adhere the transfer drum 11 electrostatically in a stable manner in the following way: detecting means (for example,. the transfer sheet detecting sensor 233) for detecting the kind of the transfer sheet P detects the kind of the transfer sheet P, and the nip time changing means (the control device 149 in FIG. 32) changes the contacting pressure between the transfer drum 11 and ground roller 12 by controlling the eccentric cam 234 based on the relation between the nip time and the amount of charges of the transfer sheet P stored in advance in storage means (the ROM 150 in FIG. 32).

Since the amount of charges given to the transfer sheet P within a certain time differs depending on the kind of the transfer sheet P, changing the nip time depending on the kind of the transfer sheet P enables any kind of transfer sheet P to adhere to the transfer drum 11 electrostatically in a stable manner.

Here, if the relation between the nip time and the amount of charges of each kind of transfer sheet P with arbitrary semi-conductive layer 27 and/or dielectric layer 28 is found in advance, it becomes easy to check how the nip time should be changed for a particular kind of transfer sheet P to enable the transfer sheet P to adhere to the dielectric layer 28 electrostatically in a stable manner, when the physical properties (resistances) of the semi-conductive layer 27 and/or dielectric layer 28, an applied voltage, or the kind of the transfer sheet P is changed.

Also, if the relation between the nip time and the amount of charges of each kind of transfer sheet P is found in advance, the nip time can be changed to an optimal nip time for a particular kind of transfer sheet P, so that an adequate amount of charges will be given efficiently to enable the transfer sheet P to adhere to the dielectric layer 28 electrostatically in a stable manner. Further, changing the nip time based on the relation between the amount of charges of the transfer sheet P and the nip time in this way enables the transfer sheet P to adhere to the dielectric layer 28 electrostatically in a stable manner.

As a result, the transfer sheet P will not separate from the transfer drum 11 before all of the toner images in four colors formed on the photosensitive drum 15 are transferred onto the transfer sheet P, so that the toner images are transferred onto the transfer sheet P satisfactorily, thereby making it possible to steadily produce an image.

The nip time can be adjusted easily by changing the nip width between the transfer drum 11 and ground roller 12 or the rotation speed of the transfer drum 11.

The nip width can be changed easily by changing the hardness of the semi-conductive layer 27. In other words, the nip time can be adjusted easily by changing the hardness of the semi-conductive layer 27. When the hardness of the semi-conductive layer 27 is set in a range between 20 and 80 in ASKER C, the transfer sheet P can adhere to the transfer drum 11 electrostatically in a stable manner.

Also, the nip width can be changed easily by adjusting the contacting pressure between the transfer drum 11 and ground roller 12. In other words, the nip time can be changed easily by adjusting the contacting pressure between the transfer drum 11 and ground roller 12. The contacting pressure between the transfer drum 11 and ground roller 12 can be adjusted easily using, for example, the eccentric cam 234 shown in FIGS. 48 and 49.

It is preferable to set the nip time so that the nip width will be in a range between 0.5 mm to 5.0 mm. Because the transfer sheet P can adhere to the dielectric layer 28 electrostatically in a stable manner when the nip width is set in a range between 0.5 mm and 5.0 mm.

As has been explained, the nip time can be changed without degrading the transfer efficiency if the nip time is changed not by adjusting the rotation speed of the transfer drum 11 but by adjusting the hardness of the semi-conductive layer 27 and/or the contacting pressure between the transfer drum 11 and ground roller 12.

Figure 54:
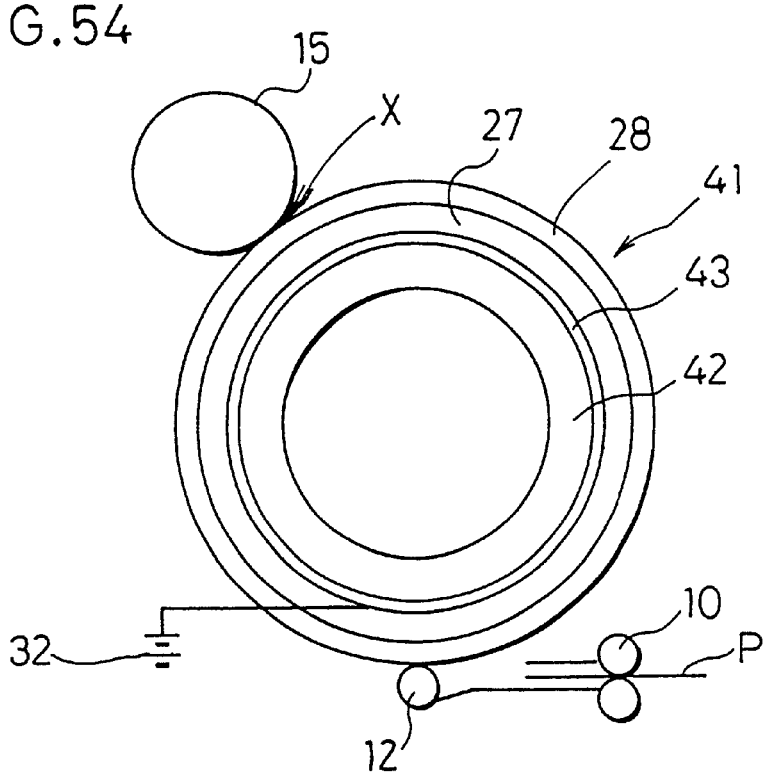
FIG. 54 is a schematic view showing another structure of the transfer drum shown in FIG. 47.

The transfer drum 11 may be replaced with another transfer drum 41 including the semi-conductive layer 27 and dielectric layer 28 as shown in FIG. 54. The transfer drum 41 includes a cylindrical base material (base layer) 42 made of a resin having a conductive thin film layer 43 such as copper foil or aluminum foil on the surface thereof instead of the conductive layer 26. The semi-conductive layer 27 and dielectric layer 28 are sequentially placed on the top surface of the thin film layer 43.

The thin film layer 43 is connected to the power supply unit 32, so that the charges are induced on the surface of the dielectric layer 28 in a stable manner when a voltage is applied as was in the transfer drum 11. As a result, the transfer sheet P can adhere to the transfer drum 41 and the toner images are transferred onto the transfer sheet P in a stable manner.

The transfer drum 41, which includes the base material 42 made of a resin at the center and the conductive material such as copper foil placed on the surface of the base material 42, can cut the manufacturing costs compared with the transfer drum 11 having the conductive layer 26 separately.

Figure 55:
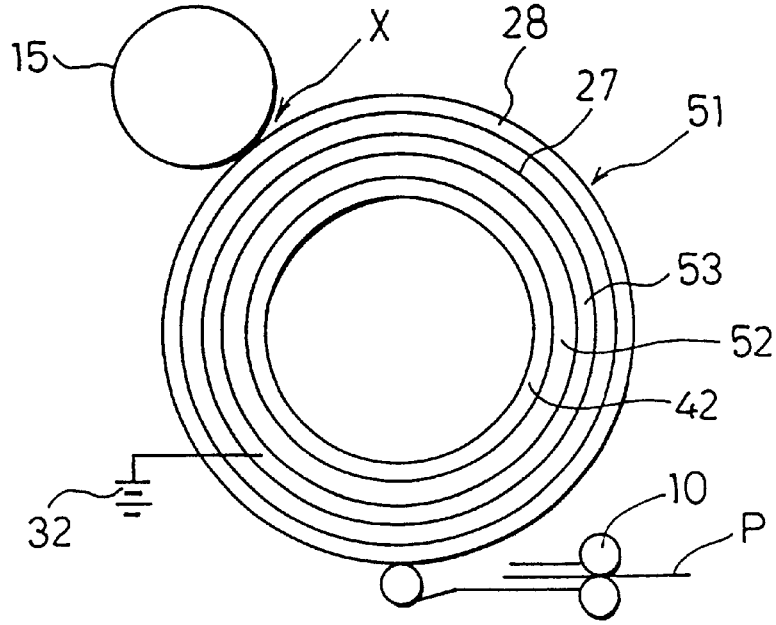
FIG. 55 is a schematic view showing still another structure of the transfer drum shown in FIG. 47.
Figure 56:
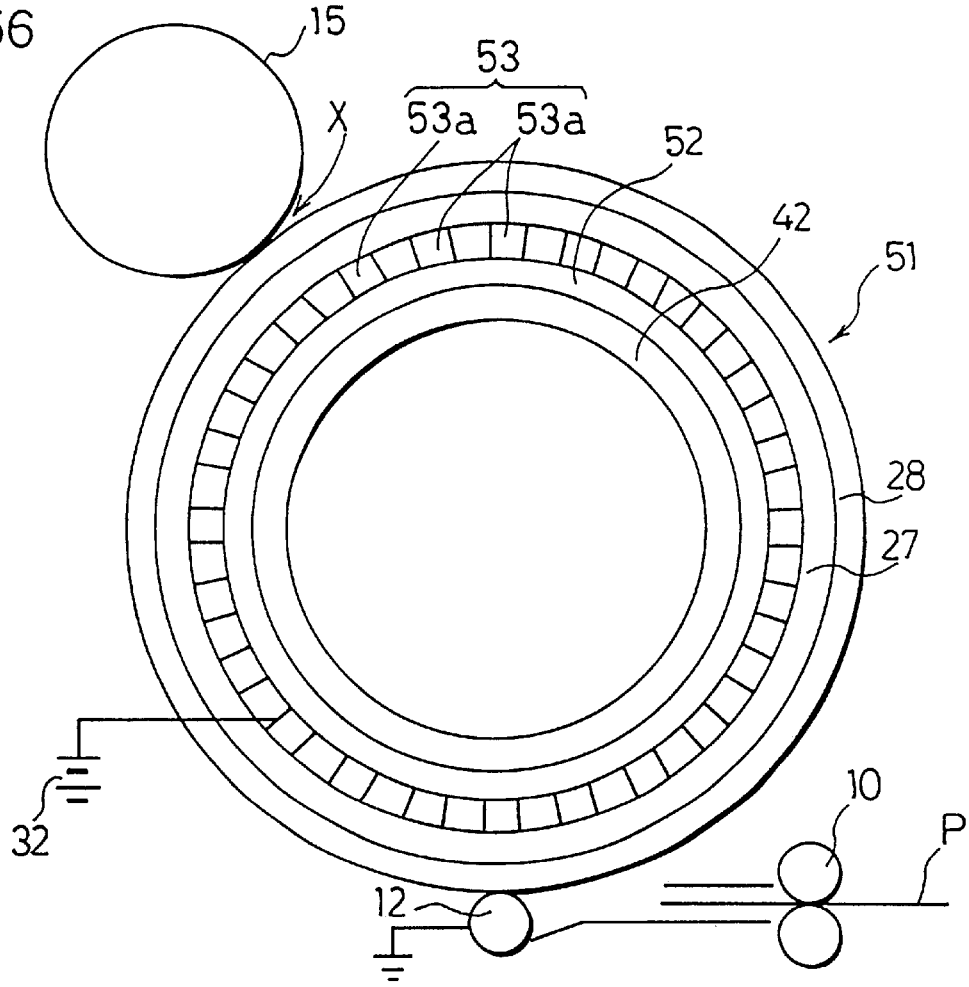
FIG. 56 is a schematic view explaining a structure of an electrode layer of the transfer drum shown in FIG. 55.
Figure 57:
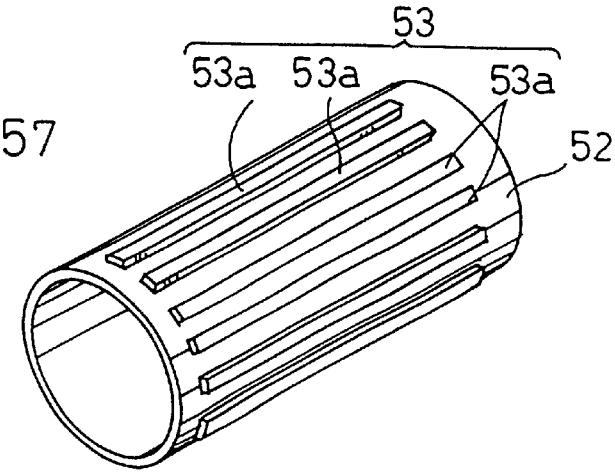
FIG. 57 is a perspective view showing the structure of the electrode layer of the transfer drum shown in FIG. 55.

Alternatively, another transfer drum 51 shown in FIG. 55 having the semi-conductive layer 27 and dielectric layer 28 may be used. The transfer drum 51 includes the base material 42 of the transfer drum 41, and a semi-conductive elastic layer 52 is placed on the surface of the base material 42. Further, a non-continuous electrode layer (conductive layer) 53 is placed on the top surface of the elastic layer 52; the non-continuous electrode layer 53 comprises a plurality of conductive plates (conductive members) 53*a* such as copper plates or aluminium plates aligned at regular intervals.

Further, the semi-conductive layer 27 and dielectric layer 28 are sequentially placed on the top surface of the electrode layer 53.

The electrode layer 53 is connected to the power source unit 32, so that, like the transfer drums 11 and 41, the charges are induced on the surface of the dielectric layer 28 in a stable manner when a voltage is applied to the electrode layer 53. As a result, the transfer sheet P can adhere to the transfer drum 51 and the toner images can be transferred onto the transfer sheet P in a stable manner.

Note that the same effect can be obtained when the semi-conductive layer 27 is connected to the power source unit 32 and a voltage is applied to the semi-conductive layer 27.

With the above-structured transfer drum 51, a voltage drops only when the grounded ground roller 12 approaches to the transfer drum 51, because the electrode layer 53 is composed of a plurality of the conductive plates 53*a* placed on the elastic layer 52 discontinuously and no charges move from one conductive plate 53*a* to another, thereby preventing a drop in voltage.

Accordingly, the voltage will not drop at the transfer point X, which eliminates defects in a transferred toner image and upgrades the transfer efficiency and image quality. Also, since the electrode layer 53 is composed of a plurality of conductive plates 53 placed on the elastic layer 52 at regular intervals, the manufacturing costs of the transfer drum 51 and hence those of the image forming apparatus can be saved.

[THIRTEENTH EMBODIMENT]

Still another embodiment of the present invention will be explained in the following while referring to FIGS. 58 through 62.

Figure 59:
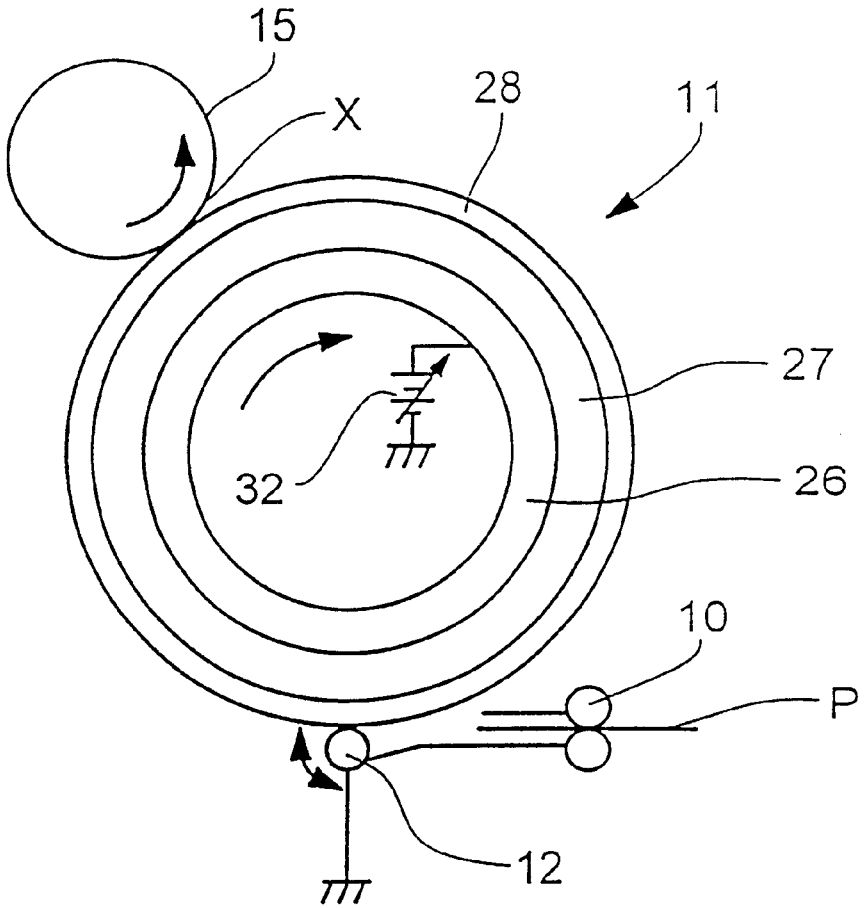
FIG. 59 is a diagram showing a structure around a transfer drum of the image forming apparatus shown in FIG. 58.

The transfer drum 11 of the present embodiment is of the same structure as that of the counterpart in the twelfth embodiment. As shown in FIG. 59, the transfer drum 11 includes the cylindrical conductive layer 26 made of aluminum as the base material, and the semi-conductive layer 27 made of elastic urethan foam is formed on the top surface of the conductive layer 26. Further, the dielectric layer 28 made of polyvinylidene fluoride is placed on the top surface of the semi-conductive layer 27. Also, the conductive layer 26 is connected to the power source unit 32, and the grounded conductive ground roller 12 is provided around the transfer drum 11. The transfer paper P adheres to the transfer drum 11 and a toner image is transferred onto the transfer paper P in the same manner as the first embodiment.

As has been explained in the first embodiment, the transfer paper P is attracted to the transfer drum 11 and the toner image formed on the photosensitive drum 15 is transferred onto the transfer paper P as the transfer drum 11 makes the first turn. Here, a voltage at least as large as the sum of a voltage (hereinafter referred to as attracting voltage) required to attract the transfer paper P and a voltage (hereinafter referred to as transferring voltage) required to transfer the image formed on the photosensitive body 15 onto the transfer paper P must be applied to the transfer drum 11. However, a voltage varies considerably due to the operating environments and the kind of the transfer paper P. Thus, the above two voltage must be changed depending on the operating environments and the kind of the transfer paper P to realize optimal attraction and toner image transfer.

A structure to enable the optimal attraction and toner image transfer will be explained in the following.

To begin with, the relation among the operating environments, applied voltage, and adhesion of the transfer paper P is set forth in TABLE 42B below. In TABLE 42B, marks ○, Δ, and × represent the states of adhesion of the transfer paper P.

TABLE 42B

| HUMIDITY | APPLIED VOLTAGE (kV) | | | |
|---|---|---|---|---|
| (%) | 1.0 | 1.5 | 2.0 | 2.5 |
| 10–20 | ○ | ○ | ○ | ○ |
| 40–50 | Δ | ○ | ○ | ○ |
| 70–80 | X | X | Δ | ○ |

○: FAIR Δ: INFERIOR X: POOR

TABLE 42B reveals that the applied voltage becomes higher as the humidity increases to obtain satisfactory adhesion of the transfer paper P.

Next, the relation among the operating environments, applied voltage, and the transfer of the toner image onto the transfer paper P is set forth in TABLE 43 below. In TABLE 43, marks ○, Δ, and × represent a condition of the toner image transferred onto the transfer paper P.

TABLE 43

| HUMIDITY | APPLIED VOLTAGE (kV) | | | |
|---|---|---|---|---|
| (%) | 1.0 | 1.5 | 2.0 | 2.5 |
| 10–20 | ○ | ○ | ○ | Δ |
| 40–50 | ○ | ○ | Δ | X |
| 70–80 | ○ | Δ | X | X |

○: FAIR Δ: INFERIOR X: POOR

TABLE 43 reveals that the applied voltage becomes lower as the humidity increases to transfer the toner image onto the transfer paper P satisfactorily.

Thus, neither the transfer drum 11 can attract the transfer paper P sufficiently nor the toner image can be transferred onto the transfer paper P satisfactorily when the humidity is high if the applied voltage is constant.

To eliminate such an inconvenience, modes as set forth in TABLE 44 below are prepared, so that either the image forming apparatus or user can switch the mode to a desired one: normal mode, paper adhesion mode, or cardboard mode.

TABLE 44 shows the relation among each mode, attracting voltage, transferring voltage, and the number of rotation times of the transfer drum when forming a full-color copy.

TABLE 44

| MODE | ATTRACTING VOLTAGE(kV) | TRANSFERRING VOLTAGE(kV) | No. OF ROTATION TIMES OF TRANSFER DRUM IN FULL COLOR COPY | REMARKS (SELECTED WHEN) |
|---|---|---|---|---|
| NORMAL | 1.8 | 1.8 | 4 | UNDER NORMAL CONDITION |
| PAPER ADHESION | 2.5 | 1.0 | 5 | UNDER HIGH TEMPERATURE AND HUMIDITY |
| CARDBOARD | 2.0 | 1 8 | 4 | CARDBOARD IS USED |

When the paper adhesion mode is selected to make a full color print, the transfer paper P is attracted to the transfer drum 11 first as the transfer drum 11 makes the first turn, and the transfer process starts from the second turn. In contrast, when the normal mode or cardboard mode is selected, the transfer paper P is attracted to the transfer drum 11 and the transfer process starts using the attracting voltage as the transfer drum 11 makes the first turn, and the transfer process is continued using the transferring voltage from the second turn.

When the paper adhesion mode is selected to make a monochrome print, the paper attraction and transfer processes are carried out in the same manner as above. In contrast, when the normal mode or cardboard mode is selected, the attraction of the transfer paper P and the toner image transfer are completed using the attracting voltage as the transfer drum 11 makes the first turn.

Figure 60:
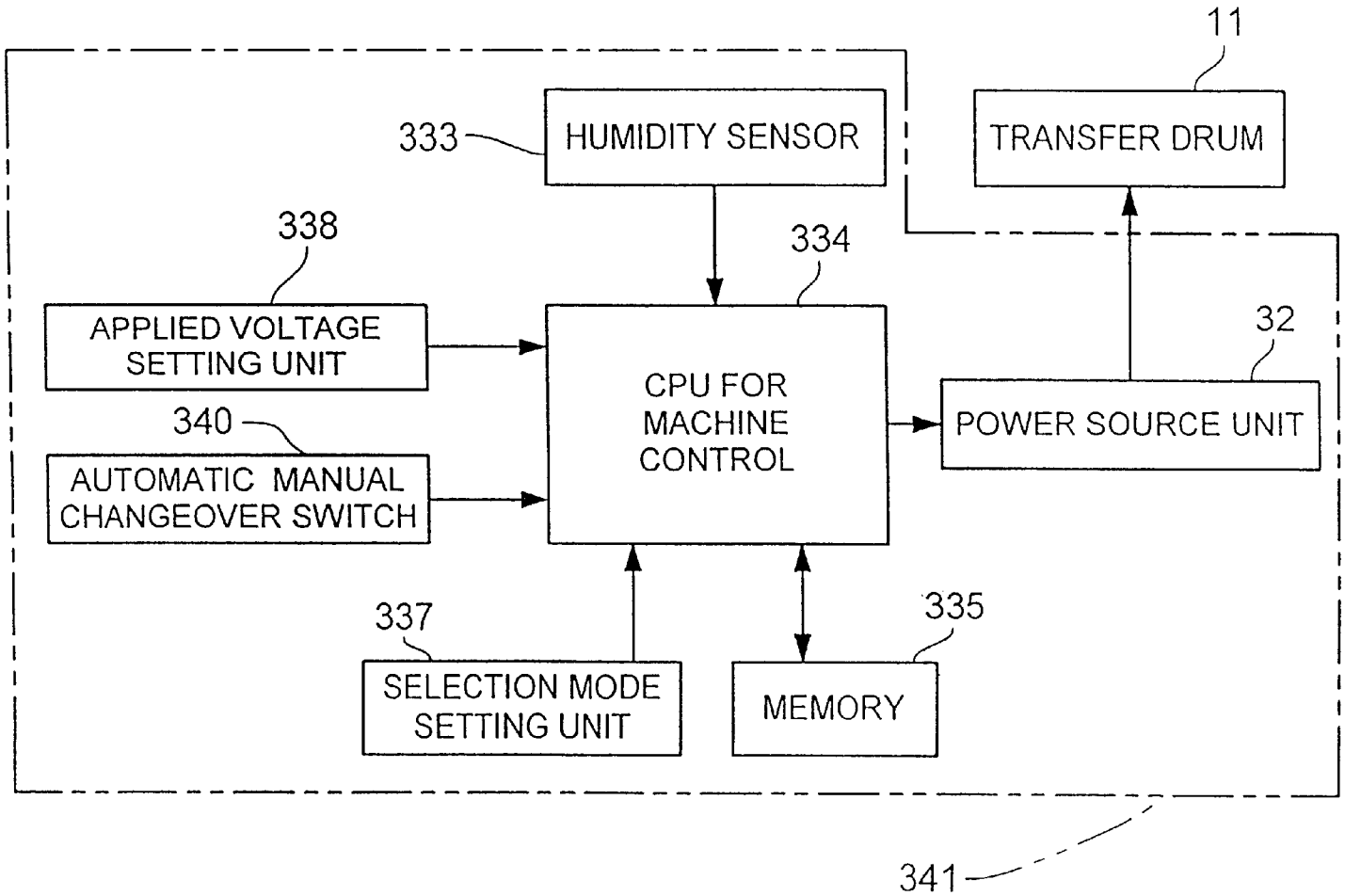
FIG. 60 is a block diagram showing a structure of a transfer drum's applied voltage control device of the image forming apparatus shown in FIG. 58.

An image forming apparatus with the above mode switching operation includes a transfer drum voltage applying device 341 serving as voltage applying means as shown in FIG. 60. The transfer drum voltage applying device 341 applies two kinds of voltages to the transfer drum 11: a voltage to attract the transfer paper P to the transfer drum 11, and a voltage to transfer a toner image onto the transfer paper P. The transfer drum voltage applying device 341 includes the power source unit 32, a humidity sensor 333, a CPU 334 for machine control, a memory 335, an operation panel 336 (FIG. 61), a selection mode setting unit 337, an applied voltage setting unit 338, a mode display unit 339 (FIG. 61), and an automatic•manual changeover switch 340.

Figure 61:
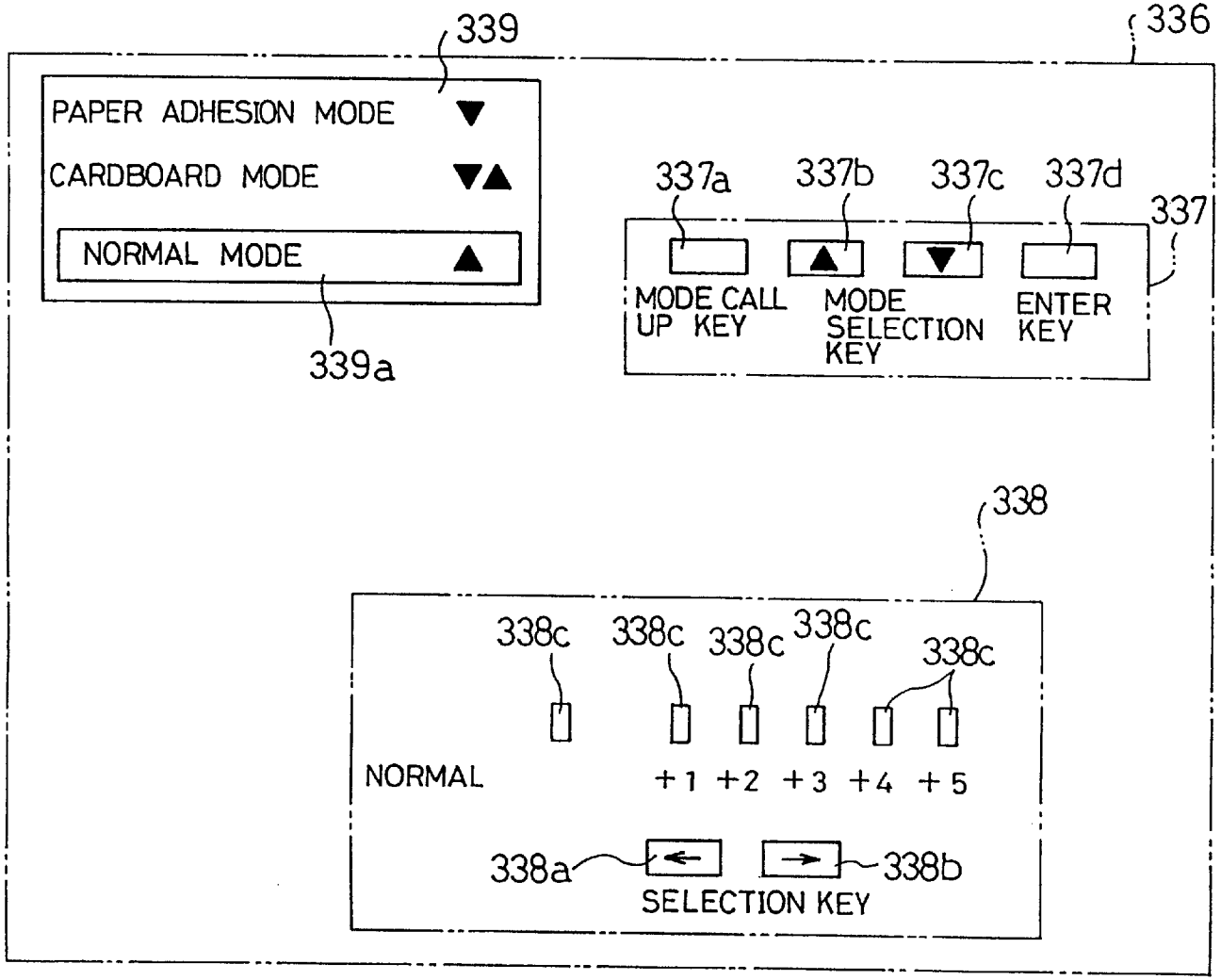
FIG. 61 is a view schematically explaining an operation panel provided on the surface of the image forming apparatus shown in FIG. 58.

The selection mode setting unit 337, applied voltage setting unit 338, mode display unit 339, and automatic•manual changeover switch 340 are mounted on the operation panel 336 shown in FIG. 61.

The power source unit 32 applies a certain voltage to the transfer drum 11 as per instruction from the CPU 334.

Figure 58:
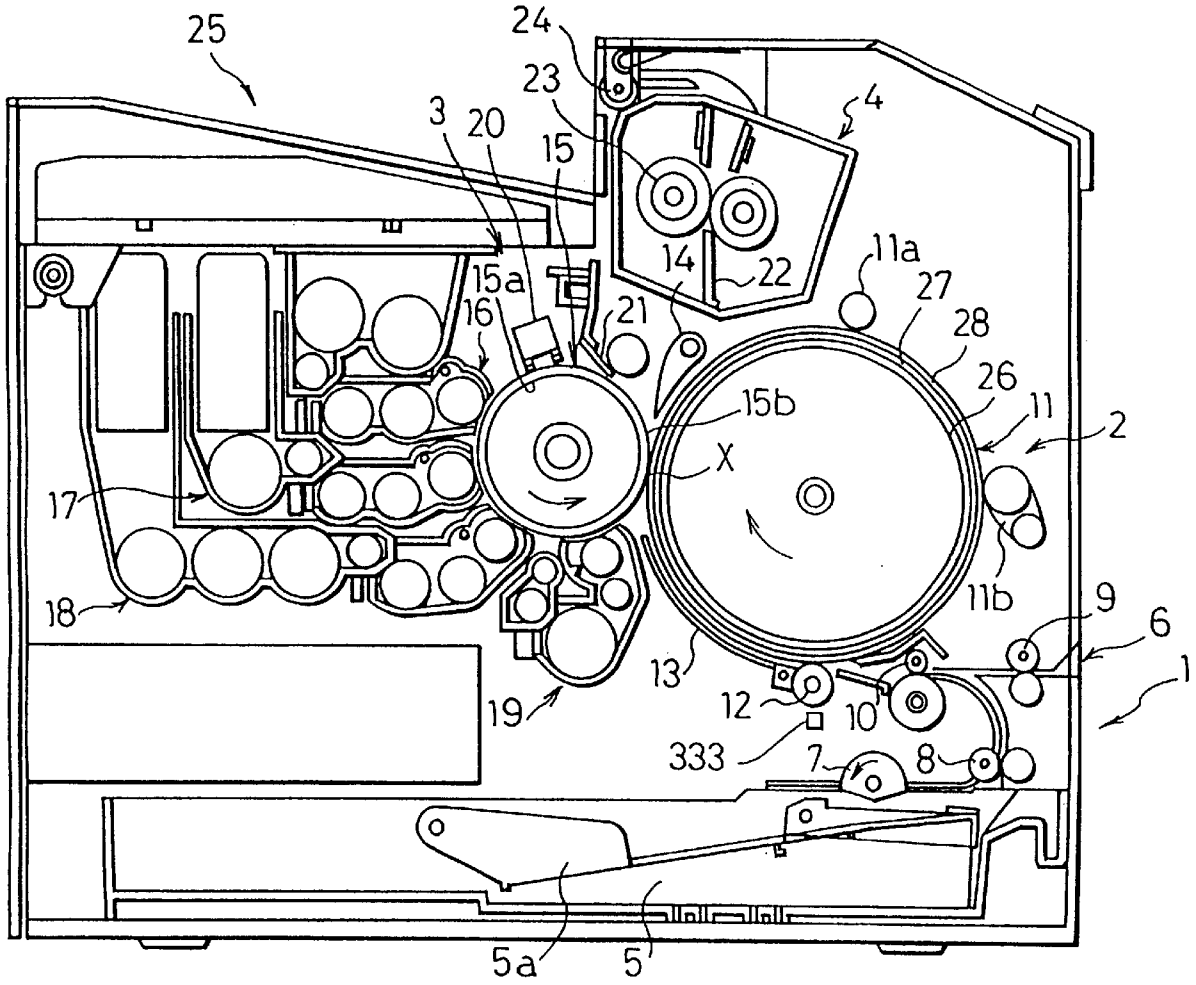
FIG. 58 is a schematic view showing a structure of an image forming apparatus in accordance with the thirteenth embodiment of the present invention.
Figure 62:
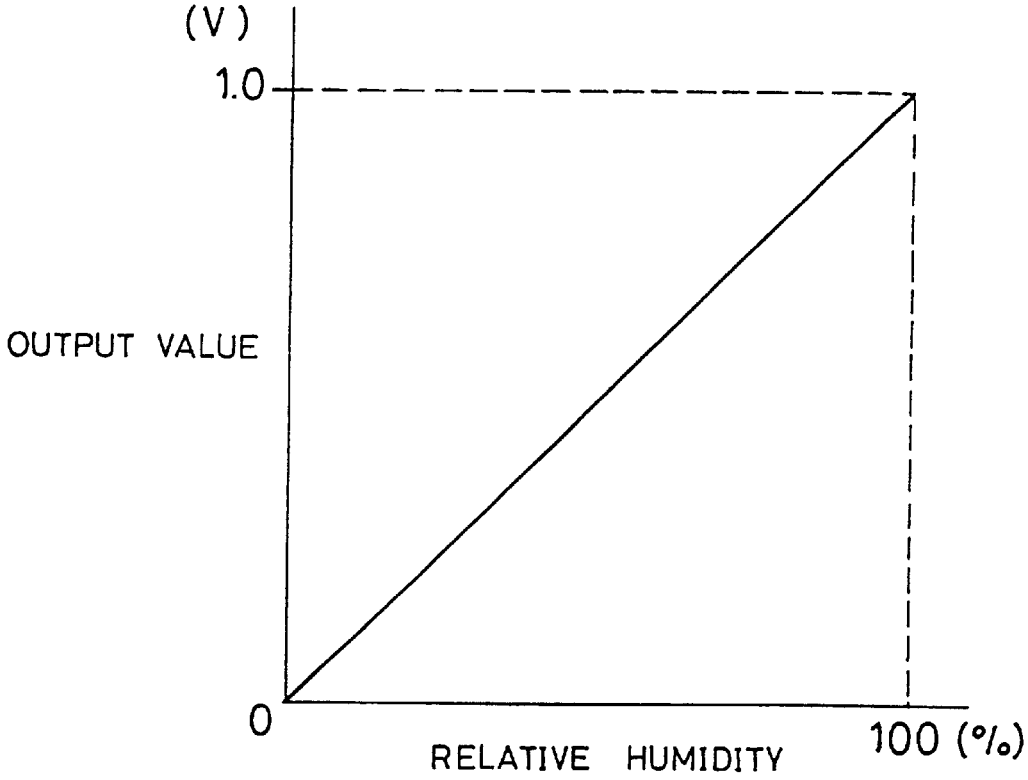
FIG. 62 is a graph showing a relation between an output value of a humidity sensor used in the image forming apparatus shown in FIG. 58 and relative humidity.

The humidity sensor 333, provided around the transfer drum 11 as shown in FIG. 58, measures relative humidity around the transfer drum 11, and converts the measured relative humidity into a voltage to output the same to the CPU 334. A commercially available unit is used as the humidity sensor 333. As shown in FIG. 62, the humidity sensor 333 of the present embodiment converts the relative humidity of 0 to 100% into a voltage of 0 to 1V and outputs the same in response to an input of 5V.

The CPU 334 receives a switching signal from the automatic•manual switch 340 so as to judge whether the image forming apparatus selects the mode based on the output values as set forth in TABLE 45 below, or the user selects the mode manually. Then, the CPU 334 reads out the data from the memory 335 in accordance with the judgment, and controls the transfer drum voltage applying device 341.

TABLE 45 shows the relation between the output values and selected modes.

TABLE 45

| HUMIDITY (%) | 0–39 | 40–69 | 70–100 |
|---|---|---|---|
| SENSOR'S OUTPUT VALUE (V) | 0–0.39 | 0.4–0.69 | 0.7–1.0 |
| SELECTED MODE | NORMAL | NORMAL | PAPER ADHESION |

The memory 335 records the data based on TABLE 44 and TABLE 45 and a control program run by the transfer drum voltage applying device 341.

The automatic•manual changeover switch 340 is used to switch an automatic setting to a manual setting and vice versa: in the automatic setting, the image forming apparatus sets the mode automatically, whereas in the manual setting, the user selects the mode or adjusts the applied voltage manually.

As shown in FIG. 61, the selection mode setting unit 337 includes a mode call up key 337*a*, a mode selection keys 337*b*•337*c*, and an enter key 337*d*, which are used when the user judges the operating environments and the kind of the transfer paper P and selects a desired mode. The mode call up key 337*a* calls up a mode selected by the image forming apparatus or user, and the called up mode, or namely, the selected mode, is framed by a selected mode display frame 339*a*. The mode selection keys 337*b*•337*c* are used when the user selects a desired mode depending on the operating environments or the kind of the transfer paper P. The enter key 337*d* is used to input the mode selected by the user using the mode selection keys 337*b*•337*c*. The mode entered by the enter key 337 is stored in the memory 335.

As shown in FIG. 61, the applied voltage setting unit 338 includes selection keys 338*a*•338*b*, and a selection number displaying unit 338*c*. When a resulting image in the normal mode is not satisfactory, the user fine-adjusts the applied voltage to the transfer drum 11 by selecting a selection number corresponding to a desired applied voltage using the selection keys 338*a*•338*b* based on his judgment while referring to the correspondence between the applied voltages and selection numbers as set forth in TABLE 46 below. The selected number is displayed on the selected number display unit 338*c*.

TABLE 46 below shows the correspondence between the C selection number and the applied voltage.

TABLE 46

| APPLIED VOLTAGE(kV) | 1.80 | 1.85 | 1.90 | 1.95 | 2.00 | 2.05 |
|---|---|---|---|---|---|---|
| SELECTION No. | NORMAL MODE(0) | +1 | +2 | +3 | +4 | +5 |

The mode display unit 339 displays each mode, and the mode currently selected by the image forming apparatus or user is framed by the selected mode display frame 339*a*.

How the image forming apparatus selects a desired mode will be explained in the following.

As shown in FIG. 60, upon receipt of an automatic setting switching signal from the automatic•manual changeover switch 340, the CPU 334 reads out the data from the memory 335, and judges that it is the image forming apparatus that selects a desired mode based on the readout data. Subsequently, the CPU 334 receives the output value from the humidity sensor 333, and selects a mode from TABLE 45 using the output value, determining the attracting voltage and transferring voltage shown in TABLE 44. Accordingly, the CPU 334 sends an instruction based on the above voltages to the power source unit 32. The power source unit 32 applies the above voltages to the transfer drum 11 to start the attraction of the transfer paper P and toner image transfer. In other words, when the normal mode is selected for a full color print, the attracting voltage is applied to the transfer drum 11 when the transfer drum 11 makes the first turn, so that the transfer paper P is attracted to the transfer drum 11 and the transfer of the toner image starts. The transferring voltage is applied to the transfer drum 11 from the second and following turns to continue the transfer process. In contrast, when the paper adhesion mode is selected, the attracting voltage is applied to the transfer drum 11 when the transfer drum 11 makes the first turn, so that the transfer paper P is attracted to the transfer drum 11, and the transferring voltage is applied to the transfer drum 11 when the transfer drum 11 makes the second turn to start the toner image transfer.

The cardboard is not easily attracted even when the relative humidity is in a range between 40 and 70%; however, the above image forming apparatus may erroneously judge the cardboard as to be a normal paper based on the humidity, and the quality of a resulting image may not be satisfactory. Thus, if the cardboard is used, it is more efficient and reliable when the user selects the cardboard mode. Thus, as shown in FIG. 61, a currently selected mode is called up with the mode call up key 337*a*, then the cardboard mode is selected with the mode selection keys 337*b*•337*c*, and then the cardboard mode is inputted with the enter key 337*d*. At the same time, as shown in FIG. 60, the CPU 334 prepares so that it can change the normal mode to cardboard mode. However, when the CPU 334 has switched the mode to the paper adhesion mode when the humidity is about 70%, it is not necessary to switch the mode to the cardboard mode.

Next, how the user switches the mode to a desired one will be explained.

The user judges the operating environments and the kind of the transfer paper P, and selects an optimal mode from the three modes with the mode selecting keys 337*b*•337*c*. As shown in FIG. 60, upon receipt of the manual setting switching signal from the automatic•manual changeover switch 340, the CPU 334 reads out the data from the memory 335, and judges that it is the user that selects the mode based on the readout data. The readout data are processed in the same manner as above, and CPU 334 sends an instruction to the power source unit 32, which accordingly applies a voltage to the transfer drum 11 to start the attraction of the transfer paper P and transfer of the toner image in the same manner as above. As shown in FIG. 61, the selected mode is framed by the selected mode display frame 339*a* in the mode display unit 339.

When the user judges that the toner image was not transferred onto the transfer paper P satisfactorily in any of the above three modes, he makes the CPU 334 select the normal mode so that he can change the attracting voltage alone in the normal mode. Here, the user selects a selection number using the selection keys 338•338*b* as shown in FIG. 61.

The selection numbers are displayed on the selection number display unit 338*c*. As shown in FIG. 60, the selected number is sent to the CPU 334 through the applied voltage setting unit 338. The CPU 334 selects a voltage value corresponding to the selection number as shown in TABLE 46. Accordingly, the voltage thus found is treated as the attracting voltage in the normal mode and sent to the power source unit 32. As a result, the power source unit 32 applies a corresponding voltage to the transfer drum 11 to start the attraction of the transfer paper P and the transfer of the toner image.

[FOURTEENTH EMBODIMENT]

Still another embodiment of the present embodiment will be explained in the following while referring to FIGS. 63 through 67, and FIGS. 68(*a*) through 68(*d*).

The transfer drum 11 of the present embodiment is of the same structure as that of the counterpart of the thirteenth embodiment. The transfer paper P is attracted to the transfer drum 11 and a toner image is transferred onto the transfer paper P in the same manner as the first embodiment.

Figure 63:
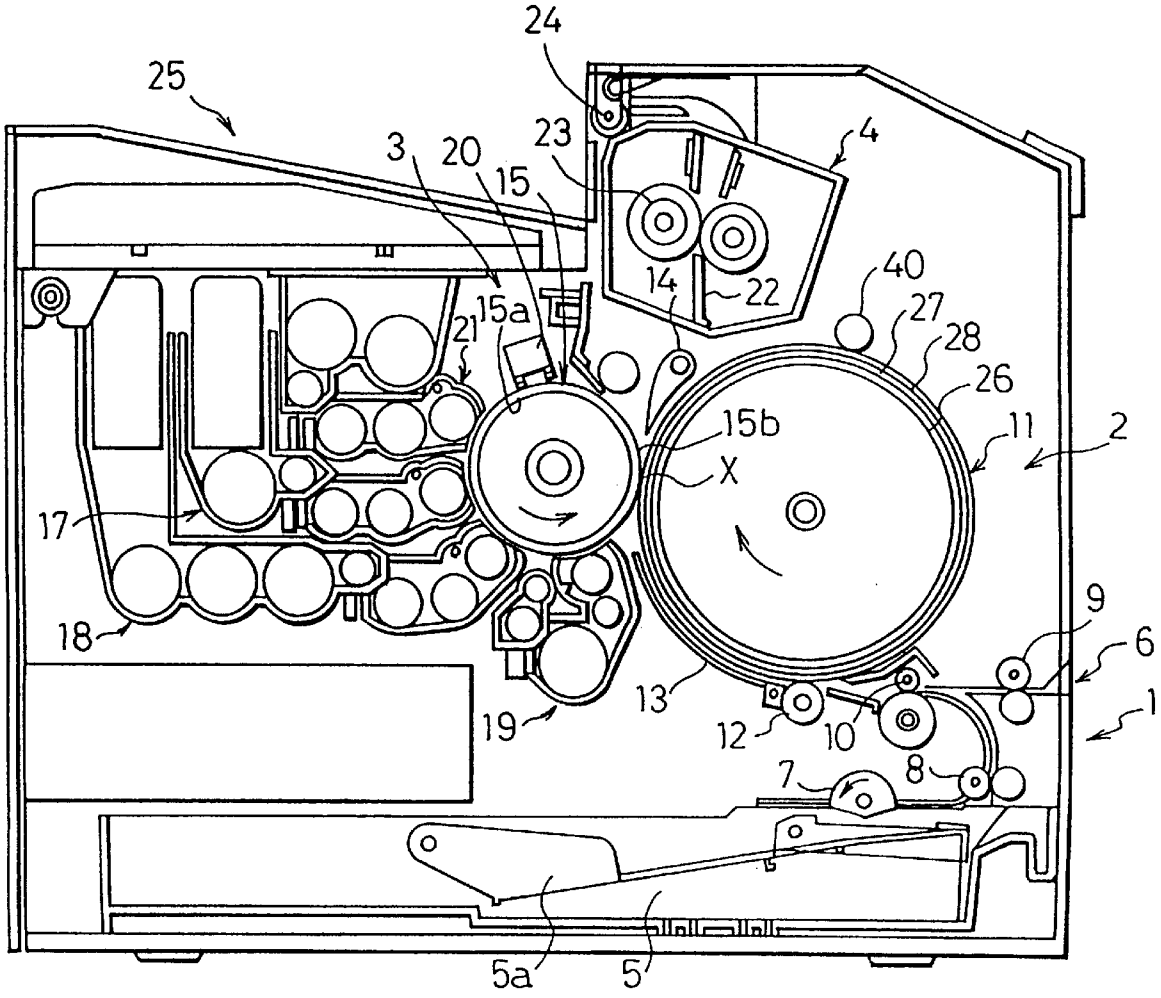
FIG. 63 is a schematic view showing a structure of an image forming apparatus in accordance with the fourteenth embodiment of the present invention.

An image forming apparatus of the present embodiment includes a roller type conductive brush 40 shown in FIG. 63 instead of the charge removing device 11*a* and cleaning device 11*b* of the first embodiment.

A structure enabling the cleaning and charge removing operations for the transfer drum 11 will be explained in the following.

Figure 64:
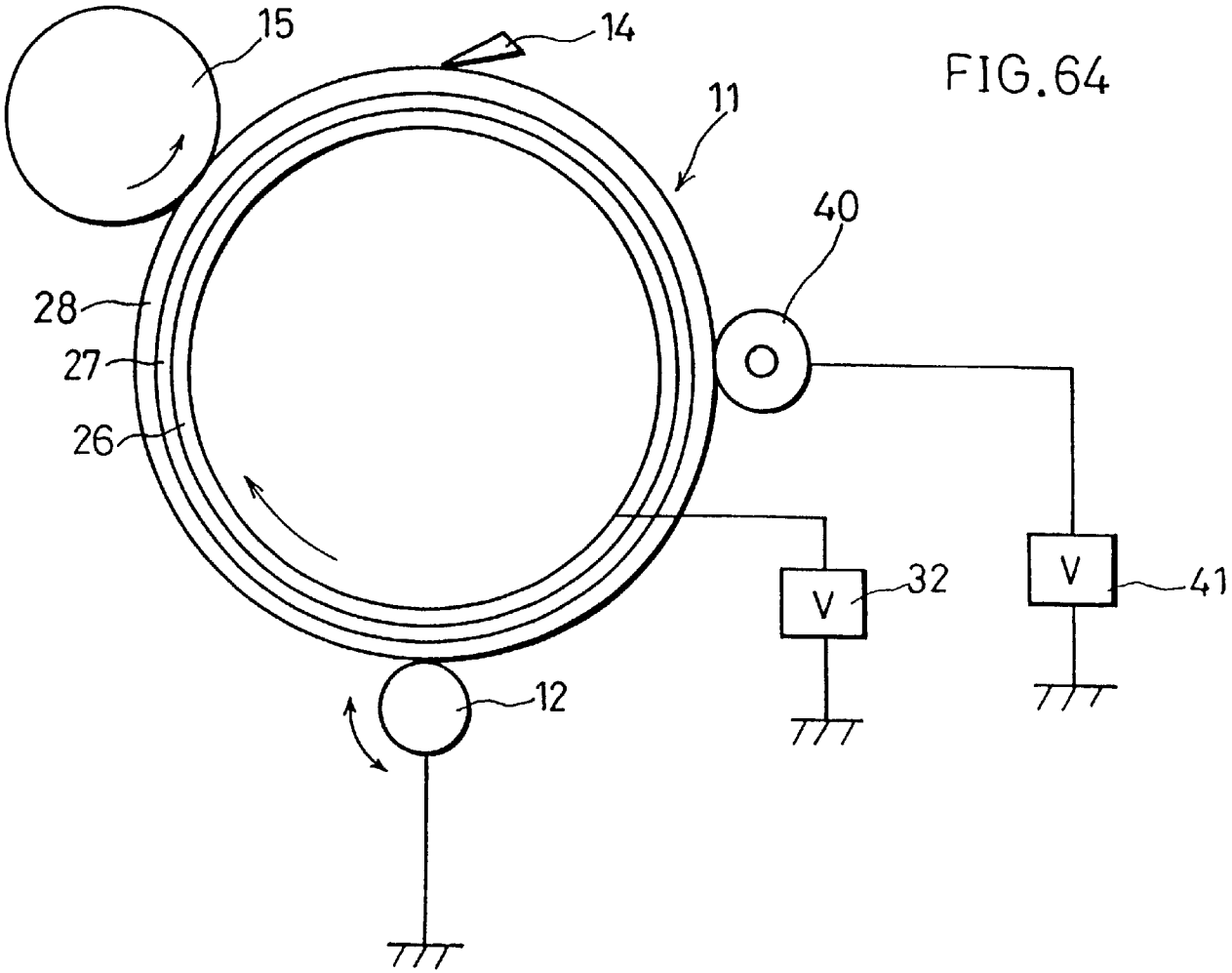
FIG. 64 is a diagram schematically showing a charge removing device of the image forming apparatus shown in FIG. 63.
Figure 65:
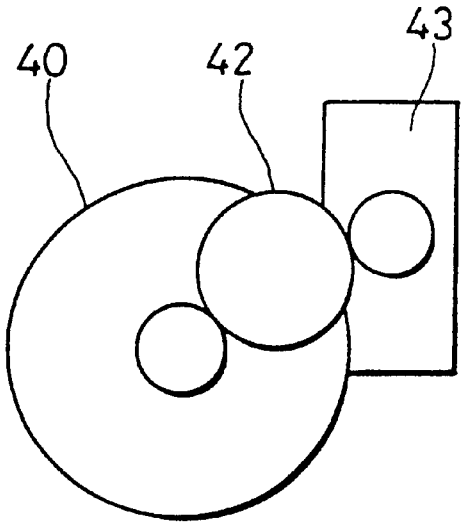
FIG. 65 is a view schematically explaining a structure of a rotation driving device of the charge removing device shown in FIG. 63.
Figure 66:
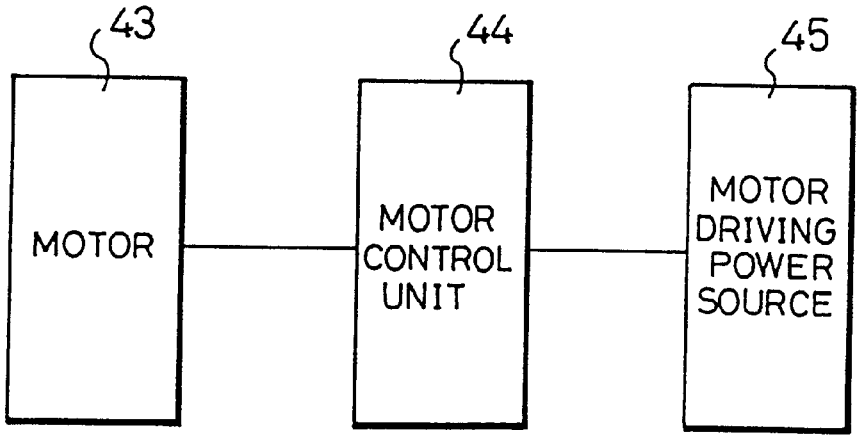
FIG. 66 is a block diagram schematically showing control means of the rotation driving device shown in FIG. 63.

The image forming apparatus of the present embodiment includes a roller type conductive brush 40, a power source unit 41, a gear 42, a motor 43, a motor control unit 44, and a motor driving power source 45 as shown in FIGS. 64 through 66.

The power source unit 41 applies a voltage to the roller type conductive brush 40 to remove the charges on the transfer drum 11. The gear 42 conveys a driving force generated by the motor 43 to the roller type conductive brush 40. The motor 43 generates the driving force to rotate the roller type conductive brush 40. The motor control unit 44 controls the voltage of the motor driving power source 45 and sets an adequate number of rotation times of the motor 43. The motor driving power source 45 applies a voltage to the motor 43 through the motor control unit 44.

The transfer drum 11 keeps rotating until the transfer operation ends and the transfer paper P is separated from the transfer drum 11 by the separating claw 14. The roller type conductive brush 40 is moved so as to touch the transfer drum 11 by unillustrated driving means under these conditions to remove the charges on the transfer drum 11.

The amount of crossover of the transfer drum 11 and roller type conductive brush 40, and the corresponding charge removing effect on the transfer drum 11 are set forth in TABLE 47 below. Note that the amount of crossover referred herein means the amount of thrust of the roller type conductive brush 40 into the transfer drum 11.

TABLE 47

| AMOUNT OF CROSSOVER (mm) | −0.5 OR LESS | 0.0 | 0.5 | 1.0 | 2.0 | 3.0 | 5.0 OR MORE |
|---|---|---|---|---|---|---|---|
| CHARGE REMOVING EFFECT | X | ○ | ◎ | ◎ | ◎ | ◎ | ○ |

◎: EXCELLENT
○: FAIR
X: NONE

TABLE 47 reveals that the charge removing effect can be obtained when the roller type conductive brush 40 and transfer drum 11 are brought into contact with each other, and in particular, the charge removing effect is enhanced when the amount of crossover is in a range between 0.5 and 3.0 mm.

A voltage is applied to the transfer drum 11 from the power source unit 32, and a voltage is applied to the roller type conductive brush 40 from the power source unit 41. When the charge removing operation starts, the residual charges on the surface of the transfer drum 11 and those on the roller type conductive brush 40 are released to the ground through the grounded roller type conductive brush 40 and power source unit 41. The relation between the applied voltage to the roller type conductive brush 40 with respect to the transfer drum 11 and the charge removing effect on the transfer drum 11 is set forth in TABLE 48 below.

TABLE 48

| VOLTAGE(V) | −100 OR LESS | 0 | 100 | 300 | 500 | 700 | 1000 | 1500 OR MORE |
|---|---|---|---|---|---|---|---|---|
| CHARGE REMOVING EFFECT | X | ○ | ○ | ○ | ◎ | ◎ | ◎ | ○ |

◎: EXCELLENT
○: FAIR
X: NONE

In TABLE 48, a negative voltage means that a voltage applied to the transfer drum 11 from the power source unit 32 is higher than the one applied to the roller type conductive brush 40.

TABLE 48 reveals that the charge removing effect can be obtained when a voltage applied to the roller type conductive brush 40 is not less than 0V nor more than 1500V higher the one applied to the transfer drum 11, and in particular, the charge removing effect is enhanced when a voltage applied to the roller type conductive brush 40 is not less than 500V nor more than 1000V higher than the one applied to the transfer drum 11. The reason is as follows. A current flows when a polarized electrode is energized and the charges of the transferring body are removed. However, not all of the charges are removed when the voltages of the same level are applied to the transferring body and charge removing brush, respectively. Thus, when a voltage higher than a voltage applied to the transfer drum is applied to the charge removing brush, the polarized charges are attracted to the charge removing brush and removed completely.

The transfer drum 11 and roller type conductive brush 40 rotate, for example, at the same speed, and the residual charges on the transfer drum 11 are removed through the roller type conductive brush 40. Further, the charge removing effect on the transfer drum can be upgraded if a difference in relative speed is given to the roller type conductive brush 40 with respect to the transfer drum 11. The relation between a relative rotation speed (circumferential speed) of the roller type conductive brush 40 with respect to the rotating speed (circumferential speed) of the transfer drum 11 and the charge removing effect on the transfer drum 11 is set forth in TABLE 49 below.

TABLE 49

| SPEED OF ROLLER TYPE CONDUCTIVE BRUSH | SLOWER | | | | | FASTER | | | |
|---|---|---|---|---|---|---|---|---|---|
| WITH RESPECT TO TRANSFER DRUM | 80% OR MORE | 50% | 40% | 20% | SAME | 20% | 40% | 60% | 80% OR MORE |
| CHARGE REMOVING EFFECT | ◎ | ◎ | ○ | ○ | ○ | ○ | ◎ | ◎ | ◎ |

◎: EXCELLENT
○: FAIR

TABLE 49 reveals that the charge removing effect on the transfer drum 11 can be obtained regardless of the relative speed of the roller type conductive brush 40 with respect to the transfer drum 11; however, it is preferable if the roller type conductive brush 40 rotates not less than 50% slower or not less than 40% faster than the transfer drum 11 does. Although, it is not shown in TABLE 49, when the roller type conductive brush 40 rotates not less than 200% faster than the transfer drum 11, not only the charge removing effect, but also the cleaning effect can be upgraded.

The charge removing effect varies depending on the amount of brush making contact with the transfer drum 11, or namely, the brush density. The relation between the brush density of the roller type conductive brush 40 and the charge removing effect on the transfer drum 11 is set forth in TABLE 50 below.

TABLE 50

| NUMBER OF BRUSHES PER SQUARE CENTIMETER (ps/cm$^2$) | 3000 OR LESS | 5000 | 10000 | 15000 | 20000 | 25000 | 30000 OR MORE |
|---|---|---|---|---|---|---|---|
| CHARGE REMOVING EFFECT | X | Δ | Δ | ○ | ◎ | ◎ | ◎ |

◎: EXCELLENT
○: FAIR
Δ: POOR
X: ALMOST NONE

TABLE 50 reveals that the charge removing effect on the transfer drum 11 can be obtained when the brush density of the roller type conductive brush 40 is 15000 pieces/cm$^2$ or more, and in particular, the charge removing effect is enhanced when the brush density is 20000 pieces/cm$^2$ or more.

The roller type conductive brush 40 presses the tip of the brush to the transfer drum 11, and for this reason, the charge removing effect varies depending on the resistance values of the brush. The resistance value of the brush is measured under the following conditions: the brush portion of the roller type conductive brush 40 is brought into contact with a metal roller with the amount of thrust of 1.0 mm, then the metal roller and the roller type conductive brush 40 are rotated at 90 rpm and 100 rpm, respectively, and then a voltage of 100V is applied to the brush portion.

The relation between the resistance value of the brush and the charge removing effect on the transfer drum 11 is set forth in TABLE 51.

TABLE 51

| RESISTANCE VALUE OF BRUSHES(KΩ) | 70 OR MORE | 60 | 50 | 40 | 36 | 20 | 10 | 5 OR LESS |
|---|---|---|---|---|---|---|---|---|
| CHARGE REMOVING EFFECT | X | Δ | Δ | ○ | ◎ | ◎ | ◎ | ◎ |

◎: EXCELLENT
○: FAIR
Δ: POOR
X: ALMOST NONE

TABLE 51 reveals that the charge removing effect of the transfer drum 11 can be obtained when the resistance value of the brushes is 40 kΩ or less, and particularly, the charge removing effect is enhanced when the resistance value of the brushes is 36 kΩ or less. The brushes are made of conductive materials such as a stainless fiber, a carbon fiber, a copper-dyed acrylic fiber, an ST conductive non-woven fabric.

Next, the removing operation of the residual toner on the transfer drum 11, or namely, the cleaning operation will be explained.

The cleaning operation is carried out at the same time as the charge removing operation. As shown in FIG. 64, the brush portion (not shown) of the roller type conductive brush 40 is brought into contact with the surface of the transfer drum 11, so that the brush portion can scape off the residual toner adhering to the transfer drum 11. The toner adhering to the brush portion is dusted by an unillustrated flicker bar or the like and collected into an unillustrated filter through vacuuming using an unillustrated blower.

The charge removing and cleaning operations are performed each time the transfer operation ends, and continue until the transfer drum 11 makes a full turn. The roller type conductive brush 40 is separated from the transfer drum 11 when the charge removing operation ends. Since the roller type conductive brush 40 has both the charge removing function and the cleaning function, the image forming apparatus demands fewer components and thus the manufacturing costs can be saved.

Figure 67:
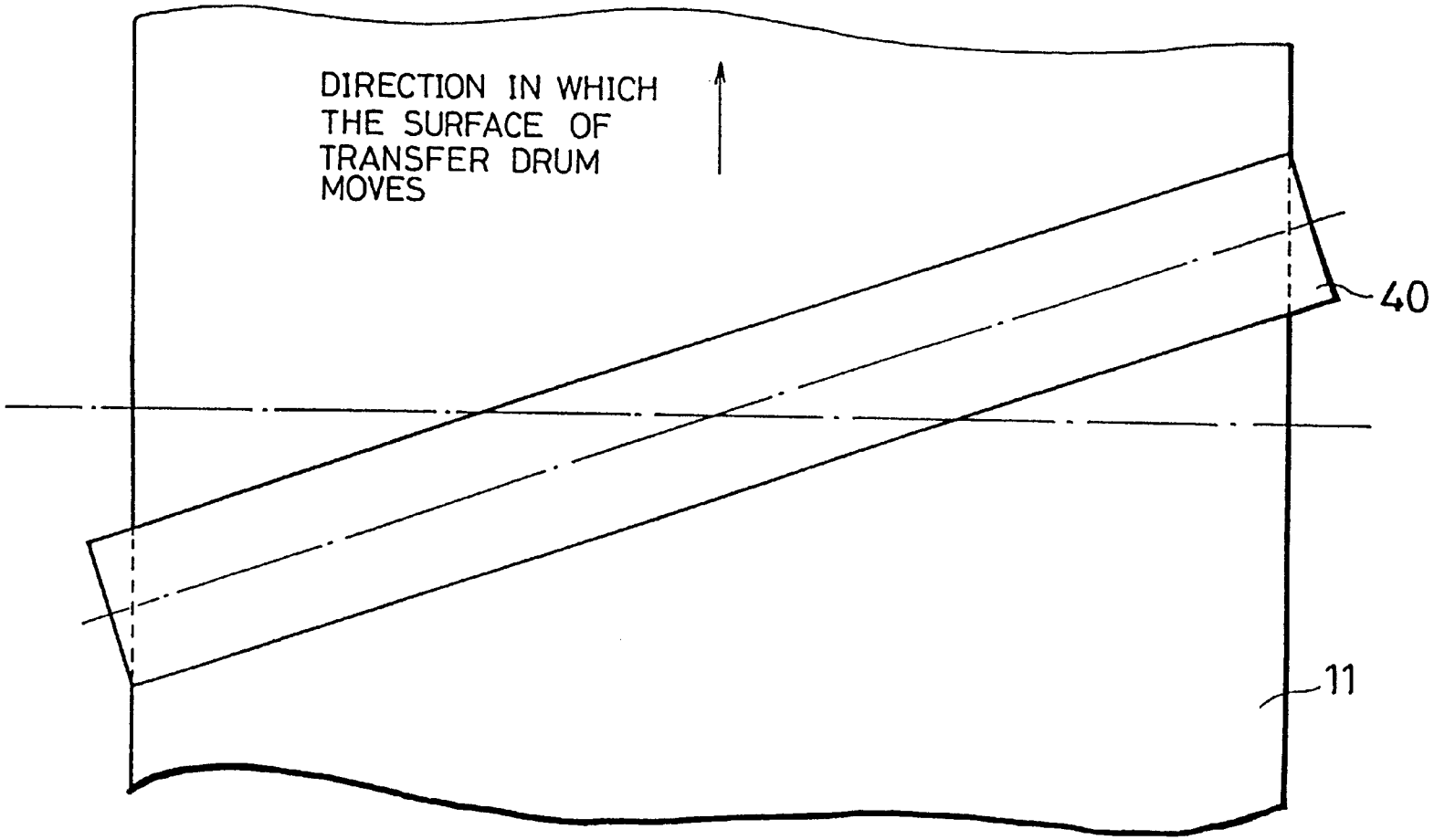
FIG. 67 is a view explaining a position of a roller type conductive brush shown in FIG. 64 with respect'to the transfer drum.
Figure 68A:
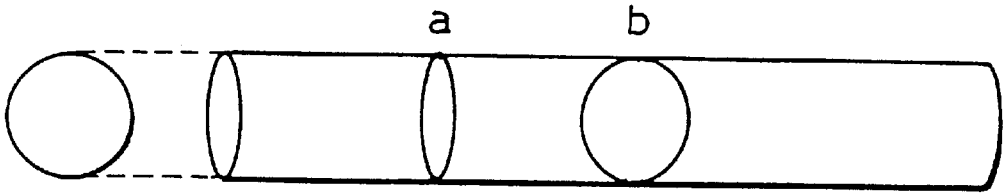
FIG. 68(*a*) is a schematic perspective view explaining effectiveness of the roller type conductive brush shown in FIG. 67 depending on the position and orientation thereof.
Figure 68B:
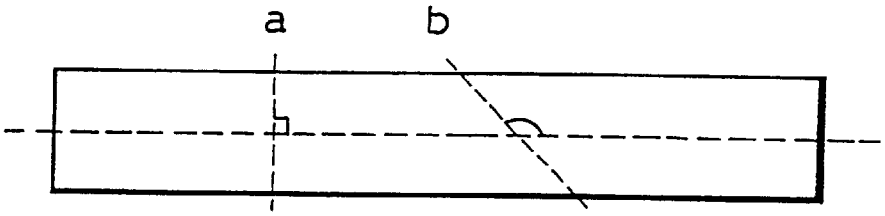
Figure 68C:
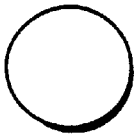
Figure 68D:
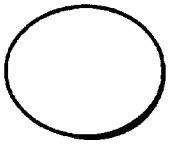
Figure 69:
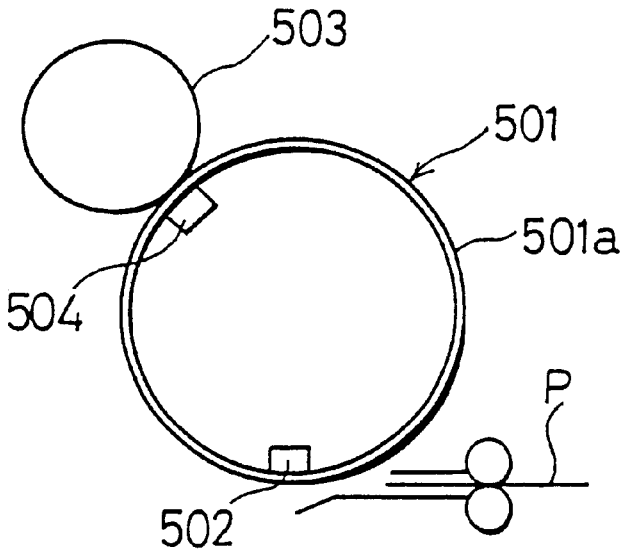
FIG. 69 is a schematic view showing a structure of a conventional image forming apparatus.
Figure 70:
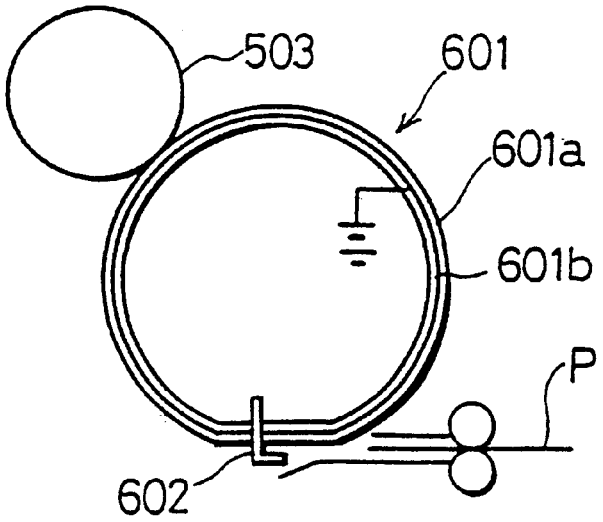
FIG. 70 is a schematic view showing a structure of another conventional image forming apparatus.
Figure 71:
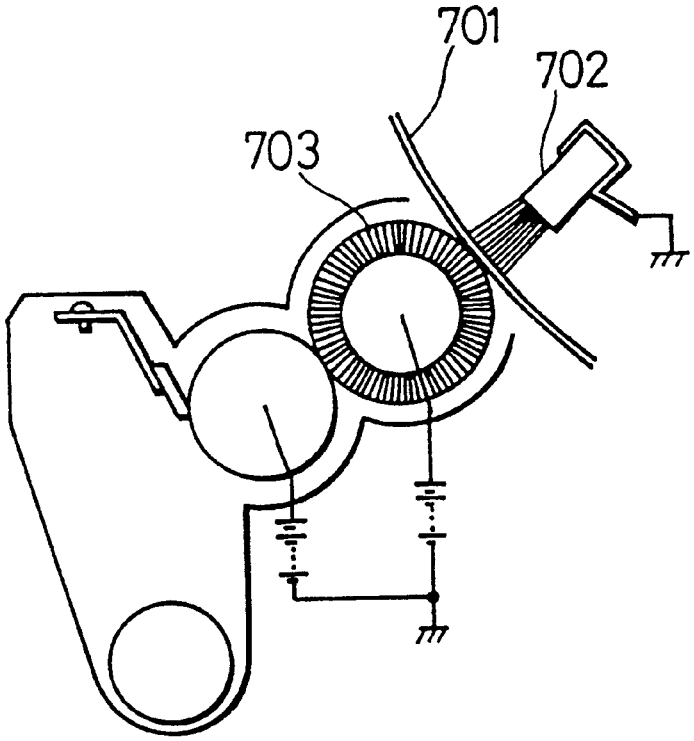
FIG. 71 is a schematic view showing a structure of still another conventional image forming apparatus.

As shown in FIG. 67, it is preferable that the axis of rotation of the roller type conductive brush 40 is tilted with respect to a direction in which the roller type conductive brush 40 intersects at right angles with a direction in which the surface of the transfer drum 11 moves, which will be explained in detail while referring to FIGS. 68(*a*) through 68(*d*). FIG. 68(*a*) is a schematic perspective view of the roller type conductive brush 40 and FIG. 68(*b*) is a plan view of the roller type conductive brush 40. FIG. 68(*c*) is a front view of a virtual cross section a shown in FIGS. 68(*a*) and 68(*b*), and FIG. 68(*d*) is a front view of another virtual cross section b shown in FIGS. 68(*a*) and 68(*b*). When the axis of rotation of the roller type conductive brush 40 does not intersect at right angles with the direction in which the surface of the transfer drum 11 moves, which is indicated by a small letter b in FIG. 68(*b*), the cross section area of the roller type conductive brush 40 seen from the direction in which the surface of the transfer drum 11 moves (indicated by an arrow in FIG. 67) expands and the major diameter of the roller type conductive brush 40 seen from the direction in which the surface of the transfer drum 11 moves (indicated by the arrow in the drawing) becomes larger as shown in FIGS. 68(*a*), 68(*c*), and 68(*d*) compared with a case when the axis of rotation of the roller type conductive brush 40 intersects at right angles with the direction in which the surface of the transfer drum 11 moves, which is indicated by a small letter a in FIG. 68(*a*). As a result, the roller type conductive brush 40 makes contact with the transfer drum 11 in a larger area, thereby making it possible to improve the charge removing effect without upsizing the roller type conductive brush 40 in diameter.

The invention being thus described, it will be obvious that the same may be varied in many ways. Such variations are not to be regarded as a departure from the spirit and scope of the invention, and all such modification as would be obvious to one skilled in the art are intended to be included within the scope of the following claims.

What is claimed is:

1. An image forming apparatus comprising:

an image carrying body on which a toner image is formed;

transfer means for transferring the toner image formed on said image carrying body onto a transfer paper by bringing the transfer paper into contact with said image carrying body, said transfer means attracting and holding the transfer paper electrostatically, said transfer means including at least a dielectric layer on an outer surface side and a semi-conductive layer and a conductive layer on an inner surface side;

voltage applying means, connected to said conductive layer, for applying a predetermined voltage to said conductive layer;

potential difference generating means for pressing the transfer paper against a surface of said transfer means, and for generating a potential difference between said conductive layer to which the voltage is applied and the transfer paper; and transfer paper charging means, provided on an upstream side of said potential difference generating means in a direction in which the transfer paper is transported, for charging the transfer paper to a polarity reversed to that of a polarity of said transfer means.

2. The image forming apparatus as defined in claim 1, wherein said potential difference generating means is a grounded conductive electrode member.

3. The image forming apparatus as defined in claim 1 further comprising pre-curl means for giving a curvature to a transfer paper supplied to a section between said transfer means and said potential difference generating means.

4. The image forming apparatus as defined in claim 1 further comprising charge removing means for removing charges on the surface of said transfer means.

5. The image forming apparatus as defined in claim 1 further comprising cleaning means for cleaning the surface of said transfer means.

6. The image forming apparatus as defined in claim 1, wherein said transfer means is of a layered structure of said dielectric layer, said semi-conductive layer, and said conductive layer, which are laminated in this order from a contact surface side of the transfer paper.

7. The image forming apparatus as defined in claim 6, wherein said dielectric layer and said semi-conductive layer are made into a two-layer one-piece sheet.

8. The image forming apparatus as defined in claim 6, wherein said semi-conductive layer is made of a semi-conductive elastic body.

9. The image forming apparatus as defined in claim 1, wherein said conductive layer and said voltage applying means are connected to each other through an electric resistor.

10. The image forming apparatus as defined in claim 1, wherein said potential difference generating means includes a conductive roller made of a conductive material.

11. The image forming apparatus as defined in claim 1, wherein said potential difference generating means includes a roller type brush made of a conductive material.

12. The image forming apparatus as defined in claim 1, wherein said potential difference generating means includes a comb-shaped brush made of a conductive material.

13. The image forming apparatus as defined in claim 11, wherein an electric resistance value of said roller type brush is set to 36 kΩ or less.

14. The image forming apparatus as defined in claim 12, wherein an electric resistance value of said comb-shaped brush is set to 36 kΩ or less.

15. The image forming apparatus as defined in claim 12, wherein said comb-shaped brush has a plurality of groups of brush bristles on a brush supporting member, each-group of brush bristles including a predetermined number of brush bristles, a pitch between said plurality of groups of brush bristles being set to 1.6 mm or less.

16. The image forming apparatus as defined in claim 10, wherein said transfer means is made into a cylinder to serve as a transfer drum, whereby said conductive roller is rotatably driven by said transfer drum.

17. The image-forming apparatus as defined in claim 11, wherein said transfer means is made into a cylinder to serve as a transfer drum, whereby said roller type brush rotates together with said transfer drum.

18. The image forming apparatus as defined in claim 10, wherein said transfer means is made into a cylinder to serve as a transfer drum and an amount of crossover of said conductive roller and said transfer drum is set in a range between 0.5 mm and 3.0 mm inclusive.

19. The image forming apparatus as defined in claim 12, wherein said transfer means is made into a cylinder to serve as a transfer drum and an amount of crossover of said roller type brush and said transfer drum is set in a range between 0.5 mm and 3.0 mm inclusive.

20. The image forming apparatus as defined in claim 12, wherein said transfer means is made into a cylinder to serve as a transfer drum and an amount of crossover of said comb-shaped brush and said transfer drum is set in a range between 0.5 mm and 3.0 mm inclusive.

21. The image forming apparatus as defined in claim 1, wherein said potential difference generating means is movable to touch and separate from the surface of said transfer means so that said potential difference generating means separates from said transfer means after the transfer paper adheres to said transfer means, an amount of spacing between said potential difference generating means and said transfer means being set to 1.0 mm or more.

22. The image forming apparatus as defined in claim 1, wherein said transfer paper charging means is a plate member which charges the transfer paper by friction between the transfer paper and said plate member.

23. The image forming apparatus as defined in claim 22, wherein said plate member is at least 50 mm long in a direction in which the transfer paper is transported.

24. An image forming apparatus comprising:

an image carrying body on which a toner image is formed;

transfer means for transferring the toner image formed on said image carrying body onto a transfer paper by bringing the transfer paper into contact with said image carrying body, said transfer means attracting and holding the transfer paper electrostatically, said transfer means including at least a dielectric layer on an outer surface side and a semi-conductive layer and a conductive layer on an inner surface side;

voltage applying means, connected to said conductive layer, for applying a predetermined voltage to said conductive layer;

potential difference generating means for pressing the transfer paper against a surface of said transfer means, and for generating a potential difference between said conductive layer to which the voltage is applied and the transfer paper; and transfer paper charging means for charging the transfer paper in a polarity reversed to a polarity of said transfer means, wherein said potential difference generating means is a grounded conductive electrode member, and said transfer paper charging means is provided on a surface of said electrode member and is a charged layer for charging the transfer paper by friction between the transfer paper and said surface portion.

25. An image forming apparatus comprising:

an image carrying body on which a toner image is formed;

a transferrer for transferring the toner image formed on said image carrying body onto a transfer paper by bringing the transfer paper into contact with said image carrying body, said transferrer attracting and holding the transfer paper electrostatically and including at least a dielectric layer on an outer surface side and a semiconductive layer and a conductive layer on an inner surface side;

a voltage applier, connected to said conductive layer, for applying a predetermined voltage to said conductive layer;

a potential difference generator for pressing the transfer paper against a surface of said transferrer, and for generating a potential difference between said conductive layer to which the voltage is applied and the transfer paper; and a transfer paper charger, provided on an upstream side of said potential difference generator in a direction in which the transfer paper is transported, for charging the transfer paper to a polarity reversed to that of a polarity of said transferrer.

26. The image forming apparatus as defined in claim 24, wherein said charged layer is composed of glass or nylon.

27. The image forming apparatus as defined in claim 24, wherein said charged layer is composed of polytetrafluoroethylene.

* * * * *